US010703594B2

(12) United States Patent
Furusawa et al.

(10) Patent No.: US 10,703,594 B2
(45) Date of Patent: Jul. 7, 2020

(54) SHEET CONVEYANCE APPARATUS

(71) Applicant: CANON KABUSHIKI KAISHA, Tokyo (JP)

(72) Inventors: Motohiro Furusawa, Shizuoka (JP); Atsushi Ogata, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 67 days.

(21) Appl. No.: 16/166,458

(22) Filed: Oct. 22, 2018

(65) Prior Publication Data

US 2019/0127164 A1 May 2, 2019

(30) Foreign Application Priority Data

Oct. 30, 2017 (JP) ..... 2017-209838
Oct. 5, 2018 (JP) ..... 2018-190128

(51) Int. Cl.

| | |
|---|---|
| ***B65H 5/06*** | (2006.01) |
| ***B65H 85/00*** | (2006.01) |
| ***B65H 3/52*** | (2006.01) |
| ***B65H 3/06*** | (2006.01) |
| ***B65H 29/58*** | (2006.01) |

(52) U.S. Cl.

CPC ..... *B65H 5/062* (2013.01); *B65H 3/06* (2013.01); *B65H 3/5261* (2013.01); *B65H 29/58* (2013.01); *B65H 85/00* (2013.01); *B65H 2301/3332* (2013.01); *B65H 2301/33312* (2013.01); *B65H 2403/722* (2013.01); *B65H 2801/06* (2013.01)

(58) Field of Classification Search

CPC ..... B65H 2403/70; B65H 2403/722; B65H 2404/63; B65H 2404/631; B65H 2404/632; B65H 2404/633; B65H 29/58; B65H 85/00; B65H 2301/3332; B65H 2301/33312

See application file for complete search history.

(56) References Cited

U.S. PATENT DOCUMENTS

| | | | | |
|---|---|---|---|---|
| 7,431,293 | B2 * | 10/2008 | Carter | B65H 29/58 271/303 |
| 7,918,451 | B2 * | 4/2011 | Honda | B65H 29/12 271/225 |
| 8,439,358 | B2 | 5/2013 | Watanabe et al. | |
| 8,613,445 | B2 * | 12/2013 | Nishii | B65H 85/00 271/186 |

(Continued)

FOREIGN PATENT DOCUMENTS

| | | |
|---|---|---|
| JP | 2007-076881 A | 3/2007 |
| JP | 2008-070489 A | 3/2008 |

(Continued)

*Primary Examiner* — Jeremy R Severson
(74) *Attorney, Agent, or Firm* — Venable LLP

(57) ABSTRACT

A sheet conveyance apparatus is configured to interlock a first transmission mechanism and a second transmission mechanism such that the second transmission mechanism switches a rotational driving direction of a reverse rotary member between a normal rotation direction and a reverse rotation direction with a delay with respect to the first transmission mechanism starting transmission of a rotational driving force such that a guide member pivots between a first pivot position and a second pivot position.

11 Claims, 42 Drawing Sheets

(56) References Cited

U.S. PATENT DOCUMENTS

| | | | | |
|---|---|---|---|---|
| 8,666,297 | B2 * | 3/2014 | Honda | G03G 15/00 271/256 |
| 8,720,886 | B2 | 5/2014 | Kuroda et al. | |
| 8,740,215 | B2 | 6/2014 | Watanabe et al. | |
| 8,849,178 | B2 | 9/2014 | Yoshimura et al. | |
| 8,919,773 | B2 * | 12/2014 | Kato | B65H 85/00 271/186 |
| 8,964,271 | B2 | 2/2015 | Kaneko et al. | |
| 9,296,585 | B2 | 3/2016 | Yamada | |
| 9,395,672 | B2 | 7/2016 | Kaneko et al. | |
| 9,656,819 | B2 | 5/2017 | Yamada | |
| 2010/0192710 | A9 * | 8/2010 | Hanashima | B65H 1/14 74/55 |

FOREIGN PATENT DOCUMENTS

| | | | |
|---|---|---|---|
| JP | 2013-242362 | A | 12/2013 |
| JP | 2017-007761 | A | 1/2017 |
| JP | 2017-052655 | A | 3/2017 |

* cited by examiner

SHEET CONVEYANCE APPARATUS

BACKGROUND OF THE INVENTION

Field of the Invention

The present invention relates to a sheet conveyance apparatus configured to convey a sheet.

Description of the Related Art

In recent years, it has been desired that an image forming apparatus saves further resources. In addition, since use of duplex recording has become more diverse, increase in printing speed in duplex recording is desired to improve production efficiency.

For example, as disclosed in Japanese Patent Laid-Open No. 2008-70489, a configuration in which, in the case of performing duplex recording, a sheet is switched back and conveyed by rotating a conveyance roller in a reverse rotation direction after recording on one surface, conveyed into a duplex conveyance path and front and back surfaces thereof are inverted, and an image is formed on the other surface by conveying the sheet to an image forming portion again.

Meanwhile, for example, as disclosed in Japanese Patent Laid-Open No. 2013-242362, a configuration of improving the production efficiency by switching a discharge conveyance path and an inversion conveyance path by using a guide member configured to switch a conveyance path of the sheet and alternately conveying a sheet one surface of which has been subjected to recording and a sheet both surfaces of which have been subjected to recording. To be noted, the guide member of this kind configured to switch the conveyance path of the sheet is sometimes also referred to as a flap or a flapper. In this configuration of Japanese Patent Laid-Open No. 2013-242362, a sheet both surfaces of which have been subjected to recording can be discharged by a conveyance roller while a sheet one surface of which has been subjected to recording is switched back by a reverse conveyance roller and conveyed in a reverse direction. In addition, by feeding an unprinted sheet and performing recording on one surface thereof before the sheet one surface of which has been subjected to recording passes through the inversion conveyance path and is conveyed to the image forming portion again, duplex recording can be more efficiently performed than in the configuration of Japanese Patent Laid-Open No. 2008-70489.

In addition, in consideration of miniaturization and saving electricity, a configuration of driving, by the same drive source that rotates only in one direction, a guide member that switches the conveyance path of the sheet and a conveyance roller that discharges the sheet to the outside of the apparatus or switches back and conveys the sheet to the duplex conveyance path is proposed in Japanese Patent Laid-Open No. 2007-76881 below.

In a conventional configuration as disclosed in Japanese Patent Laid-Open No. 2007-76881, switching of the rotation direction of the reverse conveyance roller and switching of the conveyance path by the guide member are simultaneously performed by a solenoid. Therefore, the switching of the conveyance path by the guide member cannot be started before switching back and conveying the sheet one surface of which has been already subjected to recording in a reverse direction by a reverse roller.

In addition, in a switch back conveyance mechanism of Japanese Patent Laid-Open No. 2007-76881, so-called triple rollers in which two opposing rollers are in contact with a single roller capable of rotating in a normal rotation direction and a reverse rotation direction and thus a roller nip for discharge and a roller nip for inversion are formed is used. The configuration of driving the guide member and the triple conveyance roller by the same drive source has a merit that the switch back conveyance mechanism can be configured to be simple and inexpensive, be small and light, or save electricity.

However, in the case of the configuration of Japanese Patent Laid-Open No. 2007-76881, switching of the conveyance path by the guide member cannot be started before guiding the sheet both surfaces of which have been subjected to recording to a discharge conveyance path and completing discharge. Particularly, in such a configuration as that of Japanese Patent Laid-Open No. 2007-76881, since the guide member and the triple conveyance rollers are driven by the same drive source, there is a possibility that, for example, it is difficult to shorten a distance between a leading sheet and a subsequent sheet in the conveyance path and the productivity of duplex recording decreases.

SUMMARY OF THE INVENTION

According to one aspect of the present invention, a sheet conveyance apparatus includes a sheet discharge section constituting a sheet discharge portion configured to convey and discharge a sheet, a sheet inversion section including a reverse rotary member constituting a sheet inversion portion configured to invert and convey a sheet, a guide member configured to pivot to a first pivot position to guide the sheet to the sheet discharge portion and a second pivot position to guide the sheet to the sheet inversion portion, a rotation driving portion configured to generate a rotational driving force in only one rotation direction, a first transmission mechanism configured to transmit the rotational driving force of the rotation driving portion such that the guide member pivots between the first pivot position and the second pivot position, a second transmission mechanism configured to transmit the rotational driving force of the rotation driving portion to the reverse rotary member such that the reverse rotary member is rotationally driven in a normal rotation direction or a reverse rotation direction, and an interlocking mechanism configured to interlock the first transmission mechanism and the second transmission mechanism such that the second transmission mechanism switches a rotational driving direction of the reverse rotary member between the normal rotation direction and the reverse rotation direction with a delay with respect to the first transmission mechanism starting transmission of the rotational driving force such that the guide member pivots between the first pivot position and the second pivot position.

Further features of the present invention will become apparent from the following description of exemplary embodiments with reference to the attached drawings.

DESCRIPTION OF THE EMBODIMENTS

Exemplary embodiments of the present invention will be described below with reference to attached drawings. To be noted, the configurations described below are merely examples, and, for example, elements of detailed portions can be appropriately modified by one skilled in the art within the gist of the present invention. In addition, numerical values shown in the exemplary embodiments are values for reference and should not limit the present invention.

Sheet conveyance apparatuses according to exemplary embodiments of the present invention will be described below with reference to drawings. The sheet conveyance apparatuses according to the exemplary embodiments of the present invention are provided in image forming apparatuses or image reading apparatuses such as copiers, printers, facsimile machines, and multifunctional printers. These apparatuses are image forming apparatuses or image reading apparatuses including sheet conveyance portions as sheet conveyance apparatuses capable of inverting and conveying sheets to form images on both surfaces of the sheets or read images on both surfaces of the sheets. In the exemplary embodiments below, examples in which a laser beam printer is used as an image forming apparatus will be described.

First Exemplary Embodiment

Figure 1:
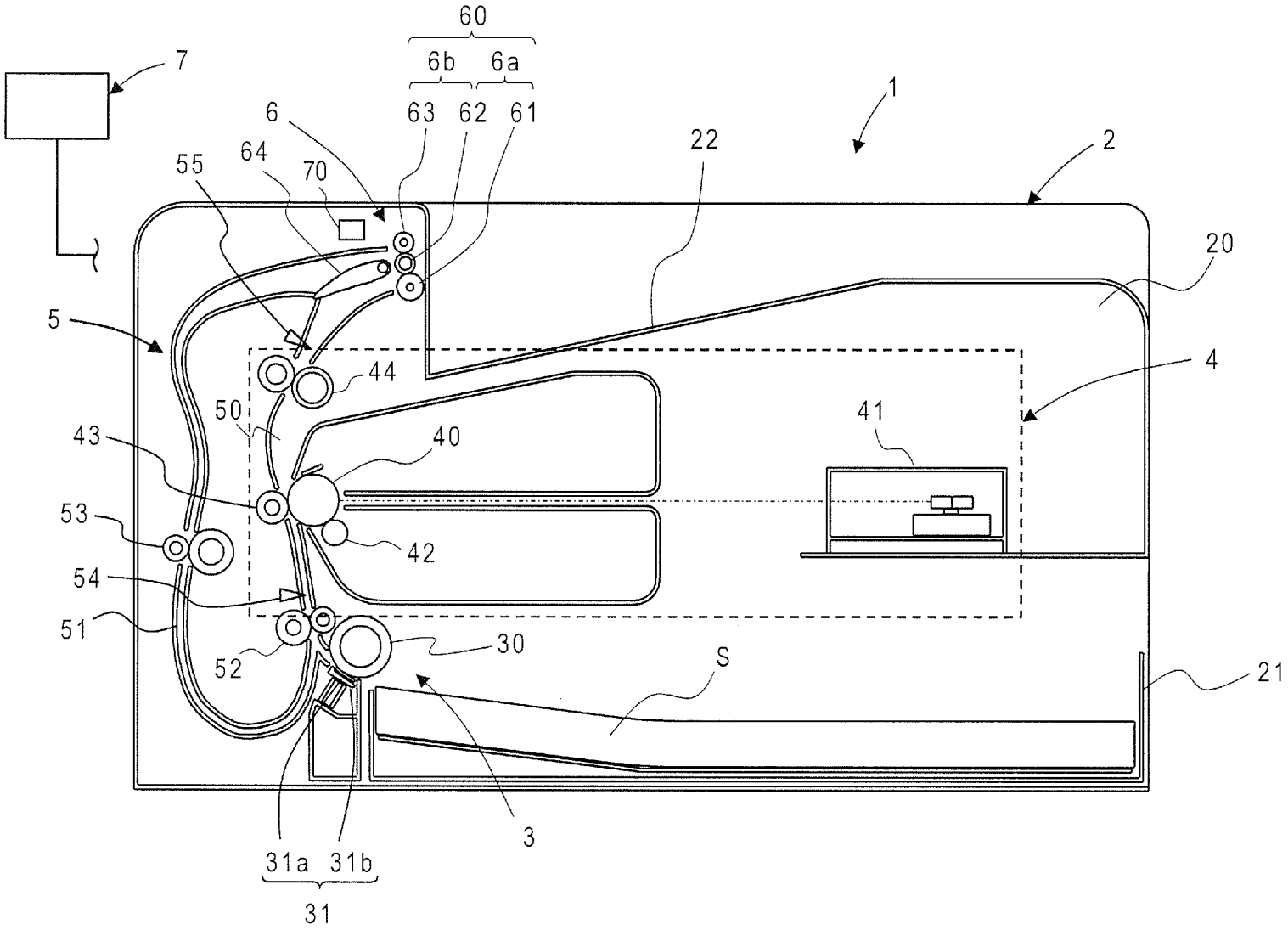
FIG. 1 is a section view of a laser beam printer according to a first exemplary embodiment of the present invention.

FIG. 1 is a side section view of a laser beam printer according to a first exemplary embodiment schematically illustrating an overall configuration thereof. As illustrated in FIG. 1, a laser beam printer 1 according to the first exemplary embodiment includes a printer body 2, a sheet feeding portion 3, an image forming portion 4, a sheet conveyance portion 5, a discharge inversion portion 6, and a sheet conveyance controller 7 serving as a controller.

The printer body 2 of the present exemplary embodiment includes components of the laser beam printer 1. This laser beam printer 1 includes a casing 20 accommodating the sheet feeding portion 3, the image forming portion 4, the sheet conveyance portion 5, the discharge inversion portion 6, and the sheet conveyance controller 7. In addition, the laser beam printer 1 includes a supply cassette 21 detachably attached to a lower portion of the casing 20 and a discharge tray 22 formed in an upper portion of the casing 20.

The supply cassette 21 accommodates sheets S in a stacked state. The discharge tray 22 accommodates sheets on which simplex recording or duplex recording has been completed. The sheet feeding portion 3 includes a feeding roller 30 and a separation portion 31. The feeding roller 30 feeds a sheet S accommodated in the supply cassette 21 to the sheet conveyance portion 5, and the separation portion 31 separates sheets together with the feeding roller 30. The separation portion 31 includes a separation pad 31*a* and a separation holder 31*b* holding the separation pad 31*a*. The separation pad 31*a* comes into pressure contact with the feeding roller 30 and separates one sheet from another. The sheet feeding portion 3 feeds the sheets S set in the supply cassette 21 to the sheet conveyance portion 5 one sheet at a time by the feeding roller 30 while separating each sheet by the separation pad 31*a*.

The image forming portion 4 includes a photosensitive drum 40, a laser scanner unit 41, a developing portion 42, a transfer roller 43, and a fixing portion 44, and forms an image on the sheet S on the basis of predetermined image information. The laser scanner unit 41 irradiates the photosensitive drum 40 with information light generated on the basis of the image information. The developing portion 42 develops an electrostatic latent image formed on the photosensitive drum 40 with toner. The toner image formed by development is transferred onto the sheet S by the transfer roller 43, and the toner image transferred onto the sheet S is fixed to the sheet S by the fixing portion 44.

The sheet conveyance portion 5 includes a first conveyance path 50, a second conveyance path 51, a conveyance roller pair 52, a re-conveyance roller pair 53, a first sensor 54, and a second sensor 55.

The discharge inversion portion 6 includes a conveyance roller unit 60 of a triple roller configuration and a guide member 64. A sheet that has passed through the first conveyance path 50 is discharged onto the discharge tray 22 or switched back and conveyed to the second conveyance path 51 by the conveyance roller unit 60 and the guide member 64.

The conveyance roller unit 60 is constituted by a first conveyance roller 61, a second conveyance roller 62, and a third conveyance roller 63. To the second conveyance roller 62 among these conveyance rollers, a rotational driving force of a drive source 70 illustrated in FIG. 1 such as a motor via an input gear 80, a switch back mechanism 65, and a roller gear 81 that are illustrated in, for example, FIGS. 2 and 3 and will be described later. The driving direction of the second conveyance roller 62 at this time will be described later.

The first conveyance roller 61 abuts the lower side of the second conveyance roller 62. The first conveyance roller 61 and the second conveyance roller 62 constitute a first nipping portion 6*a* serving as a sheet discharge portion that conveys and discharges a sheet. For example, in a discharge operation of the sheet S, the first conveyance roller 61 is rotated in a clockwise direction in FIG. 1 in accordance with the second conveyance roller 62. In addition, the third conveyance roller 63 abuts the upper side of the second conveyance roller 62. The second conveyance roller 62 and the third conveyance roller 63 constitute a second nipping portion 6*b* serving as a sheet inversion portion. For example, in an operation of conveying the sheet S into the apparatus by switch-back conveyance, the third conveyance roller 63 is rotated in a clockwise direction in FIG. 1 in accordance with the second conveyance roller 62. The discharge inversion portion 6 includes a switch back mechanism that will be described later, and is capable of performing switch-back conveyance in which the conveyance direction of the sheet can be switched to a reverse direction.

That is, the sheet conveyance apparatus of the present exemplary embodiment includes a sheet discharge section including a sheet discharge portion configured to convey and discharge a sheet, and a sheet inversion section including a reverse rotary member constituting a sheet inversion portion configured to invert and convey a sheet. In the present exemplary embodiment, a first nipping portion 6*a* serves as the sheet discharge portion and a second nipping portion 6*b* serves as the sheet inversion portion.

Further, in the present exemplary embodiment, the sheet discharge section and the sheet inversion section are constituted by, for example, triple rollers composed of the first, second, and third conveyance rollers 61, 62, and 63.

Here, the first, second, and third conveyance rollers 61, 62, and 63 described above are referred to as first, second, and third rotary members. In this case, the second rotary member 62 is disposed to oppose the first rotary member 61, and constitutes the first nipping portion 6*a* serving as the sheet discharge portion configured to convey and discharge a sheet together with the first rotary member 61.

In addition, the third rotary member 63 is disposed to oppose the second rotary member 62, and constitutes the second nipping portion 6*b* serving as the sheet inversion portion configured to invert and convey the sheet together with the second rotary member 62 as a result of the second rotary member 62 being rotationally driven in a normal rotation direction or a reverse rotation direction.

That is, the sheet discharge section in the triple rollers 61, 62, and 63 includes the first rotary member 61 and the second rotary member 62 disposed to oppose the first rotary member 61 and constituting the sheet discharge portion together with the first rotary member 61. The second rotary member 62 is configured to also function as the reverse rotary member constituting the sheet inversion portion.

In addition, the sheet inversion section in the triple rollers 61, 62, and 63 of the present exemplary embodiment includes the third rotary member 63 disposed to oppose the second rotary member 62. This third rotary member 63 constitutes the sheet inversion portion configured to invert and convey a sheet together with the second rotary member 62 as a result of the second rotary member 62 being rotationally driven in a normal rotation direction or a reverse rotation direction.

To be noted, the sheet discharge section and the sheet inversion section described above respectively including the first nipping portion 6*a* serving as the sheet discharge portion and the second nipping portion 6*b* serving as the sheet inversion portion are not limited to be constituted by the triple rollers. For example, the first nipping portion 6*a* serving as the sheet discharge portion and the second nipping portion 6*b* serving as the sheet inversion portion may be respectively constituted by two pairs of opposing rollers.

The first conveyance path 50 is a conveyance path for conveying, for example, a sheet S which has not been subjected to printing or one surface of which has been subjected to recording. The first conveyance path 50 branches into two on the upstream side of the conveyance direction of the sheet S, for example, at a position upstream of the conveyance roller pair 52, and one end portion of the two branches of the first conveyance path 50 is opened as an inlet port facing the supply cassette 21. One surface of the sheet S conveyed into the first conveyance path 50 from the supply cassette 21 is subjected to recording by the first image forming portion 4 while being conveyed in the first conveyance path 50. Meanwhile, the downstream side of the first conveyance path 50 is disposed so as to face the conveyance roller unit 60, for example, the first nipping portion 6*a* constituted by the first conveyance roller 61 and the second conveyance roller 62.

The second conveyance path 51 is a conveyance path for conveying the sheet S one surface of which has been subjected to recording to the first conveyance path 50 again. The upstream side of the second conveyance path 51 is disposed so as to face the second nipping portion 6*b* constituted by the third conveyance roller 63 and the second conveyance roller 62. Meanwhile, the downstream side of the second conveyance path 51 forms a loop shape downwardly and connects to the other end of the two branches of the first conveyance path 50 on the upstream side described above.

The conveyance roller pair 52 is disposed in the first conveyance path 50. The conveyance roller pair 52 conveys the sheet S fed or conveyed from the two conveyance paths of the branches described above along the first conveyance path 50 toward the downstream side thereof. The re-conveyance roller pair 53 is disposed in the second conveyance path 51 and conveys the sheet S conveyed into the second conveyance path 51.

The first sensor 54 is disposed between the sheet feeding portion 3 and the image forming portion 4 in the first conveyance path 50, and detects the position of the leading end or the trailing end of the sheet S passing through the conveyance position thereof. The second sensor 55 is disposed on the downstream side of the first conveyance path 50, and similarly detects the position of the leading end or the trailing end of the sheet S passing through the conveyance position thereof.

The guide member 64 is pivotably disposed on the downstream side of the first conveyance path 50. By selecting the pivoting orientation of the guide member 64, the sheet S can be selectively conveyed into the first nipping portion 6*a* or the second nipping portion 6*b* of the conveyance roller unit 60 from the first conveyance path 50. In addition, by selecting the pivoting orientation of the guide member 64, a sheet switched back by the second nipping portion 6*b* of the conveyance roller unit 60 on the upstream side of the second conveyance path 51 can be conveyed into the second conveyance path 51.

Figure 2:
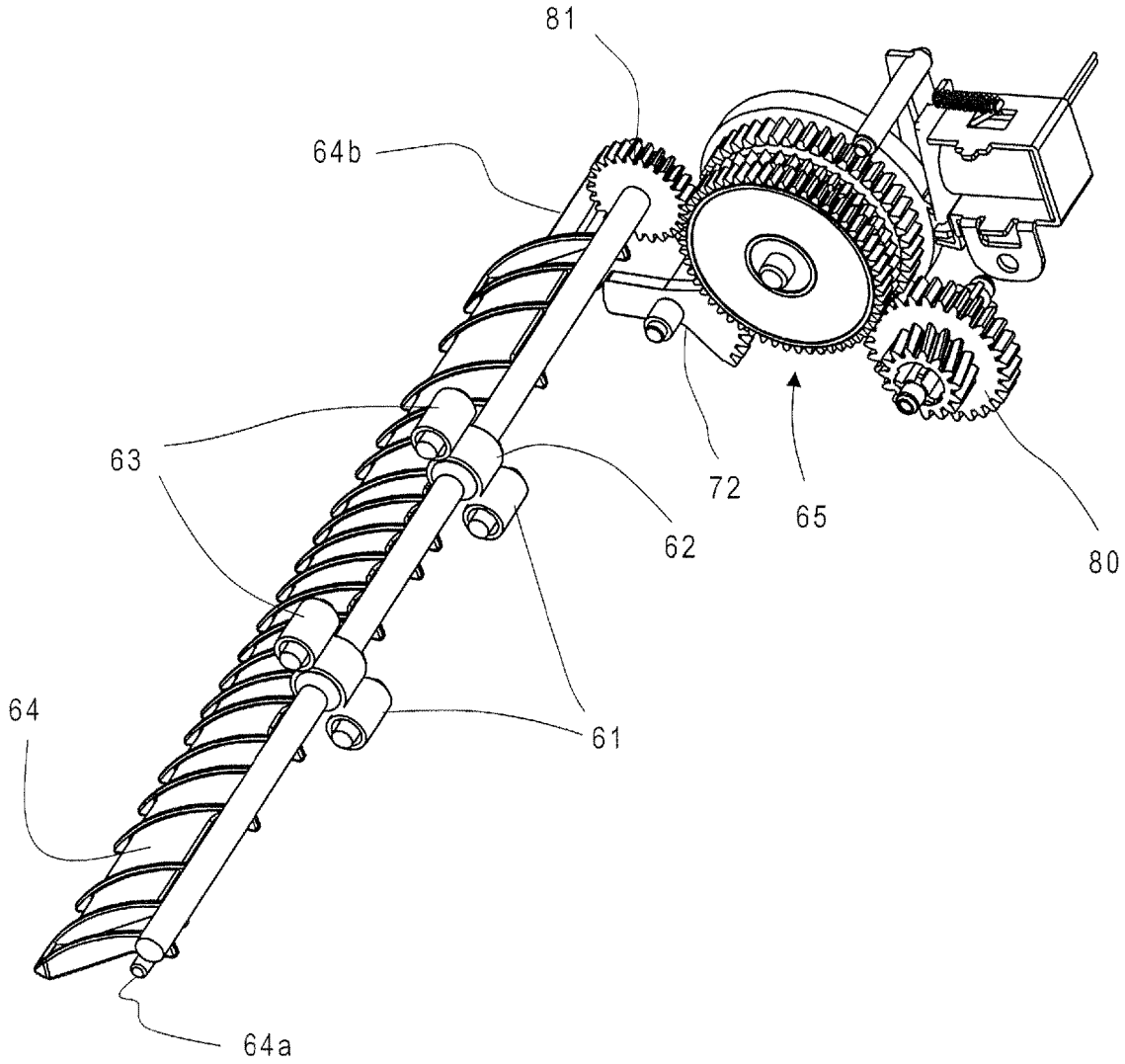
FIG. 2 is a perspective view of a sheet discharge inversion portion according to the first exemplary embodiment of the present invention.
Figure 3:
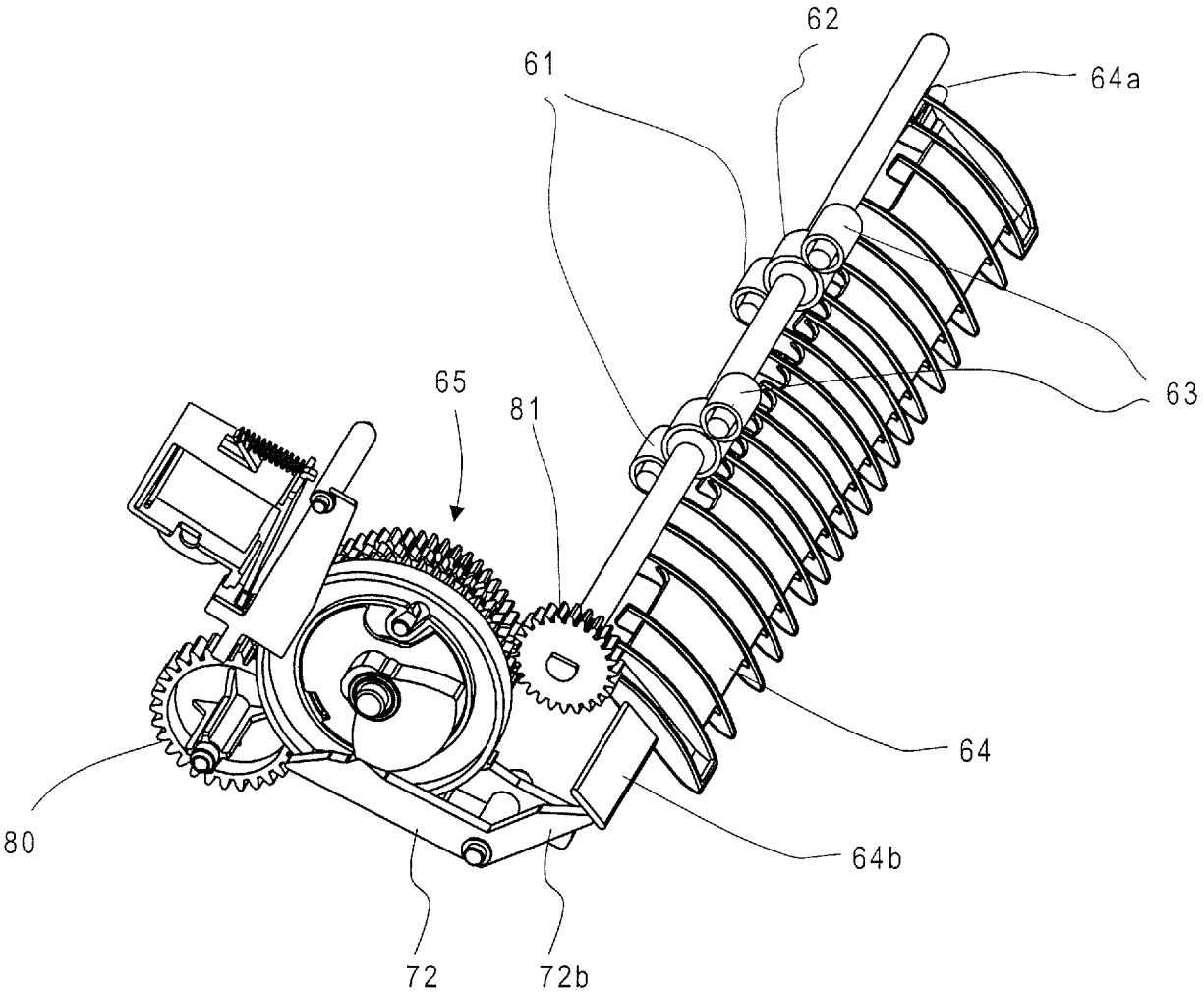
FIG. 3 is a perspective view of the sheet discharge inversion portion according to the first exemplary embodiment of the present invention as viewed in a different direction.
Figure 4:
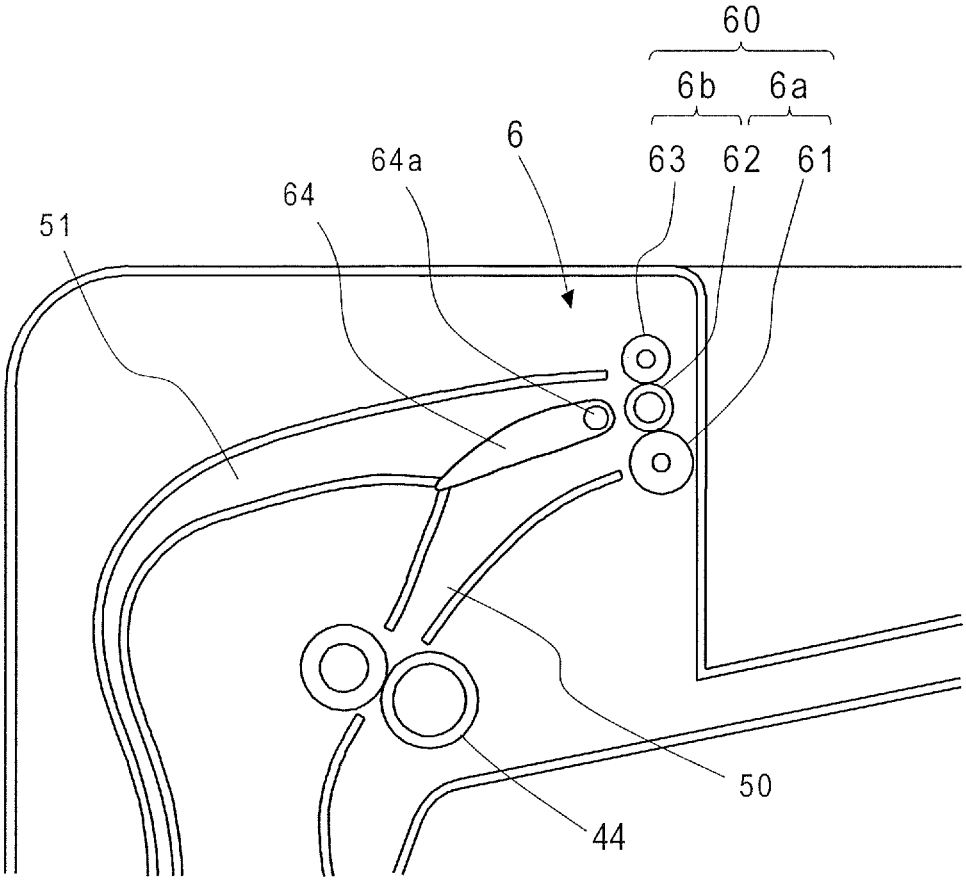
FIG. 4 is a partial section view of the sheet discharge inversion portion according to the first exemplary embodiment of the present invention.

Here, the configuration of the discharge inversion portion 6 will be schematically described with reference to FIGS. 2 to 4. FIGS. 2 and 3 are each a perspective view of the discharge inversion portion 6, and FIG. 4 is a partially enlarged section view of the discharge inversion portion 6 illustrated in FIG. 1. FIGS. 2 and 3 illustrate the configuration of the discharge inversion portion 6 as viewed from substantially opposite directions.

As illustrated in FIGS. 2 to 4, the guide member 64 is pivotably held at both sides in the vicinity of an end portion on the second conveyance roller 62 side with a pivot shaft 64*a* as a pivot center. For example, the guide member 64 has a shape in which many rib-like portions approximately corresponding to a shape illustrated in FIGS. 1 and 4 are formed in a range covering the first conveyance path 50 or the second conveyance path 51.

A projection portion 64*b* projecting to the side as illustrated in FIG. 3 is formed on one end portion of the guide member 64. This projection portion 64*b* abuts a guide support portion 72*b* of a guide link member 72 that will be described later by an urging force of an unillustrated urging portion. The guide member 64 takes a specific pivoting orientation under control by the guide link member 72 via the projection portion 64*b*, and maintains the orientation.

The guide link member 72 incudes the guide support portion 72*b*, for example, on a distal end portion of a swinging lever structure having a bent shape as illustrated in FIG. 3. By changing the abutting state of the guide support portion 72*b* with respect to the projection portion 64*b* by the switch back mechanism 65 that will be described later, the guide member 64 can be pivoted to a desired pivot position.

As described above, the conveyance roller unit 60 includes the second conveyance roller 62 serving as a sheet conveyance roller to which rotational drive is transmitted, and the first conveyance roller 61 and the third conveyance roller 63 that are rotated in accordance with the second conveyance roller 62.

The second conveyance roller 62 is rotationally driven via the roller gear 81. A driving force in a normal rotation direction or a reverse rotation direction is transmitted to the roller gear 81 via a gear portion on the periphery of the switch back mechanism 65. As a result of this, the second conveyance roller 62 can be rotationally driven in the normal rotation direction or the reverse rotation direction.

The first conveyance roller 61 is urged upward in FIGS. 2 and 3 by an unillustrated urging member, and thus the first nipping portion 6*a* illustrated in FIG. 1 is formed by the first conveyance roller 61 and the second conveyance roller 62. In addition, the third conveyance roller 63 is urged downward in FIGS. 2 and 3 by an unillustrated urging member, and thus the second nipping portion 6*b* illustrated in FIG. 1 is formed by the third conveyance roller 63 and the second conveyance roller 62.

Configuration of Components of Switch Back Mechanism

Figure 5:
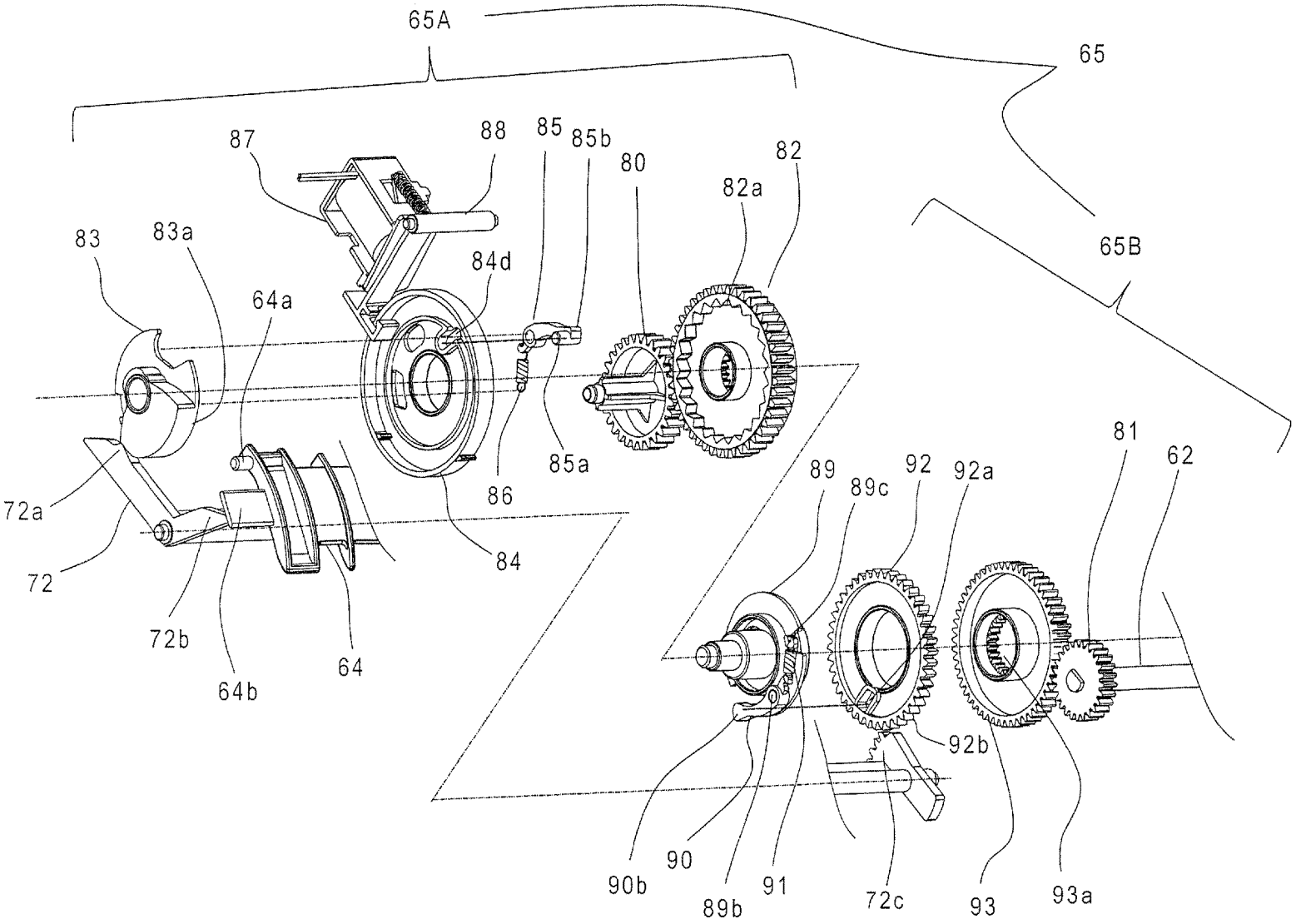
FIG. 5 is an exploded perspective view of the sheet discharge inversion portion according to the first exemplary embodiment of the present invention.
Figure 6:
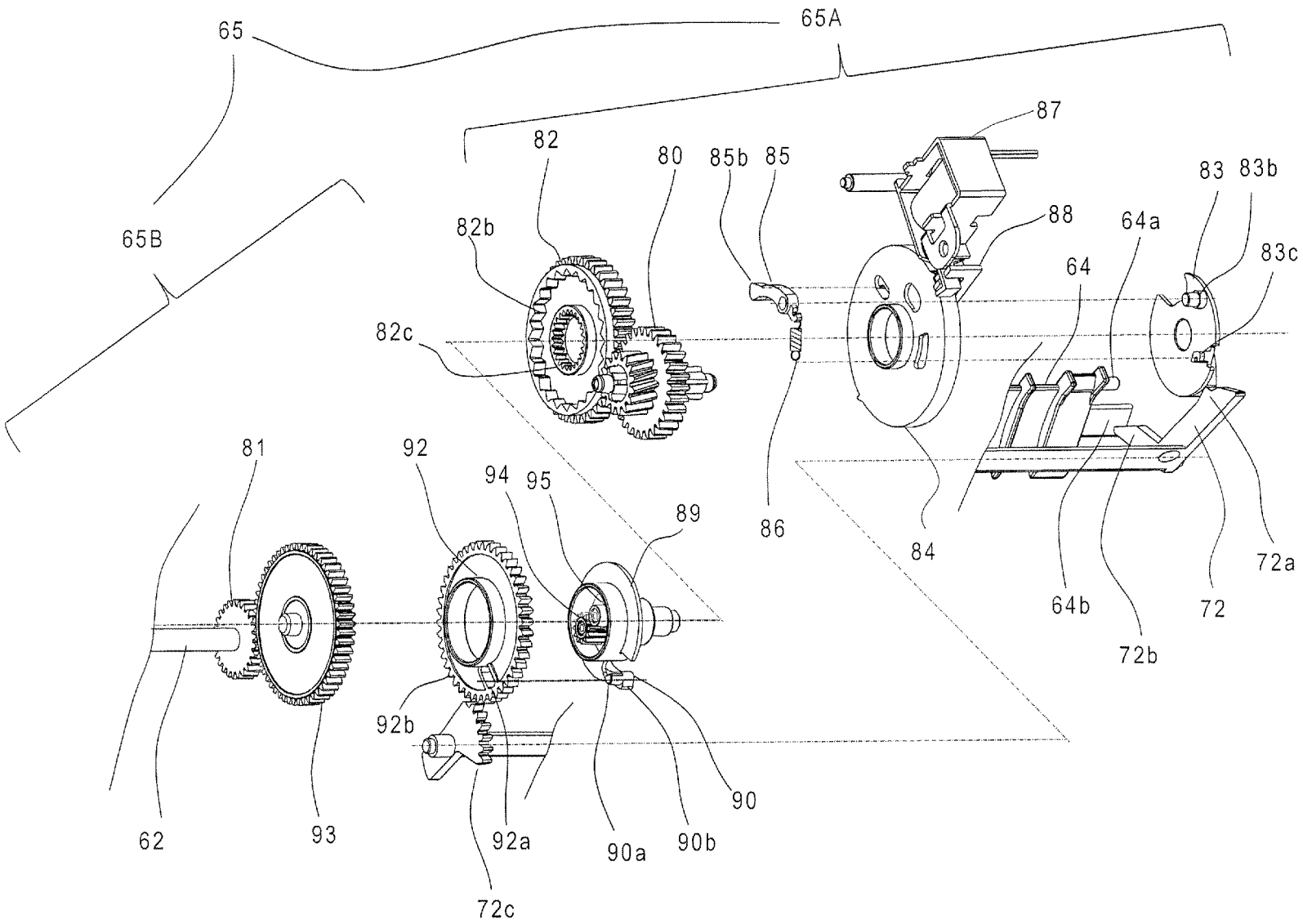
FIG. 6 is an exploded perspective view of the sheet discharge inversion portion according to the first exemplary embodiment of the present invention as viewed in a different direction.

Here, a configuration of components of the switch back mechanism 65 according to the first exemplary embodiment will be described with reference to FIGS. 5 and 6. FIGS. 5 and 6 are each an exploded perspective view of the switch back mechanism 65 according to the present exemplary embodiment. FIGS. 5 and 6 illustrate the configuration of the switch back mechanism 65 as viewed in substantially opposite directions.

Main components of the switch back mechanism 65 are a guide cam 83, a cam disk 84, a switch back input gear 82, a reverse carrier 89, a carrier disk 92, and a switch back output gear 93, and these are coaxially disposed.

The structure of the switch back mechanism 65 will be described by dividing the structure into switch back mechanisms 65A and 65B such that the configuration of components of the switch back mechanism 65 of the present exemplary embodiment can be more easily understood. For example, the switch back mechanism 65A serving as a first transmission mechanism corresponds to a structure on the upstream side of the drive including the switch back input gear 82, and the switch back mechanism 65B serving as a second transmission mechanism corresponds to a structure on the downstream side of the drive not including the switch back input gear 82.

The switch back input gear 82 of the switch back mechanism 65 receives a rotational driving force from the input gear 80 driven by an unillustrated driving system including a motor, a driving gear train, and so forth, and is always rotationally driven in one direction. The switch back input gear 82 serves as an input portion of a rotationally driving force common to the switch back mechanisms 65A and 65B.

In the present exemplary embodiment, a drive source of a motor and the like that drives the input gear 80 and a driving system or the like thereof are not illustrated. For example, the input gear 80 or the drive source or driving system thereof may be considered as a rotation driving portion that generates a rotational driving force in only one rotation direction.

From the viewpoint of functions, the switch back mechanism 65A serving as a first transmission mechanism and the switch back mechanism 65B serving as a second transmission mechanism described above correspond to the following configurations. First, the switch back mechanism 65A constitutes a first transmission mechanism configured to transmit the rotational driving force of the rotation driving portion 80 such that the guide member 64 is pivoted between the first pivot position and the second pivot position. In addition, the switch back mechanism 65B constitutes a second transmission mechanism configured to transmit the rotational driving force of the rotation driving portion 80 such that the second conveyance roller 62 serving as the second rotary member is rotationally driven in a normal rotation direction of reverse rotation direction.

Switch Back Mechanism 65A

In the switch back mechanism 65A, an inner wheel portion of the switch back input gear 82 is formed in, for example, a thin plate shape as illustrated in FIGS. 5 and 6. For example, a first locked portion 82*a* having a corrugated shape illustrated in FIG. 5 and a second locked portion 82*b* illustrated in FIG. 6 that will be described later are respectively formed on inner circumferential portions on both sides of the inner wheel portion of the switch back input gear 82.

The first locked portion 82*a* is provided on the inner circumferential portion on the cam disk 84 side as illustrated in FIG. 5, and is capable of being locked by a cam stopper locking portion 85*b* of a cam stopper 85. The cam stopper 85 is pivotably held through, for example, an elliptical opening of the cam disk 84 as illustrated in FIG. 6 such that the cam stopper 85 is capable of pivoting about a boss portion 83*b* of the guide cam 83. This cam stopper 85 is capable of moving between a locking position and a non-locking position with respect to the first locked portion 82*a* of the switch back input gear 82 illustrated in FIG. 5.

As illustrated in FIG. 6, the cam stopper 85 and a cam hook portion 83*c* of the guide cam 83 are bridged by a cam stopper spring 86. The cam stopper 85 is urged, in such a direction that the cam stopper locking portion 85*b* thereof is locked by the first locked portion 82*a* of the switch back input gear 82, by an urging force of the cam stopper spring 86. A boss portion 85*a* of the cam stopper 85 illustrated in FIG. 5 is guided by a cam elongated hole portion 84*d* of the cam disk 84, and thus a swing range of the cam stopper 85 is regulated.

The swing position of the cam stopper 85 is controlled via the cam disk 84. The cam disk 84 can be switched between a locking position at which the cam stopper 85 and the switch back input gear 82 are locked and a non-locking position at which these two are not locked. Therefore, the pivot position of the cam disk 84 can be switched between positions respectively corresponding to the locking position and the non-locking position described above by a solenoid 87 serving as an actuator and a solenoid link 88 that pivots in synchronization with the solenoid 87.

In the locking position described above, the rotational driving force of the switch back input gear 82 is transmitted to the guide cam 83 through the cam stopper 85, and thus the switch back input gear 82 and the guide cam 83 can rotate in an integrated manner.

The guide cam 83 and the guide link member 72, and the guide link member 72 and the guide member 64 are each pressed by an unillustrated spring and thus held in a contact state. When the guide cam 83 rotates, the guide link member 72 and the guide member 64 can be pivoted along the shape of a cam surface of a cam portion 83*a* of the guide cam 83.

In addition, in the non-locking position, the rotational drive of the switch back input gear 82 is not transmitted, and the guide cam 83 is held at a predetermined position. Therefore, the pivot positions of the guide link member 72 and the guide member 64 are maintained. That is, in the present exemplary embodiment, the cam disk 84, the cam stopper 85, the solenoid link 88, and so forth constitute a disconnection mechanism that is disposed between the rotation driving portion 80 and the guide member 64 in a first drive transmission path and disconnects transmission of a drive from the rotation driving portion 80 to the guide member 64, and the solenoid 87 described above serves as a drive source that drives this disconnection mechanism.

In addition, the cam disk 84 can be referred to as a member that holds the guide cam 83 at a position corresponding to the first pivot position and a position corresponding to the second pivot position, and the cam stopper 85 can be referred to as a connection member that establishes drive connection between the guide cam 83 and the driving member 82 rotationally driven by the rotation driving portion 80. Further, the cam disk 84 described above causes the connection member 85 to take a disconnected state in which the drive connection between the guide cam 83 and the driving member 82 is disconnected, in a holding state in which the pivot position of the guide cam 83 is held at the position corresponding to the first pivot position or the position corresponding to the second pivot position.

In addition, the solenoid link 88 can be said to make the cam disk 84 switchable between the holding state and a cancelled state in which the holding of the guide cam 83 by the cam disk 84 is cancelled and the guide cam 83 and the driving member 82 are brought into drive connection, and the solenoid 87 can be referred to as a drive source that drives the solenoid link 88.

Switch Back Mechanism 65B

Meanwhile, in the switch back mechanism 65B, the second locked portion 82*b* capable of being locked by a carrier stopper locking portion 90*b* of a carrier stopper 90 is provided on the inner circumferential portion of the switch back input gear 82 on the reverse carrier 89 side as illustrated in FIG. 6.

As illustrated in FIG. 5, the carrier stopper 90 is pivotably held so as to be pivotable about a boss portion 89*b* of the reverse carrier 89 rotatably supporting first and second idler gears 94 and 95, and is movable between a locking position and a non-locking position with respect to the second locked portion 82*b* of the switch back input gear 82. This carrier stopper 90 functions as a switching member. In a first position in which the carrier stopper 90 is not engaged with the switch back input gear 82 serving as a driving member, the carrier 89 is fixed, and in a second position in which the carrier stopper 90 is engaged with the driving member, the carrier 89 rotates with the first and second idler gears 94 and 95 in an integrated manner.

As illustrated in FIG. 5, one end portion of a carrier stopper spring 91 is hooked on the carrier stopper 90, and the other end of the carrier stopper spring 91 is hooked on a carrier hook portion 89*c* of the reverse carrier 89. The carrier stopper 90 is urged in such a direction that the carrier stopper locking portion 90*b* is locked by the second locked portion 82*b* of the switch back input gear 82 illustrated in FIG. 6 by the urging force of this carrier stopper spring 91.

As illustrated in FIG. 6, movement of a boss portion 90*a* of the carrier stopper 90 is regulated by being guided by an elongated hole portion 92*a* of the carrier disk 92. Meanwhile, as an action of the switch back mechanism 65A described above, a carrier control portion 72*c* of the guide link member 72 pivots, engages with a locking portion 92*b* on the outer circumference of the carrier disk 92, and stops by unillustrated abutting. As a result of this, rotation of the carrier disk 92 is stopped, and, in synchronization with this, the carrier stopper 90 is configured to be switched between a locking position, in which the carrier stopper 90 is locked with respect to the switch back input gear 82 and a non-locking position in which the carrier stopper 90 is not locked.

The guide link member 72, particularly the carrier control portion 72*c* that will be described later functions as a control member that selects rotation or non-rotation of the idler gears 94 and 95 in synchronization with the pivoting of the guide member 64. For example, as will be described later, the switch back mechanism 65B is caused to perform the switching of rotation direction of the second conveyance roller 62 with a delay with respect to start of transmission of a rotational driving force by the switch back mechanism 65A to pivot the guide member 64 between the first and second pivot positions. That is, these members constitute an interlocking mechanism interlocked such that the switch back mechanism 65B switches the rotational driving direction of the second conveyance roller 62 to a normal rotation direction or a reverse rotation direction with a delay with respect to start of pivoting the guide member 64 by the switch back mechanism 65A.

Here, an input internal gear 82*c* is formed in the switch back input gear 82 as illustrated in FIG. 6. This input internal gear 82*c* engages with the first idler gear 94 rotatably supported by the reverse carrier 89. The first idler gear 94 engages with the second idler gear 95 similarly rotatably supported by the reverse carrier 89.

The second idler gear 95 engages with an output internal gear 93*a* formed in the switch back output gear 93 illustrated in FIG. 5. Tooth surfaces of the input internal gear 82*c*, the first idler gear 94, the second idler gear 95, and the output internal gear 93*a* are arranged in an axially displaced manner as illustrated in FIG. 6 such that the input internal gear 82*c* does not engage with the second idler gear 95, and that the first idler gear 94 does not engage with the output internal gear 93*a*.

In the locking position of the carrier stopper 90, the locking portion 92*b* on the outer circumference of the carrier disk 92 is separated from the carrier control portion 72*c* formed as a sector gear of the guide link member 72. In addition, in this state, the rotational drive of the switch back input gear 82 is transmitted to the reverse carrier 89 through the carrier stopper 90, and the switch back input gear 82 and the reverse carrier 89 rotate in an integrated manner. As a result of this, the switch back output gear 93 also rotates with the reverse carrier 89 in an integrated manner via the first idler gear 94 and the second idler gear 95 in the same direction as the rotation direction of the switch back input gear 82.

Meanwhile, in the non-locking position of the carrier stopper 90, the locking portion 92*b* of the carrier disk 92 engages with the carrier control portion 72*c* formed as a sector gear of the guide link member 72 and stops. In addition, in this state, the rotational driving force of the input internal gear 82*c* of the switch back input gear 82 is transmitted to the first idler gear 94 rotatably held by the reverse carrier 89 that is stopped by the carrier stopper 90. Since the rotational driving force transmitted to the first idler gear 94 is transmitted to the output internal gear 93*a* through the second idler gear 95, the output internal gear 93*a* rotates in a direction opposite to the rotation direction of the switch back input gear 82.

That is, in the present exemplary embodiment, the reverse carrier 89, the first and second idler gears 94 and 95, and so forth described above constitute a normal/reverse unit disposed between the rotation driving portion 80 and the reverse rotary member 62 in a second drive transmission path and configured to be switchable between a normal rotation state in which the rotation direction of the reverse rotary member 62 is a normal rotation direction and a reverse rotation state in which the rotation direction of the reverse rotary member 62 is a reverse rotation direction. In addition, the carrier control portion 72*c*, the carrier disk 92, the carrier stopper 90, and so forth constitute a switching unit connected to the first transmission mechanism at a position downstream of the disconnection mechanism in the drive transmission direction in a first drive transmission path and configured to switch the state of the normal/reverse unit by the drive transmitted from the first transmission mechanism.

To be noted, the carrier stopper 90 described above can be referred to as a switching member configured to be movable between a first position serving as a non-engagement position and a second position serving as an engagement position. In the first position, the carrier stopper 90 brings the normal/reverse unit into the normal rotation state when the carrier stopper 90 is not engaged with the engaged member, which is the switch back input gear 82 in the present exemplary embodiment, and brings the normal/reverse unit into the reverse rotation state when the carrier stopper 90 is engaged with the engaged member. In addition, the carrier disk 92 can be referred to as a regulation member that regulates the position of the switching member. Further, the carrier control portion 72*c* can be referred to as a movable member movable between an engagement position in which the movable member is engaged with the regulation member as a result of receiving the driving force from the first position and a separation position in which the movable member is separated from the regulation member. This carrier control portion 72*c* is configured to pivot in a first pivoting direction and a second pivoting direction as described above. In the first pivoting direction, the carrier control portion 72*c* moves from the engagement position to the separation position in accordance with the pivoting of the guide link member 72, and in the second pivoting direction, the carrier control portion 72*c* moves from the separation position to the engagement position, which is opposite to the first pivoting direction.

Normal Rotation State

Next, the configuration and switching operation of the switch back mechanism 65 in the case of switching back a sheet in the discharge inversion portion 6, that is, in the case where the conveyance roller unit 60 is switched from a normal rotation operation to a reverse rotation operation, will be described. This switching operation is performed when, for example, conveying a sheet whose first surface, that is, whose one surface has been subjected to recording in duplex recording from the first conveyance path 50 to the second conveyance path 51.

To be noted, the "normal rotation" operation of the conveyance roller unit 60 herein is an operation when the second conveyance roller 62 is driven counterclockwise in FIG. 1. The direction of this operation corresponds to, for example, a direction in which the first nipping portion 6*a* conveys out the sheet S toward the discharge tray 22 and a direction in which the second nipping portion 6*b* conveys the sheet S into the second conveyance path 51. Meanwhile, the "reverse rotation" operation of the conveyance roller unit 60 is an operation when the second conveyance roller 62 is driven clockwise in FIG. 1. The direction of this operation corresponds to, for example, a direction in which the second nipping portion 6*b* conveys the sheet S out of the apparatus, and this operation is continued until the trailing end portion of the sheet S reaches the vicinity of a roller nip of the second nipping portion 6*b* in the switch-back reverse rotation.

Figure 7:
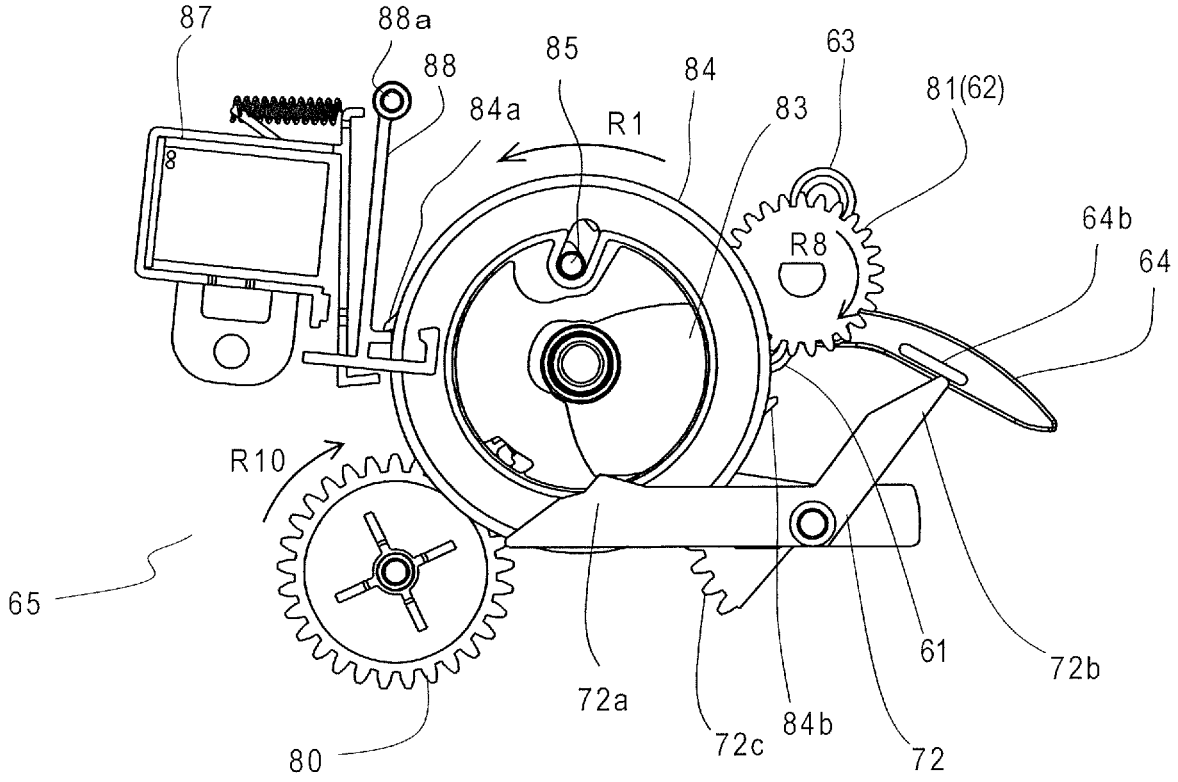
FIG. 7 is a front view of a switch back mechanism according to the first exemplary embodiment of the present invention.
Figure 8:
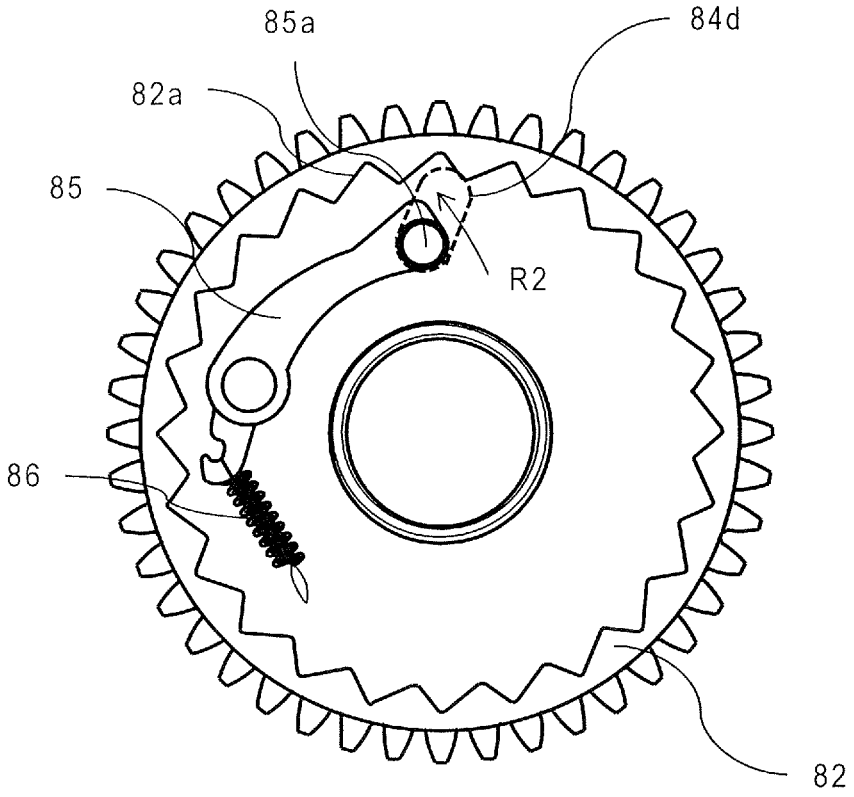
FIG. 8 is an explanatory diagram illustrating an operation of the switch back mechanism according to the first exemplary embodiment of the present invention.

FIG. 7 is a front view of the switch back mechanism 65 in the normal rotation operation state of the conveyance roller unit 60, which corresponds to, for example, illustration from the front of FIG. 3, and illustration of left and right thereof is inverted with respect to FIGS. 1, 2, 4, and so forth. In addition, FIG. 8 illustrates a positional relationship between the switch back input gear 82 and the cam stopper 85. As described above, the rotational driving force is transmitted from the input gear 80 to the switch back mechanism 65 only in an arrow R10 direction. FIG. 7 illustrates a state in which no power is supplied to the solenoid 87, and the solenoid link 88 is abutting the outer circumferential surface of the cam disk 84 by, for example, the urging force of the spring of the solenoid 87, and is engaged with the first locking portion 84*a* on the outer circumferential surface of the cam disk 84. In this state, the solenoid link 88 regulates the rotation of the cam disk 84 in an arrow R1 direction.

In addition, in this normal rotation state, as illustrated in FIG. 8, the boss portion 85*a* is guided toward the inner circumferential side in the cam elongated hole portion 84*d*, and thus the cam stopper 85 is in the non-locking position with respect to the first locked portion 82*a* of the switch back input gear 82. In this non-locking position, the rotational driving force is not transmitted from the switch back input gear 82 to the guide cam 83.

In addition, in the state of FIG. 8, the cam stopper spring 86 generates an urging force in an arrow R2 direction in which the cam stopper 85 is moved to the locking position. In this state, as illustrated in FIG. 7, a cam follower portion 72*a* of the guide link member 72 is urged by an unillustrated spring and abuts the guide cam 83. As a result of this, the guide link member 72 is held in a first position illustrated in FIG. 7, and functions as a rotation stopper of the guide cam 83. As a result of this, an urging force derived from the urging force of the cam stopper spring 86 moving the cam stopper 85 to the locking position is applied from the solenoid link 88 in the arrow R1 direction, which is an action direction. Meanwhile, in an opposite direction, which is a reaction direction, to the arrow R1 direction, the guide cam 83 maintains the position thereof receiving the urging force of the guide link member 72.

The guide link member 72 is positioned in the first position illustrated in FIG. 7, and the pivoting orientation of the guide member 64 is controlled to an illustrated orientation by the guide support portion 72*b* of the guide link member 72 via the projection portion 64*b*. This pivot orientation of the guide member 64 corresponds to a pivot orientation for guiding a sheet conveyed from the first conveyance path 50 to the first nipping portion 6*a* of the conveyance roller unit 60 in FIG. 1.

Figure 14:
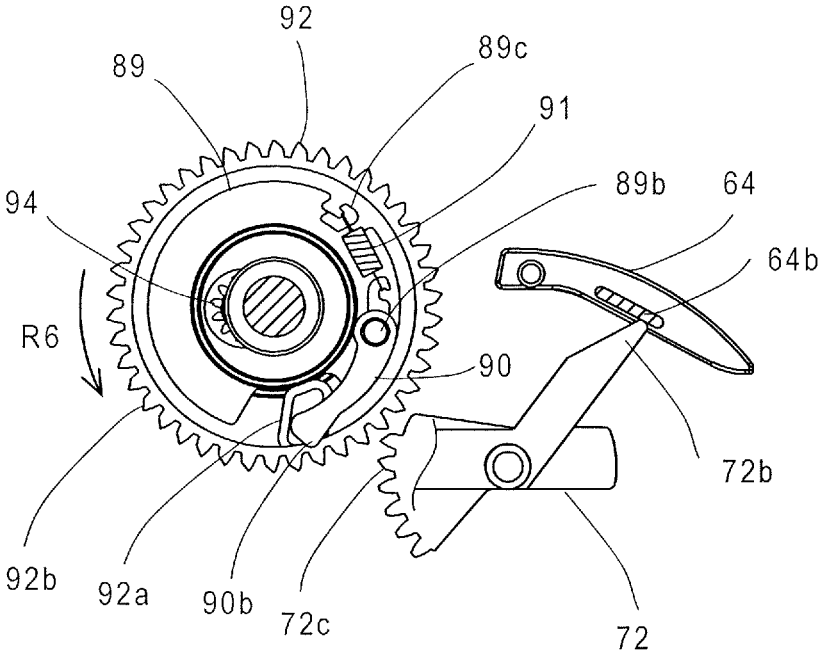
FIG. 14 is an explanatory diagram illustrating an operation of the switch back mechanism according to the first exemplary embodiment of the present invention.

In addition, at this time, as illustrated in FIG. 14 in a partially broken state, the carrier control portion 72*c* of the guide link member 72 and the locking portion 92*b* of the carrier disk 92 are separated and not engaged. In this state, as illustrated in detail in FIG. 16, the carrier stopper 90 is in the locking position with respect to the switch back input gear 82. Therefore, the rotational driving force of the switch back input gear 82 is transmitted to the reverse carrier 89 through the carrier stopper 90, and thus the switch back input gear 82 and the reverse carrier 89 rotate in an integrated manner. Further, the switch back output gear 93 also rotates in the direction of the arrow R1 illustrated in FIG. 7 that is the same as a rotation direction R4 of the switch back input gear 82 in an integrated manner via the first idler gear 94 and the second idler gear 95.

As a result of this, the rotational driving force of the switch back output gear 93 is transmitted to the roller gear 81 in an arrow R8 direction illustrated in FIG. 7, and a rotational driving force in a normal rotation direction is transmitted to the second conveyance roller 62 coaxially attached to the roller gear 81. That is, in FIG. 1, the first nipping portion 6*a* and the second nipping portion 6*b* of the conveyance roller unit 60 are respectively driven in such rotation directions that the sheet S is conveyed in a direction from the inside to the outside of the apparatus and a direction from the outside to the inside of the apparatus.

Switch Back Mechanism 65A

Figure 9:
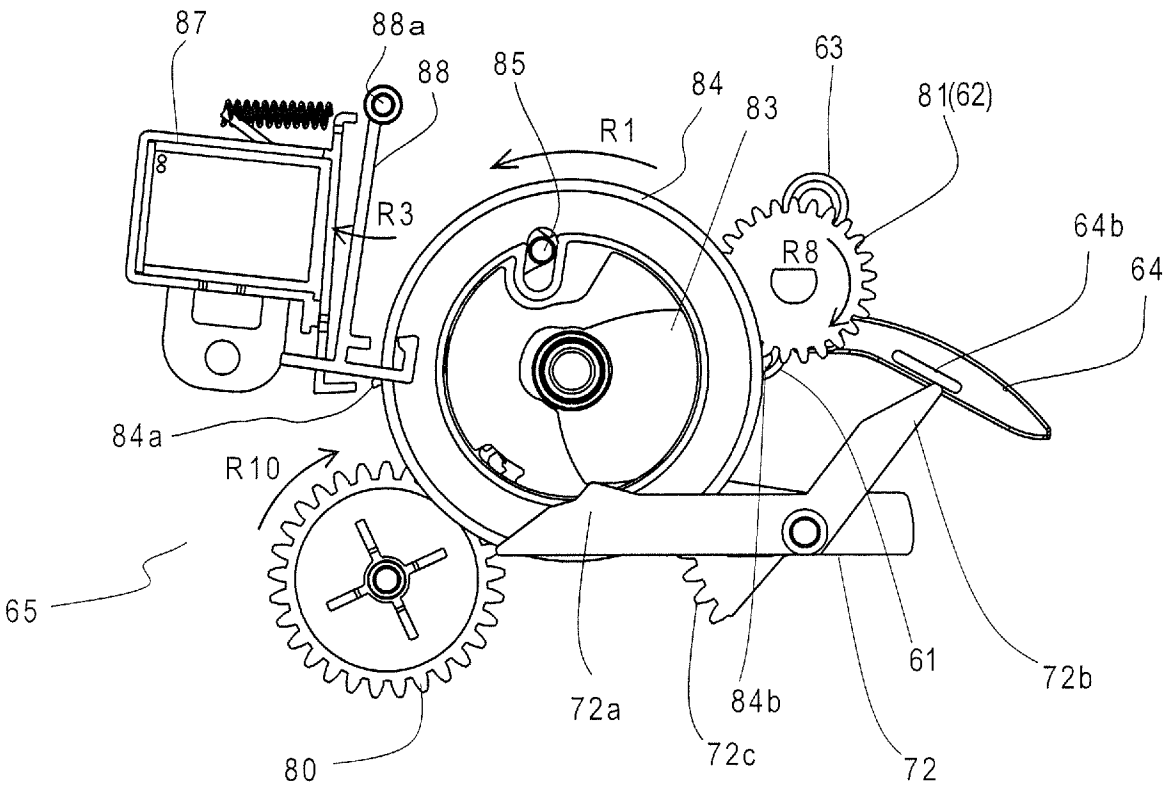
FIG. 9 is a front view of the switch back mechanism according to the first exemplary embodiment of the present invention.

Meanwhile, FIG. 9 illustrates, in a similar way to FIG. 7 and as a front view, a configuration of the switch back mechanism 65 after power is supplied to the solenoid 87 in the state of FIG. 7. In addition, FIG. 10 is a diagram illustrating an operation of the guide cam 83, the cam disk 84, and the cam stopper 85 of FIG. 9, and FIG. 11 is a diagram illustrating an operation of the switch back input gear 82 and the cam stopper 85 of FIG. 9.

As illustrated in FIG. 9, when power is supplied to the solenoid 87 in the state of FIG. 7, the solenoid link 88 rotates about a link shaft 88*a* in an arrow R3 direction to be separated from the first locking portion 84*a* on the outer circumferential surface of the cam disk 84, and thus the cam disk 84 becomes rotatable. In addition, as illustrated in FIGS. 7 and 11, the boss portion 85*a* of the cam stopper 85 presses the cam elongated hole portion 84*d* of the cam disk 84 by the urging force of the cam stopper spring 86. As a result of this, the cam disk 84 rotates in the arrow R1 direction as illustrated in FIGS. 7 to 9, and therefore the cam stopper 85 pivots in the arrow R2 direction as illustrated in FIG. 11 and moves to the locking position to engage with the first locked portion 82*a* of the switch back input gear 82.

Figure 10:
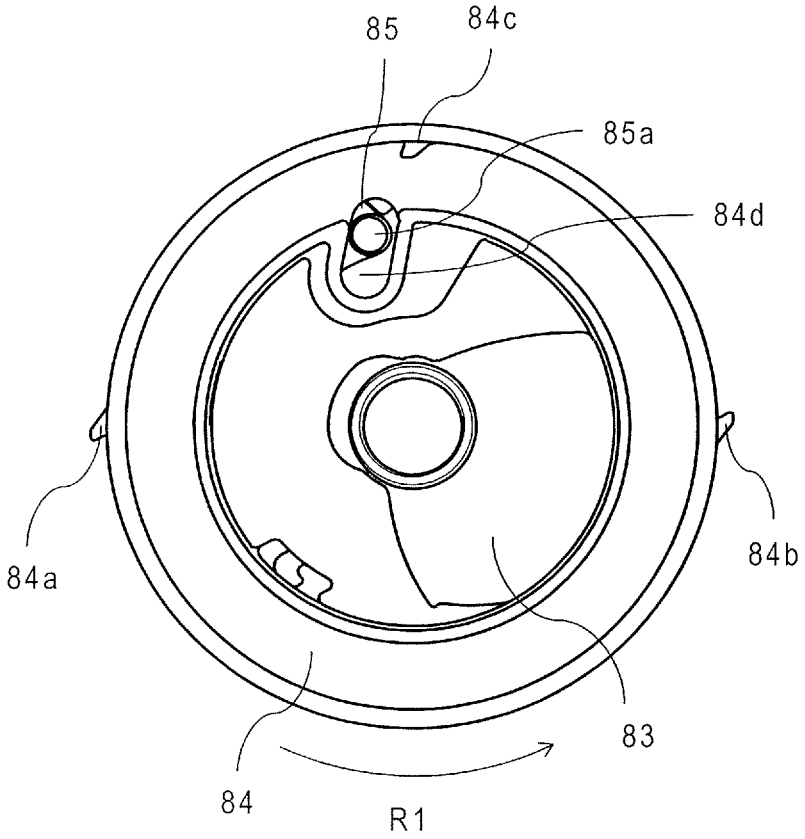
FIG. 10 is an explanatory diagram illustrating an operation of the switch back mechanism according to the first exemplary embodiment of the present invention.
Figure 11:
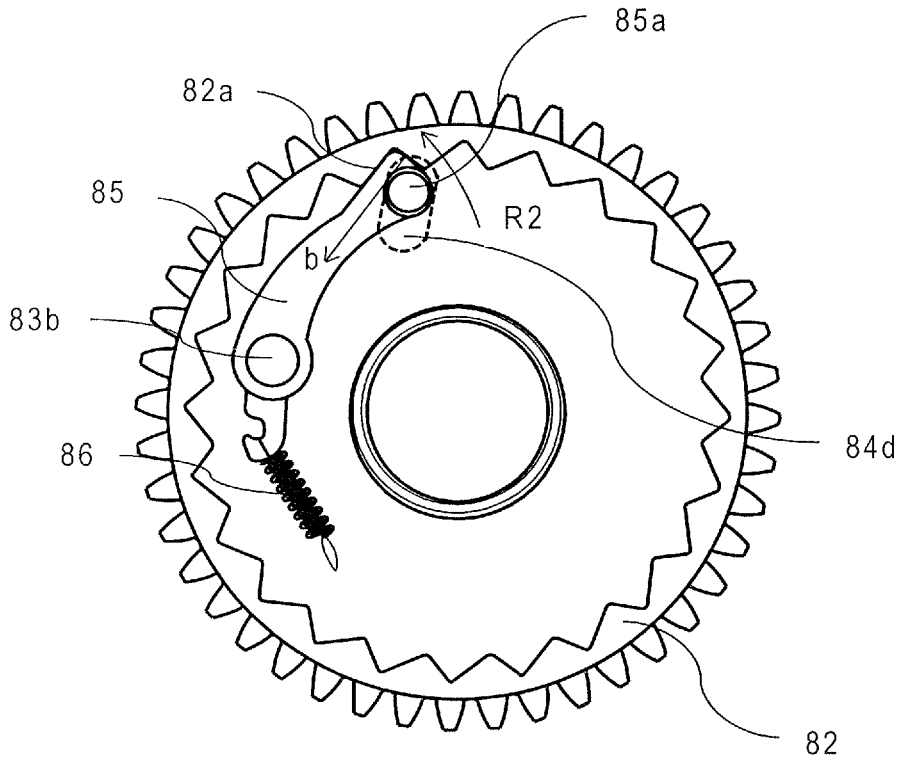
FIG. 11 is an explanatory diagram illustrating an operation of the switch back mechanism according to the first exemplary embodiment of the present invention.

In addition, as illustrated in FIG. 10, the switch back input gear 82 and the guide cam 83 rotate in the arrow R1 direction in an integrated manner due to the cam stopper 85. Further, the cam disk 84 also rotates with the switch back input gear 82 in an integrated manner due to the boss portion 85*a* of the cam stopper 85 inserted in the cam elongated hole portion 84*d*. In the case where the guide cam 83 continues to rotate further, the state changes from that of FIG. 10 to that of FIG. 12.

Figure 12:
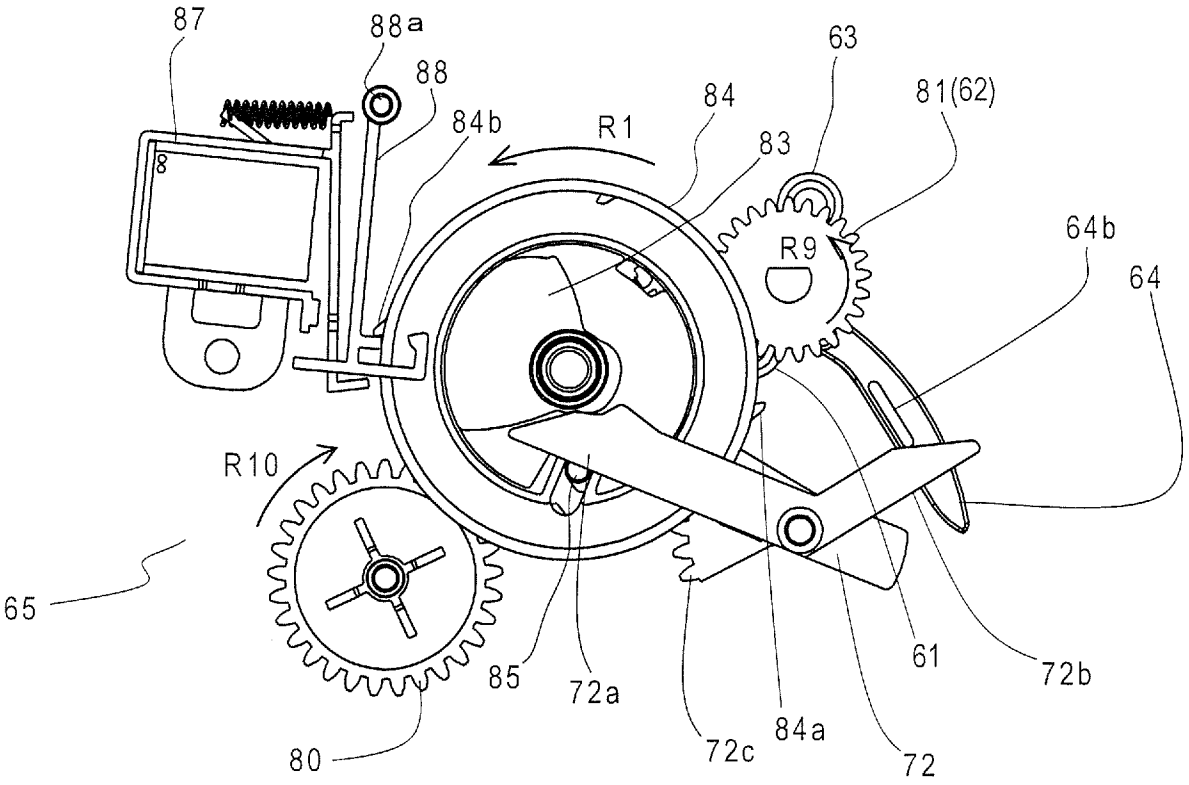
FIG. 12 is a front view of the switch back mechanism according to the first exemplary embodiment of the present invention.

As a result of this, the guide link member 72 rotates via the cam follower portion 72*a* as illustrated in FIG. 12, and moves from the first position illustrated in FIGS. 7 to 9 to the second position illustrated in FIG. 12. In accordance with this, the guide member 64 pivots to the orientation of FIG. 12. Since the guide member 64 is urged toward the guide link member 72 that is not illustrated, in the state of FIG. 12, the projection portion 64*b* of the guide member 64 abuts the guide support portion 72*b* of the guide link member 72, and thus the guide member 64 is held at an illustrated pivot position.

That is, as a result of the guide support portion 72*b* of the guide link member 72 pivoting by a predetermined angle, the projection portion 64*b* of the guide member 64 that is held also moves, and thus the guide member 64 also pivots as illustrated in FIG. 12. As a result of this, a pivot position in which the guide member 64 is held is a pivot position in which the sheet conveyed from the first conveyance path 50 is guided to the second nipping portion 6*b* of the conveyance roller unit 60 illustrated in FIG. 1. As a result of this, movement of the guide member 64 to the pivot position in which the sheet S is guided to the second nipping portion 6*b* of the conveyance roller unit 60 illustrated in FIG. 1 can be started in a state in which the second conveyance roller 62 of the conveyance roller unit 60 has not started reverse rotation and is still rotating in the normal rotation direction.

In addition, in the state of FIG. 12, generation of a magnetic field by the solenoid 87 is already cancelled. Therefore, in FIG. 12, the switch back mechanism 65 corresponds to a state in which the cam disk 84 has been rotated until the solenoid link 88 engages with the second locking portion 84*b* on the outer circumferential surface of the cam disk 84.

The cam disk 84 has approximately half-rotated, that is, rotated by approximately 180° until the state changes from that of FIG. 7 to that of FIG. 12. In the state of FIG. 12, the solenoid link 88 is abutting the outer circumferential surface of the cam disk 84 and is engaged with the second locking portion 84*b* on the outer circumferential surface of the cam disk 84. As a result of this, the solenoid link 88 locks the second locking portion 84*b*, and thus stops the rotation of the cam disk 84 in the arrow R1 direction. At this time, as illustrated in FIG. 11, the cam stopper 85 is in the locking position in which the cam stopper 85 is locked with respect to the switch back input gear 82. As a result of this, the guide cam 83 and the cam stopper 85 continues rotating in the arrow R1 direction by the rotational driving force transmitted from the switch back input gear 82.

Figure 13:
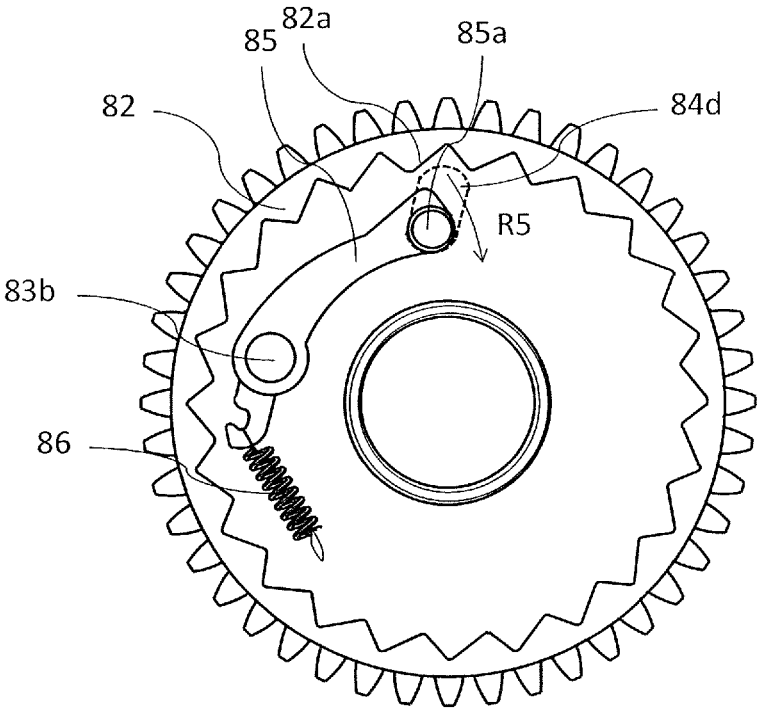
FIG. 13 is an explanatory diagram illustrating an operation of the switch back mechanism according to the first exemplary embodiment of the present invention.

Then, as illustrated in FIG. 13, the boss portion 85*a* of the cam stopper 85 is guided along the cam elongated hole portion 84*d* of the cam disk 84 against the urging force of the cam stopper spring 86 that moves the cam stopper 85 to the locking position. As a result of this, as illustrated in FIG. 13, the cam stopper 85 rotates in an arrow R5 direction about the boss portion 83*b*, and moves to the non-locking position with respect to the first locked portion 82*a* of the switch back input gear 82. As a result of this, transmission of rotational driving force from the switch back input gear 82 to the guide cam 83 is stopped.

In this state of FIG. 13, the cam stopper spring 86 maintains the urging force in the direction of moving the cam stopper 85 to the locking position. Further, as a result of the cam follower portion 72*a* of the guide link member 72 being urged by an unillustrated spring and caused to abut the guide cam 83 as illustrated in FIG. 12, the guide link member 72 is held at the second position and functions as a rotation stopper of the guide cam 83. As a result of this, an urging force derived from the urging force of the cam stopper spring 86 moving the cam stopper 85 to the locking position is received from the solenoid link 88 in the arrow R1 direction, which is the action direction. In the opposite direction, which is the reaction direction, to the arrow R1 direction, the guide cam 83 receives an urging fore from the guide link member 72 and maintains the pivot position thereof.

Link Between Switch Back Mechanisms 65A and 65B

Figure 15:
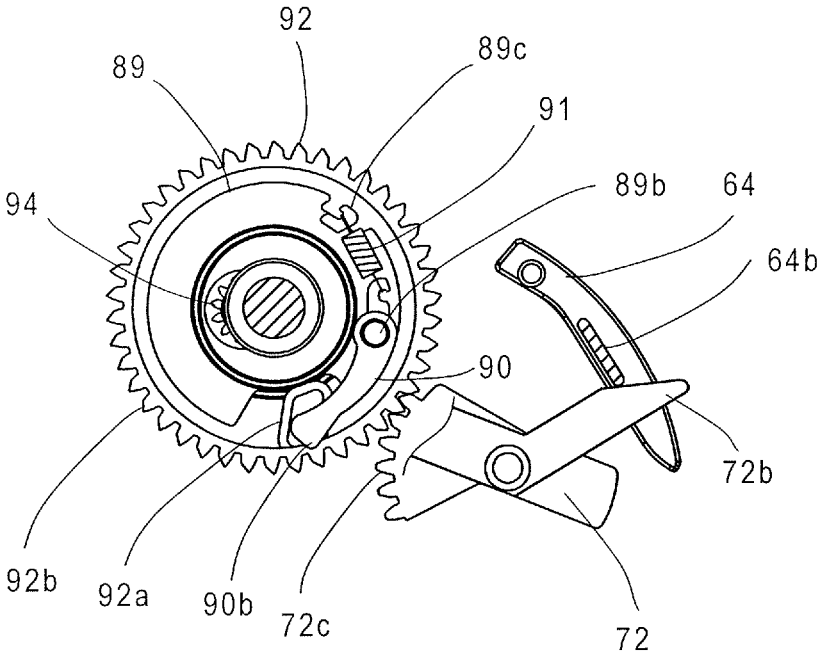
FIG. 15 is an explanatory diagram illustrating an operation of the switch back mechanism according to the first exemplary embodiment of the present invention.

FIGS. 14 and 15 illustrate part of an interlocking mechanism linking the switch back mechanisms 65A and 65B, particularly the carrier control portion 72*c* of the guide link member 72 and the locking portion 92*b* of the carrier disk 92. In FIG. 14, the locking portion 92*b* of the carrier disk 92 and the carrier control portion 72*c* of the guide link member 72 are in an unlocked state. When the carrier control portion 72*c* of the guide link member 72 pivots, the guide member 64 starts pivoting, and then, near the end of the pivoting of the guide member 64, the state changes from the state of FIG. 14 to the locked state illustrated in FIG. 15.

To be noted, the locking portion 92*b* of the carrier disk 92 and the carrier control portion 72*c* of the guide link member 72 are formed to engage with each other at respective gear tooth surfaces in a similar manner to normal gears as illustrated in FIGS. 14 and 15. To be noted, as a result of the carrier control portion 72*c* of the guide link member 72 pivoting to be closer to and away from the locking portion 92*b* of the carrier disk 92, a locked state in which the gear tooth surfaces are engaged with each other and an unlocked state in which the gear tooth surfaces are separated and not engaged are repeated. Therefore, the tooth surfaces of the locking portion 92*b* and the carrier control portion 72*c* preferably have a shape in which the tips of part of the teeth is missing like an engagement portion of so-called partially toothless gears, such that the two are more likely to engage with each other.

Switch Back Mechanism 65B

Figure 16:
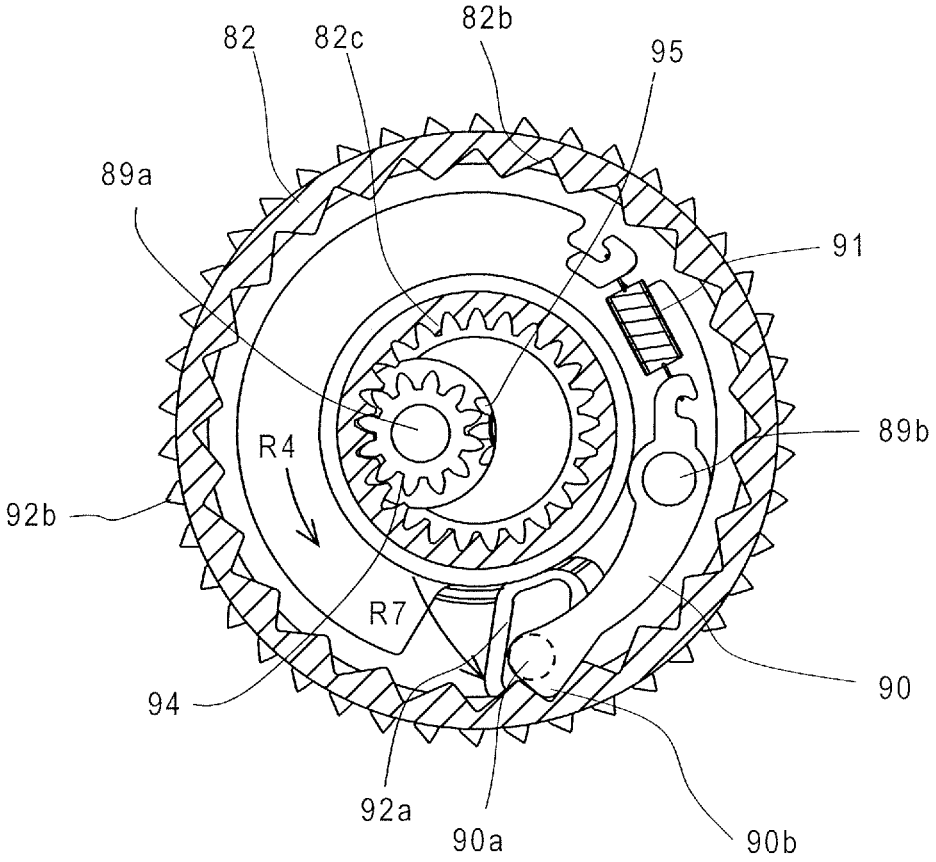
FIG. 16 is an explanatory diagram illustrating an operation of the switch back mechanism according to the first exemplary embodiment of the present invention.
Figure 17:
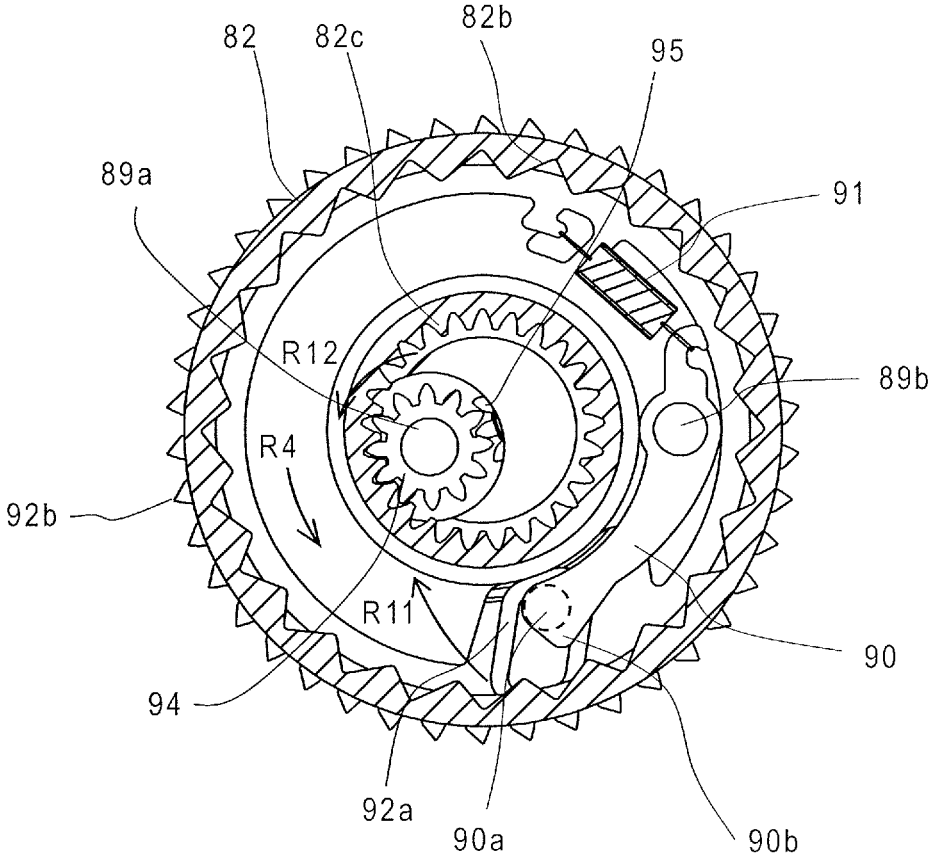
FIG. 17 is an explanatory diagram illustrating an operation of the switch back mechanism according to the first exemplary embodiment of the present invention.

FIGS. 16 and 17 are each a section view of a part related to the switch back mechanism 65B. As illustrated in FIG. 15, when the carrier control portion 72*c* of the guide link member 72 is in a locked state with respect to the locking portion 92*b* of the carrier disk 92 as illustrated in FIG. 15, the rotation of the carrier disk 92 rotating in an arrow R6 direction illustrated in FIG. 14 stops.

However, as illustrated in FIG. 16, since the carrier stopper 90 is at the locking position with respect to the switch back input gear 82, the rotational drive from the switch back input gear 82 is transmitted and the reverse carrier 89 and the carrier stopper 90 continues rotating in the arrow R4 direction. As a result of this, the boss portion 90*a* of the carrier stopper 90 is guided along the elongated hole portion 92*a* of the carrier disk 92 against an urging force of the carrier stopper spring 91 in an arrow direction R7 illustrated in FIG. 16 of moving the carrier stopper 90 to the locking position.

Then, as illustrated in FIG. 17, the carrier stopper 90 rotates in an arrow Ru direction about the boss portion 89*b*, and moves to the non-locking position with respect to the switch back input gear 82. As a result of this, the driving force is not transmitted from the switch back input gear 82 to the reverse carrier 89, and the rotation of the reverse carrier 89 stops.

Then, by the rotational driving force transmitted from the input internal gear 82*c* of the switch back input gear 82, the first idler gear 94 rotatably held by the gear shaft portion 89*a* of the reverse carrier 89 that is not rotating rotates in an arrow R12 direction illustrated in FIG. 17. Similarly, the second idler gear 95 that is rotatably held by the gear shaft portion 89*a* of the reverse carrier 89 and engages with the first idler gear 94 rotates in an opposite direction to the first idler gear 94. As a result of this, the rotational driving force is transmitted from the second idler gear 95 to the output internal gear 93*a* of the switch back output gear 93. That is, as a result of the two idler gears 94 and 95 transmitting the rotational driving force, the rotational driving force is transmitted to the switch back output gear 93 such that the rotation direction of the switch back output gear 93 is reversed with respect to the rotation direction of the switch back input gear 82.

As a result of this, as illustrated in FIG. 12, the rotational driving force of the switch back output gear 93 is transmitted to the conveyance roller unit 60 through the roller gear 81, and the second conveyance roller 62 is reversed to an R9 direction, which is opposite to the R8 direction of FIG. 7. That is, as illustrated in FIG. 12, the conveyance roller unit 60 is switched from the "normal rotation" state to the "reverse rotation" state. This "reverse rotation" state is an operation in a direction of the second nipping portion 6*b* of the conveyance roller unit 60 conveying out the sheet S to the outside of the apparatus. This "reverse rotation" state of the conveyance roller unit 60 is continued, for example, until the trailing end portion of the sheet S reaches the vicinity of the roller nip of the second nipping portion 6*b* in the former half of the operation of switching back the sheet S to the second conveyance path 51.

When the switch back input gear 82 and the reverse carrier 89 rotate in opposite directions and the first idler gear 94 and the second idler gear 95 described above rotate, the conveyance roller unit 60 is in a reverse rotation driving state. In addition, as will be described later, when the switch back input gear 82 and the reverse carrier 89 rotate in an integrated manner, the first idler gear 94 and the second idler gear 95 do not rotate. Further, the first idler gear 94 and the second idler gear 95 mutually bind the switch back input gear 82, the reverse carrier 89, and the switch back output gear 93. As a result of this, the conveyance roller unit 60 is in a normal rotation driving state. The first idler gear 94 and the second idler gear 95 operate as described above, and switches the direction of transmission of the rotational driving force to, that is, the rotation direction of, the conveyance roller unit 60 between the "normal rotation" state and the "reverse rotation" direction.

The switch back mechanism 65 of the present exemplary embodiment causes transition from the state in which the second conveyance roller 62 of the conveyance roller unit 60 is rotating in the "normal rotation" direction to the state in which the second conveyance roller 62 is rotating in the "reverse rotation" direction with a delay with respect to start of the movement of the guide member 64 from the first portion illustrated in FIG. 7 to the second position illustrated in FIG. 12. For example, the guide member 64 starts moving from the first position illustrated in FIG. 7 toward the second position illustrated in FIG. 12 for guiding the sheet S to the second nipping portion 6*b* of the conveyance roller unit 60 illustrated in FIG. 1. It is configured that the second conveyance roller 62 can be driven in the reverse rotation direction after the guide member 64 pivots to the vicinity of the second position illustrated in FIG. 12, which is a pivot end position, or at least when the movement to the second position is completed.

That is, the switch back mechanism 65 of the present exemplary embodiment is capable of delaying the switching between the "normal rotation" state and the "reverse rotation" state of the conveyance roller unit 60 with respect to the start of movement of the guide member 64, and thus maintaining a current rotational driving direction as long as possible.

Switching Operation from Reverse Rotation to Normal Rotation

Next, the configuration and operation of respective parts, that is, the switch back mechanisms 65A and 65B of the switch back mechanism 65 when discharging the sheet S by the discharge inversion portion 6, that is, when the conveyance roller unit 60 switches from the "reverse rotation" operation to the "normal rotation operation, will be described. For example, in the case of duplex printing, the sheet S whose second surface, that is, back surface, has been subjected to printing is conveyed toward the conveyance roller unit 60 through the first conveyance path 50. The control of switching the conveyance roller unit 60 from the "reverse rotation" operation to the "normal rotation" operation is performed when, for example, discharging this sheet S onto the discharge tray 22 by the conveyance roller unit 60.

Switch Back Mechanism 65A Portion

Figure 18:
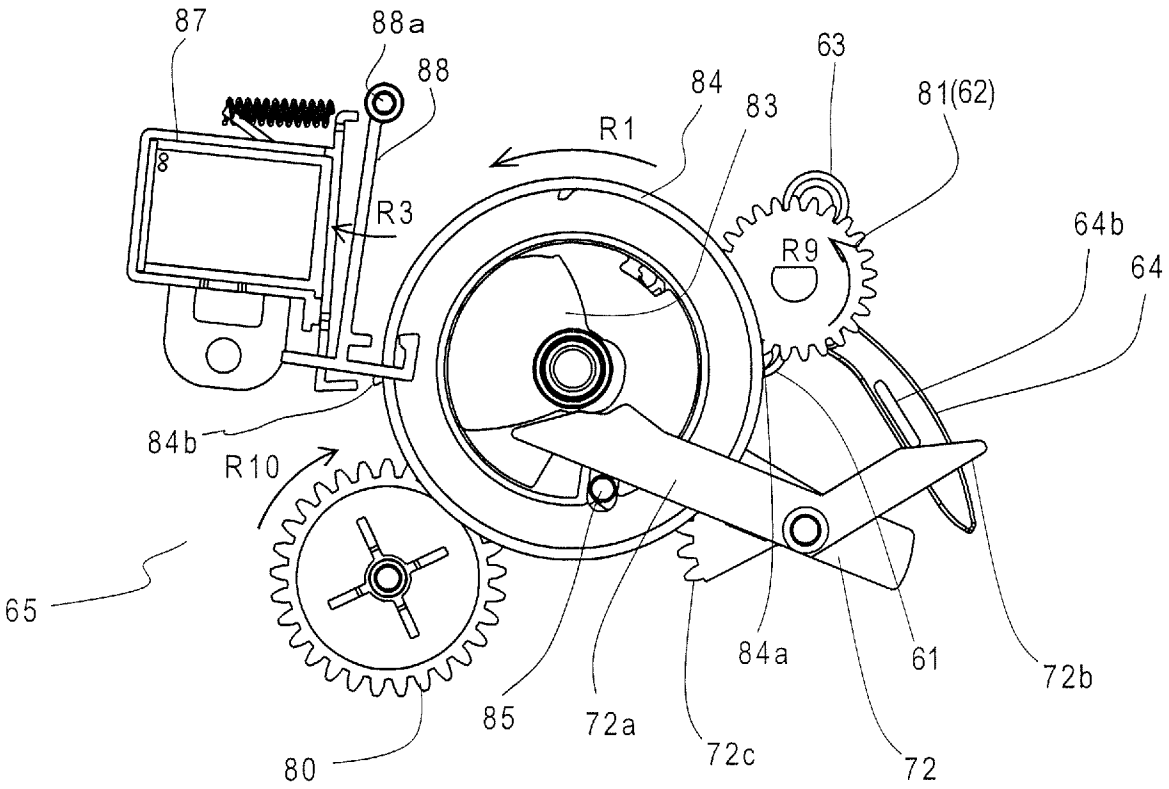
FIG. 18 is a front view of the switch back mechanism according to the first exemplary embodiment of the present invention.

FIG. 18 is a front view of the switch back mechanism 65 after power is supplied to the solenoid 87 in the state of FIG. 12. As illustrated in FIG. 18, when power is supplied to the solenoid 87, the solenoid link 88 pivots in the arrow R3 direction about the link shaft 88*a*. As a result of this, the solenoid link 88 is separated from the second locking portion 84*b* on the outer circumferential surface of the cam disk 84 by which the solenoid link 88 has been previously locked, and thus the cam disk 84 becomes rotatable.

Meanwhile, as illustrated in FIG. 11, the boss portion 85*a* of the cam stopper 85 presses the cam elongated hole portion 84*d* of the cam disk 84 by the urging force of the cam stopper spring 86. As a result of this, the cam disk 84 rotates in the arrow R1 direction as illustrated in FIGS. 7 to 9, and thus the cam stopper 85 rotates in the arrow R2 direction as illustrated in FIG. 11, and moves to the locking position to engage with the first locked portion 82*a* of the switch back input gear 82.

In addition, as illustrated in FIG. 18, the switch back input gear 82 and the guide cam 83 rotate in the arrow R1 direction in an integrated manner due to the cam stopper 85. Further, the cam disk 84 also rotates with the switch back input gear 82 in an integrated manner due to the boss portion 85*a* of the cam stopper 85 inserted in the cam elongated hole portion 84*d*.

When the guide cam 83 rotates further, the guide link member 72 rotates via the cam follower portion 72*a*, and returns to the first position illustrated in FIGS. 7 and 9 from the second position illustrated in FIGS. 12 and 18.

As a result of this, the guide member 64 pivots to the position at which the sheet conveyed from the first conveyance path 50 is guided to the first nipping portion 6*a* of the conveyance roller unit 60 illustrated in FIG. 1. At this time, the second conveyance roller 62 of the conveyance roller unit 60 is not returned to the normal rotation state and is still rotating in the reverse rotation direction. In the present exemplary embodiment, the guide member 64 starts, in this state, the movement to the position at which the sheet is guided to the first nipping portion 6*a* of the conveyance roller unit 60 illustrated in FIG. 1.

Link between Switch Back Mechanism 65A Portion and Switch Back Mechanism 65B Portion The guide link member 72 pivots, and the guide support portion 72*b* and the carrier control portion 72*c* that are integrally provided also pivot. In FIG. 15, the locking portion 92*b* of the carrier disk 92 and the carrier control portion 72*c* of the guide link member 72 are in a locked state. When the carrier control portion 72*c* of the guide link member 72 pivots in this state of FIG. 15, some time after the guide member 64 starts pivoting, the carrier control portion 72*c* of the guide link member 72 is separated from the locking portion 92*b* of the carrier disk 92 near the end of pivoting thereof, and takes an unlocked state as illustrated in FIG. 14.

Switch Back Mechanism 65B Portion

As illustrated in FIG. 14, when the carrier control portion 72*c* of the guide link member 72 is separated from the locking portion 92*b* of the carrier disk 92 and takes the unlocked state, the carrier disk 92 becomes rotatable. As a result of this, as illustrated in FIG. 16, the boss portion 90*a* of the carrier stopper 90 presses the elongated hole portion 92*a* of the carrier disk 92 by the urging force of the carrier stopper spring 91, and the carrier disk 92 rotates in an arrow R4 direction.

Therefore, the carrier stopper 90 is capable of rotating in the arrow R7 direction of FIG. 16, and moves to the locking position to engage with the first locked portion 82*a* of the switch back input gear 82. As a result of this, the rotational drive of the switch back input gear 82 is transmitted to the reverse carrier 89 through the carrier stopper 90, and the switch back input gear 82 and the reverse carrier 89 rotate in an integrated manner. Further, the switch back output gear 93 is bound via the first idler gear 94 and the second idler gear 95 supported on the reverse carrier 89 and also rotates in the arrow R4 direction that is the same as the rotation direction of the switch back input gear 82 in an integrated manner. As a result of this, as illustrated in FIG. 7, the rotational drive of the switch back output gear 93 is transmitted to the roller gear 81, and the second conveyance roller 62 integrally rotating with the roller gear 81 is driven in the arrow R8 direction, which is a normal rotation direction.

According to the configuration described above, in the state in which the second conveyance roller 62 of the conveyance roller unit 60 is still rotating in the reverse rotation direction, the guide member 64 starts pivoting to a position at which the sheet is guided to the first nipping portion 6*a* of the conveyance roller unit 60 illustrated in FIG. 1. The switching of the second conveyance roller 62 to the driving in the normal rotation direction is performed with a delay with respect to start of this pivoting of the guide member 64, and, for example, the second conveyance roller 62 is switched to the driving in the normal rotation direction when the guide member 64 moves to the vicinity of an end point of the pivoting.

Conveyance of Sheet

Next, a conveyance operation of sheets S0, S1, and S2 at the time of duplex recording in the laser beam printer 1 according to the present exemplary embodiment will be described with reference to FIGS. 19 to 27. In the description below, an operation of discharging a sheet S0 which is leading and both surfaces of which have been subjected to recording while switching back and conveying a different sheet S1 one surface of which has been subjected to recording in an opposite direction by the discharge inversion portion 6 will be mainly described as an example. In addition, in the description below, an example of control in which conveyance is performed by letting in three sheets, and the sheet S2 one surface of which has been subjected to recording is switched back by using an interval between the sheets S0 and S1 that are to be discharged will be described. In the description below, switch-back inversion conveyance by the discharge inversion portion 6, the movement of sheets to be discharged, and operations of the guide member 64 and the second conveyance roller 62 will be mainly described.

Figure 19:
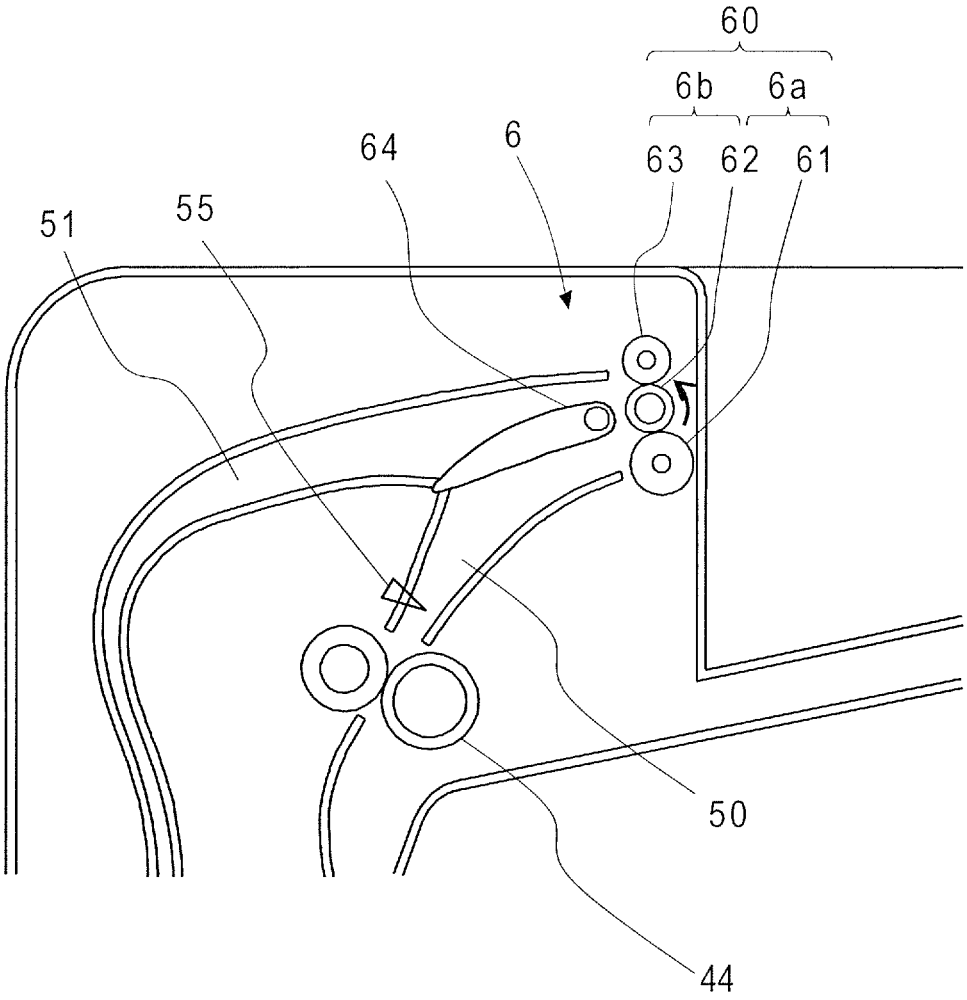
FIG. 19 is an explanatory diagram illustrating a sheet conveyance operation in successive duplex recording according to the first exemplary embodiment.

FIG. 19 illustrates a structure in the vicinity of the discharge inversion portion 6, and the state of this figure corresponds to, for example, the initial position of the discharge inversion portion 6. In FIG. 19, the guide member 64 is held at a first position at which a sheet conveyed from the first conveyance path 50 is guided to the first nipping portion 6*a* of the conveyance roller unit 60. In addition, the second conveyance roller 62 is rotationally driven in a counterclockwise direction indicated by an arrow so as to discharge the sheet conveyed from the first conveyance path 50.

Figure 20:
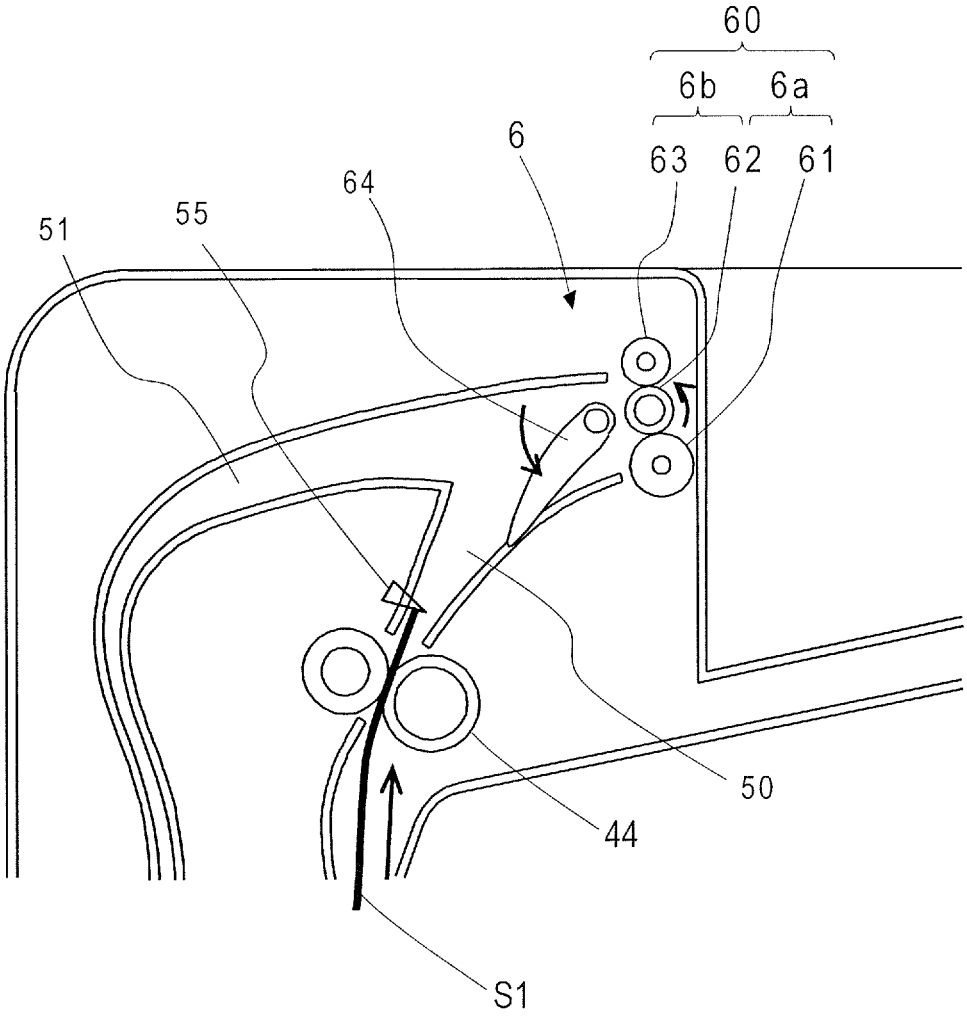
FIG. 20 is an explanatory diagram illustrating the sheet conveyance operation in the successive duplex recording according to the first exemplary embodiment.

FIG. 20 illustrates a state in which the leading end of the sheet S1 on one surface of which recording has been completed has passed through the fixing portion 44 and reached the position of the second sensor 55. As illustrated in this figure, when the second sensor 55 detects the leading end of the sheet 51, the switch back mechanism 65 operates on the basis of this sheet detection information. As a result of this, the guide member 64 is pivoted to the second pivot position at which the sheet S is guided to the second nipping portion 6*b* of the conveyance roller unit 60. This can be expressed by the change from FIG. 7 to FIG. 12.

However, as has been described, the switch back mechanism 65 does not drive the second conveyance roller 62 in the reverse rotation direction at the start of pivoting of the guide member 64. That is, the switch back mechanism 65 drives the second conveyance roller 62 in the reverse rotation direction with a delay with respect to the pivoting of the guide member 64, for example, when the guide member 64 has come to the vicinity of the second pivot position or reached the second pivot position. This switching of the driving direction from the normal rotation direction to the reverse rotation direction occurs as a result of the interlocking mechanism of the switch back mechanisms 65A and 65B, that is, the carrier control portion 72*c* of the guide link member 72 and the locking portion 92*b* of the carrier disk 92 being locked as described above. This can be expressed by the change from FIG. 14 to FIG. 15.

Figure 21:
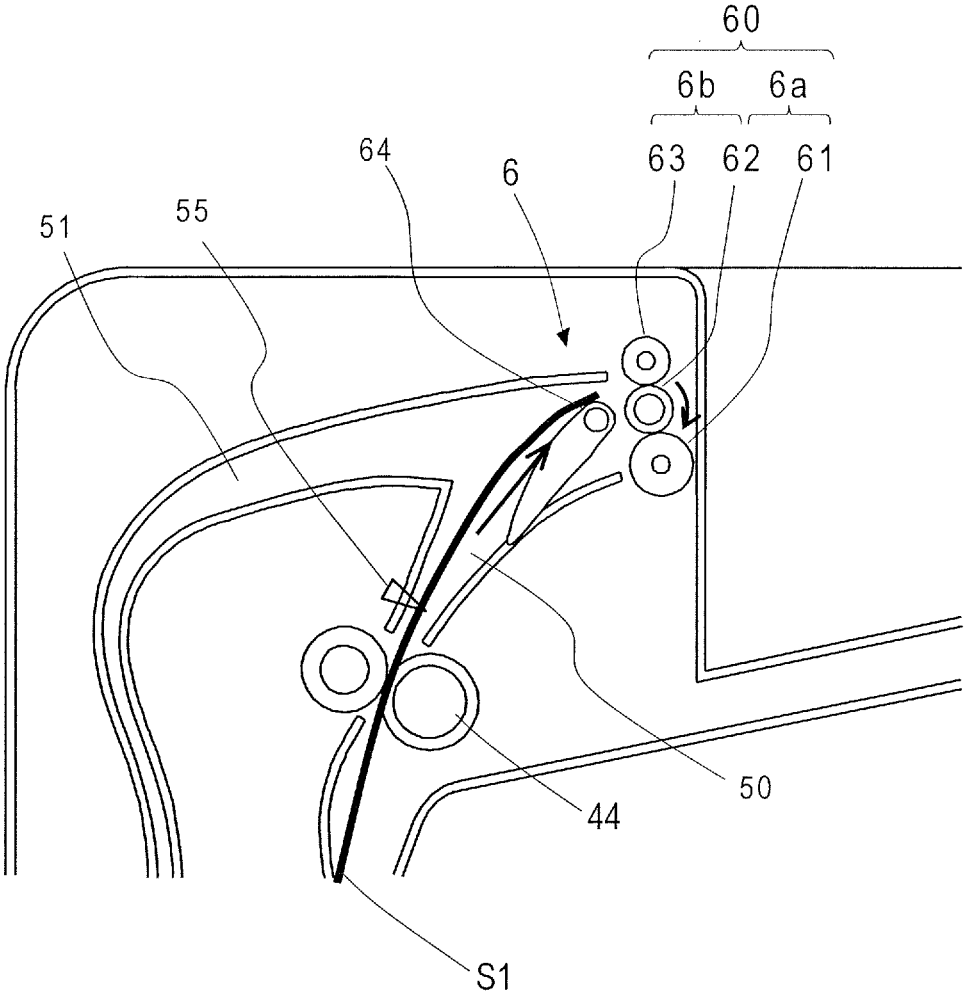
FIG. 21 is an explanatory diagram illustrating the sheet conveyance operation in the successive duplex recording according to the first exemplary embodiment.

In FIG. 20, although the guide member 64 has almost pivoted to the second pivot position, the second conveyance roller 62 is not yet driven in the reverse rotation direction as indicated by an arrow. Then, as illustrated in FIG. 21, when the guide member 64 pivots to the second pivot position, the interlocking mechanism of the switch back mechanisms 65A and 65B, that is, the carrier control portion 72*c* of the guide link member 72 and the locking portion 92*b* of the carrier disk 92 are locked. This can be expressed by the change from FIG. 14 to FIG. 15. As a result of this, the rotational driving force is transmitted through the first idler gear 94 and the second idler gear 95, and the driving of the second conveyance roller 62 in the reverse rotation direction is started as illustrated in FIG. 21. As a result of this, the second conveyance roller 62 rotates in the clockwise direction as indicated by an arrow in FIG. 21. As a result of this, the sheet is conveyed out toward the outside of the apparatus by the driving of the second nipping portion 6*b* of the conveyance roller unit 60 in the reverse rotation direction. This operation is continued until, for example, the trailing end of the sheet S1 is conveyed to a position at which the sheet S1 can be introduced into the second conveyance path 51.

Figure 22:
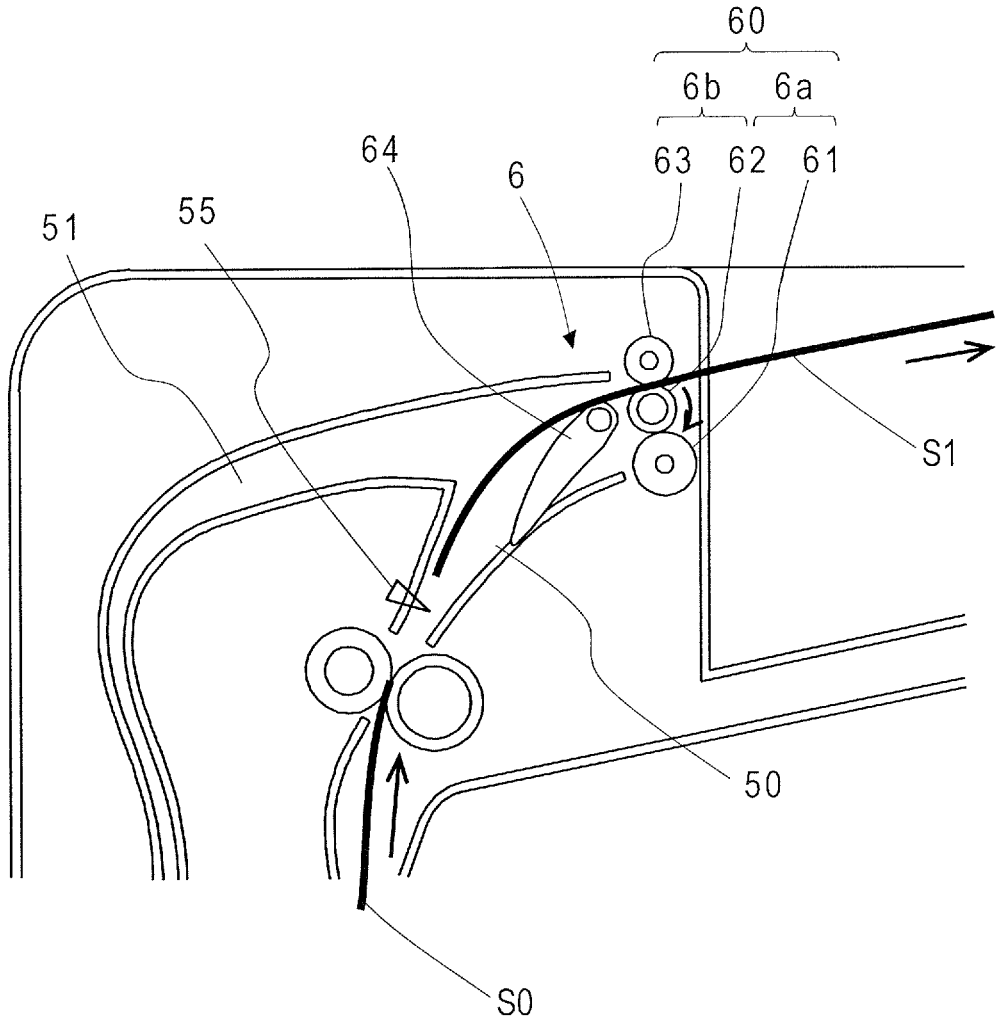
FIG. 22 is an explanatory diagram illustrating the sheet conveyance operation in the successive duplex recording according to the first exemplary embodiment.

For example, when the sheet S1 one surface of which has been subjected to recording is conveyed toward the outside of the apparatus to a position of FIG. 22 by the second nipping portion 6*b* of the conveyance roller unit 60, the detection information of the trailing end of the sheet by the second sensor 55 changes from detected to not detected. The operation of pivoting the guide member 64 from the first pivot position illustrated in FIG. 22 to the second pivot position illustrated in FIG. 23 can be started by using this change of the detection information of the second sensor 55. To be noted, after the state of FIG. 22, the sheet S0 is a sheet both surfaces of which have been subjected to recording and which is conveyed through the first conveyance path 50 after the sheet S1.

Figure 23:
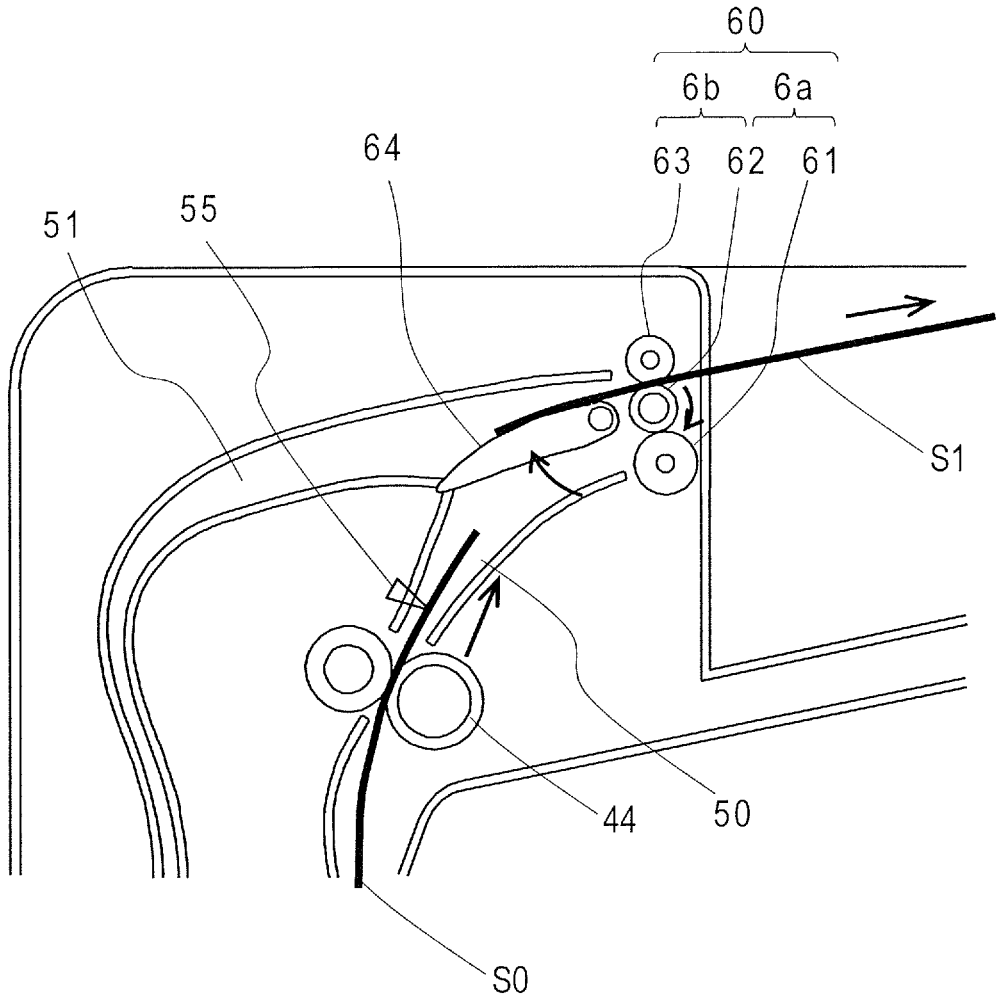
FIG. 23 is an explanatory diagram illustrating the sheet conveyance operation in the successive duplex recording according to the first exemplary embodiment.

For example, after the detection information of the second sensor 55 described above changes, the trailing end of the sheet S1 one surface of which has been subjected to recording reaches a position at which a predetermined amount of the sheet S1 remains inside the apparatus. Then, as illustrated in FIG. 23, the switch back mechanism 65 starts moving the guide member 64 from the first pivot position illustrated in FIG. 22 to the second pivot position illustrated in FIG. 23. This switching is performed by, for example, releasing the locking of the cam disk 84 by the solenoid link 88 by supplying power to the solenoid 87 after performing timekeeping of a suitable time by a timer after the occurrence of change of the detection information of the second sensor 55 described above.

As a result of this, the guide member 64 returns from the second pivot position illustrated in FIGS. 12 and 18 to the first pivot position illustrated in FIGS. 7 and 9 as illustrated in FIG. 23. That is, the guide member 64 returns to the first pivot position illustrated in FIGS. 7 and 9 at which the sheet S0 both surfaces of which have been subjected to recording is guided to the first nipping portion 6*a* of the conveyance roller unit 60.

Figure 24:
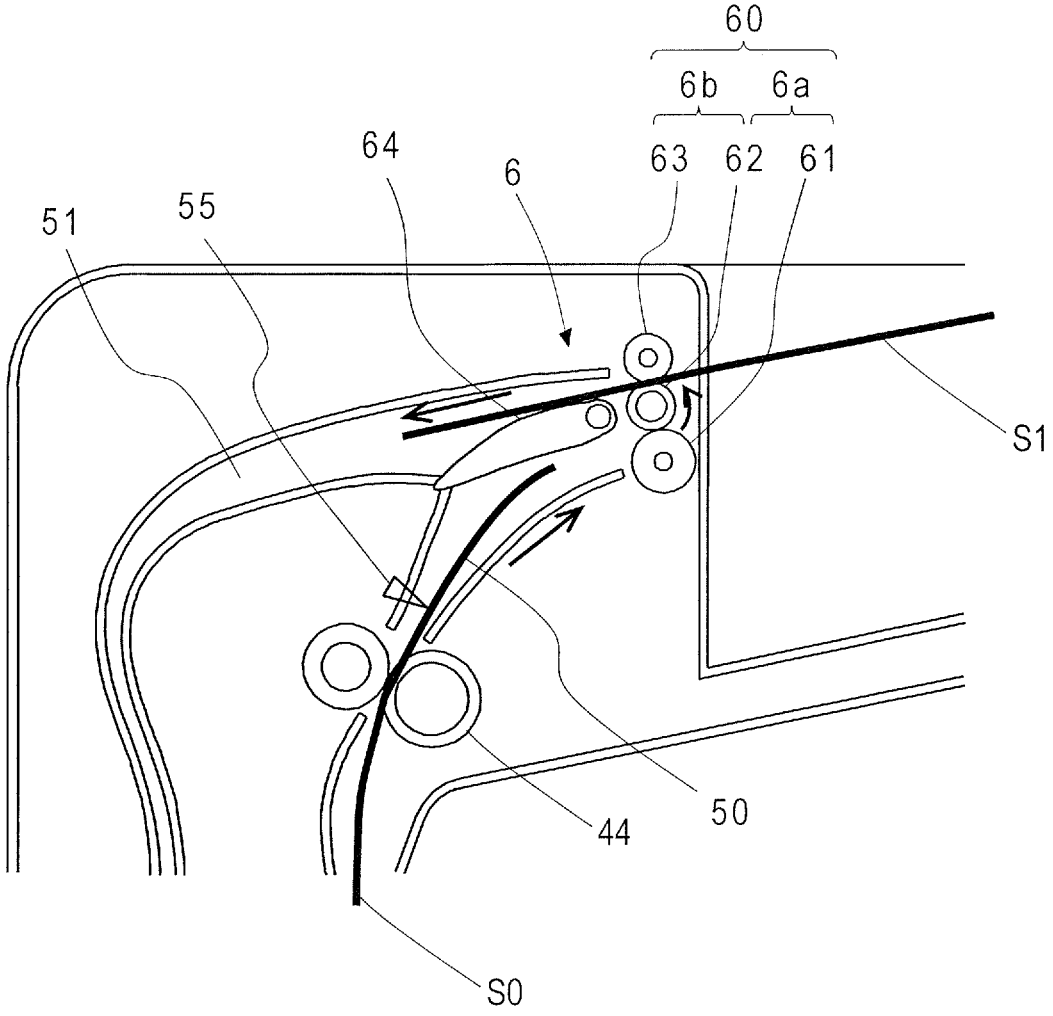
FIG. 24 is an explanatory diagram illustrating the sheet conveyance operation in the successive duplex recording according to the first exemplary embodiment.

To be noted, at the time of FIG. 23, the second conveyance roller 62 is still rotating in the clockwise direction by the driving in the reverse rotation direction and conveying the sheet one surface of which has been subjected to recording to the outside of the apparatus by the second nipping portion 6*b*. However, thereafter, when the guide member 64 moves to the first pivot position or to the vicinity thereof, the interlocking mechanism of the switch back mechanisms 65A and 65B, that is, the carrier control portion 72*c* of the guide link member 72 and the locking portion 92*b* of the carrier disk 92 are unlocked. This can be expressed by the change from FIG. 15 to FIG. 14. As a result of this, the second conveyance roller 62 is switched to normal rotation driving as illustrated in FIG. 24, and rotates in a counterclockwise direction. This rotational driving state of the conveyance roller unit 60 is a rotational driving state in which the sheet S0 both surfaces of which have been subjected to recording is discharged to the outside through the first conveyance path 50, and the sheet S1 one surface of which has been subjected to recording is conveyed into the second conveyance path 51.

Figure 25:
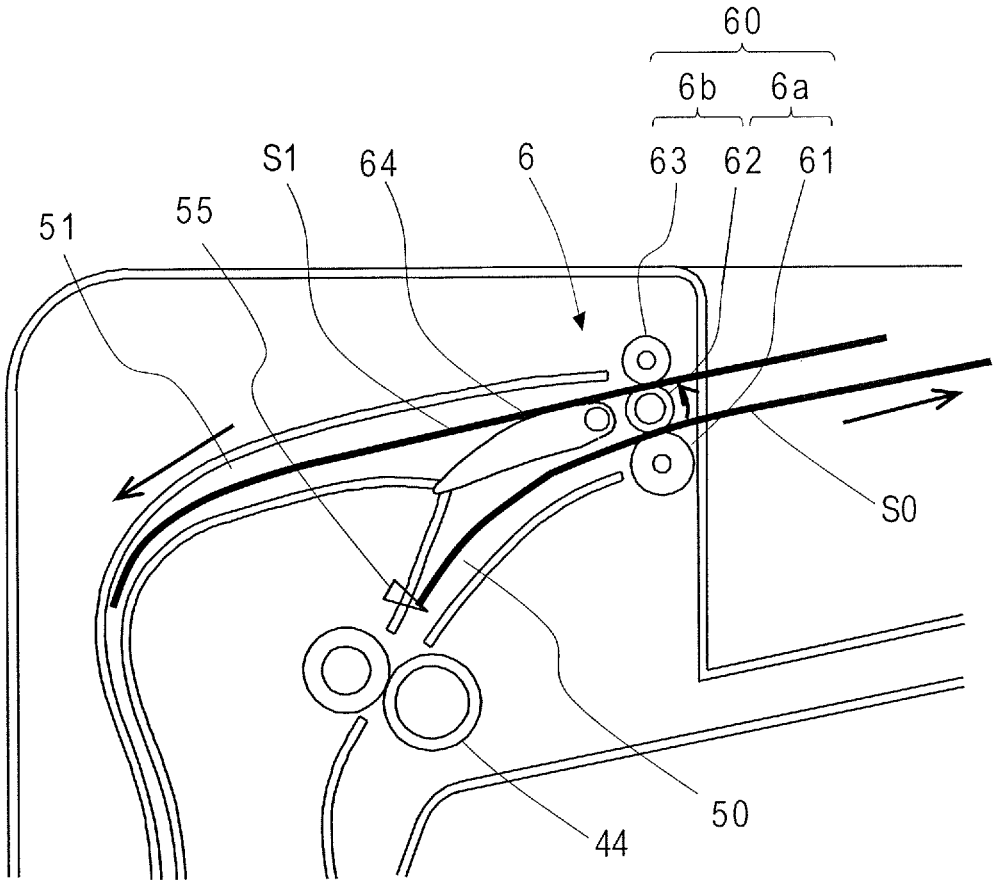
FIG. 25 is an explanatory diagram illustrating the sheet conveyance operation in the successive duplex recording according to the first exemplary embodiment.
Figure 26:
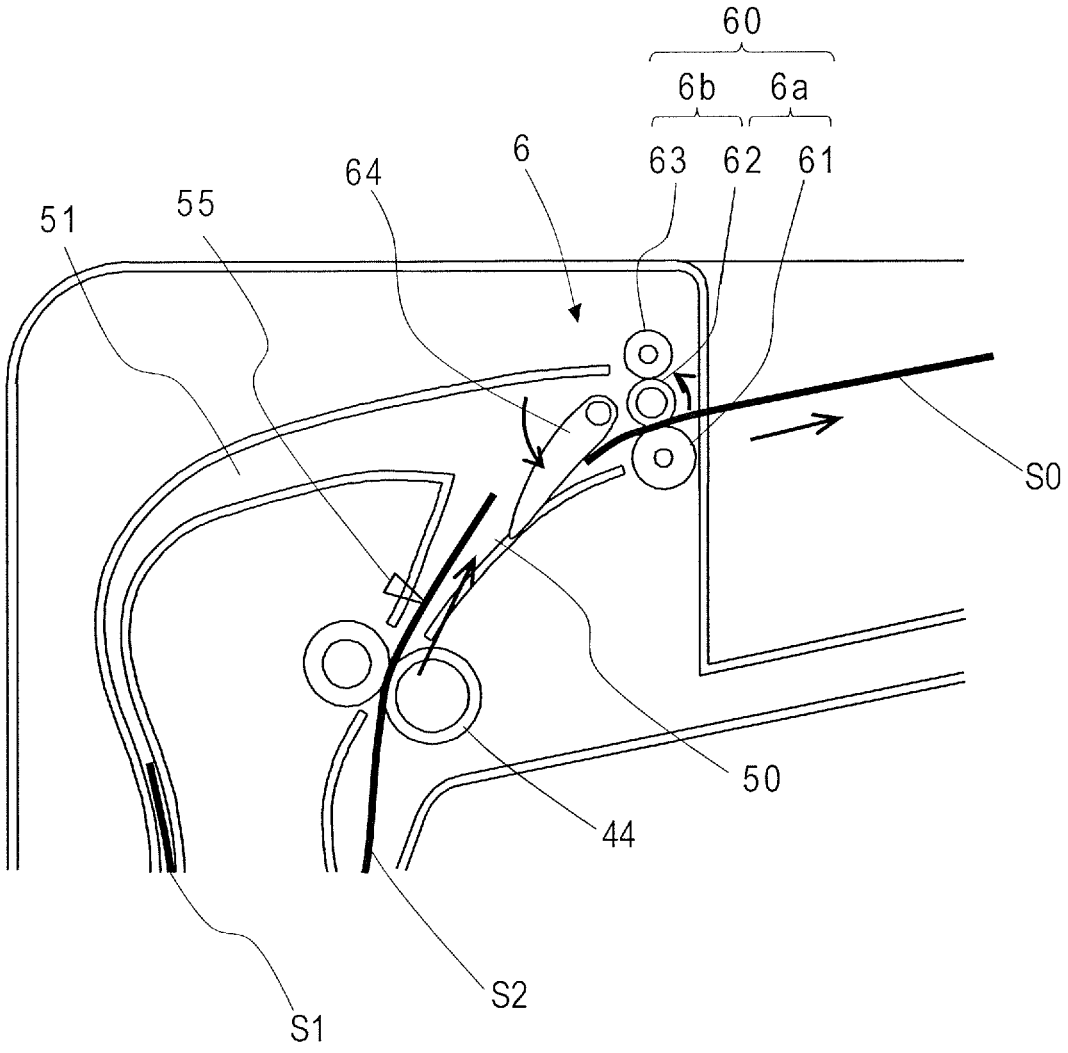
FIG. 26 is an explanatory diagram illustrating the sheet conveyance operation in the successive duplex recording according to the first exemplary embodiment.
Figure 27:
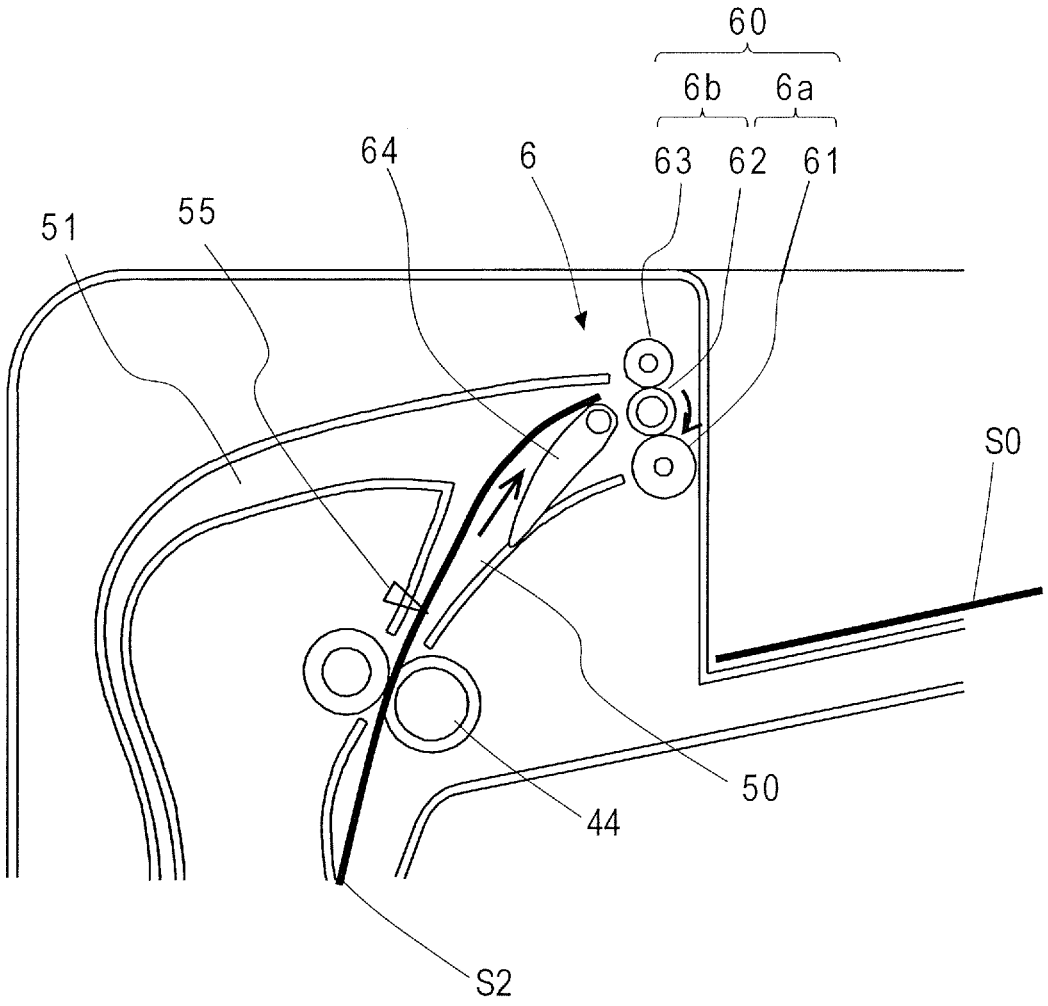
FIG. 27 is an explanatory diagram illustrating the sheet conveyance operation in the successive duplex recording according to the first exemplary embodiment.

When this rotational driving state of the conveyance roller unit 60 further progresses, conveyance of the sheets S1 and S0 is performed as illustrated in FIG. 25. Further, the sheet S0 both surfaces of which have been subjected to recording is discharged to the outside of the apparatus as illustrated in FIGS. 26 and 27. Meanwhile, in the present exemplary embodiment, the sheet S2 one surface of which has been subjected to recording is switched back and conveyed by effectively using the interval between the sheets S0 and S1 as illustrated in FIGS. 26 and 27.

That is, on the basis of the detection information of the trailing end and leading end of the sheet S2 or S0 described above by the second sensor 55, the switch back mechanism 65 operates to perform switch-back conveyance of the subsequent sheet S2 one surface of which has been subjected to recording. For example, when such a conveyance state as illustrated in FIG. 26 is generated, the switch back mechanism 65 starts moving the guide member 64 from the first pivot position to the second pivot position on the basis of the detection state of the second sensor 55. That is, the switch back mechanism 65 starts moving the guide member 64 to the second pivot position so as to guide the subsequent sheet S2 one surface of which has been subjected to recording to the second nipping portion 6*b*. The conveyance control of the switch back mechanism 65 at this time is the same as the conveyance control described with reference to FIG. 20. To be noted, in FIG. 26, for example, the trailing end of the sheet S0 both surfaces of which have been subjected to recording is at a position at which a predetermined amount of the sheet S0 remains inside the apparatus. In addition, the leading end of the subsequent sheet S2 one surface of which has been subjected to recording has passed the fixing portion 44 and the second sensor 55, and reached a position in the vicinity of the distal end of the guide member 64. In addition, the sheet S1 is being conveyed in the second conveyance path 51 for recording on the back surface thereof.

In addition, in FIG. 26, the switching of the conveyance roller unit 60 from the normal rotation driving to the reverse rotation driving synchronized with the movement of the guide member 64 to the second pivot position has not occurred, and the normal rotation state of discharging the sheet S0 to the outside is still maintained. In this manner, according to the present exemplary embodiment, sheets can be efficiently conveyed with short inter-sheet intervals by using a pivoting section of the guide member 64.

Furthermore, as illustrated in FIG. 27, when the sheet S0 both surfaces of which have been subjected to recording is discharged to the outside of the apparatus, in synchronization with the completion of movement of the guide member 64 to the second pivot position or a position in the vicinity thereof, the second conveyance roller 62 is switched to the reverse rotation driving. This switching of the second conveyance roller 62 from the normal rotation driving to the reverse rotation driving is, for example, as described above with reference to FIG. 21.

As described above, according to the present exemplary embodiment, the switch back mechanism 65 is constituted by the switch back mechanism 65A serving as a first transmission mechanism and the switch back mechanism 65B serving as a second transmission mechanism. Among these, the switch back mechanism 65A serving as a first transmission mechanism transmits the rotational driving force of the single drive source 70 so as to pivot the guide member 64 between the first pivot position and the second pivot position. In addition, the switch back mechanism 65B serving as a second transmission mechanism switches the rotational driving force of the drive source 70 such that the conveyance roller unit 60 is rotationally driven in the normal rotation direction or the reverse rotation direction.

Then, the switch back mechanisms 65A and 65B are interlocked such that, with a delay with respect to pivoting of the guide member 64 is started by the switch back mechanism 65A serving as a first transmission mechanism, the switch back mechanism 65B serving as a second transmission mechanism switches the conveyance roller unit 60 between the normal rotation direction and the reverse rotation direction.

More specifically, the switching unit receives driving force from the first transmission mechanism and transitions from the first state, in which the normal/reverse unit is in the normal rotation state, or the second state, in which the normal/reverse unit is in the reverse rotation direction, to the second state or the first state through a transition state, and, in the transition state, the rotation of the conveyance roller unit 60 is switched with a delay with respect to the start of pivoting of the guide member 64 by maintaining the rotation state of the normal/reverse unit. That is, a delay mechanism that delays the switching of rotation of the conveyance roller unit 60 with respect to the start of pivoting of the guide member 64 is constituted by this switching unit. In addition, in the present exemplary embodiment, in the case where the switching unit transitions from the first state to the second state, the switching unit takes the transition state as a result of the movable member 72*c* moving from a separation position to an engagement position in a state of being separated from the regulation member 92, and in the case where the switching unit transitions from the second state to the first state, the switching unit takes the transition state as a result of the switching member moving from the first position to the second position in a state of being not engaged with an engaged member, which is the switch back input gear 82 in the present exemplary embodiment.

According to the conveyance control described above, by using the section in which the guide member 64 is pivoted, current driving of the conveyance roller unit 60 in the normal rotation direction or the reverse rotation direction can be maintained, and thus conveyance of the sheet can be continued. As a result of this, a remarkable effect that successive duplex recording can be efficiently performed on a plurality of sheets can be obtained. Therefore, according to the image forming apparatus according to the present exemplary embodiment, for example, a remarkable effect that the intervals between conveyed sheets can be shortened and the productivity of duplex image formation can be greatly improved can be obtained. Particularly, the configuration of the present exemplary embodiment is effective in the case of a configuration in which the so-called triple rollers which are small, light, simple, and inexpensive are used as the conveyance roller unit 60, and, for example, the productivity of duplex image formation can be greatly improved.

Second Exemplary Embodiment

Figure 28:
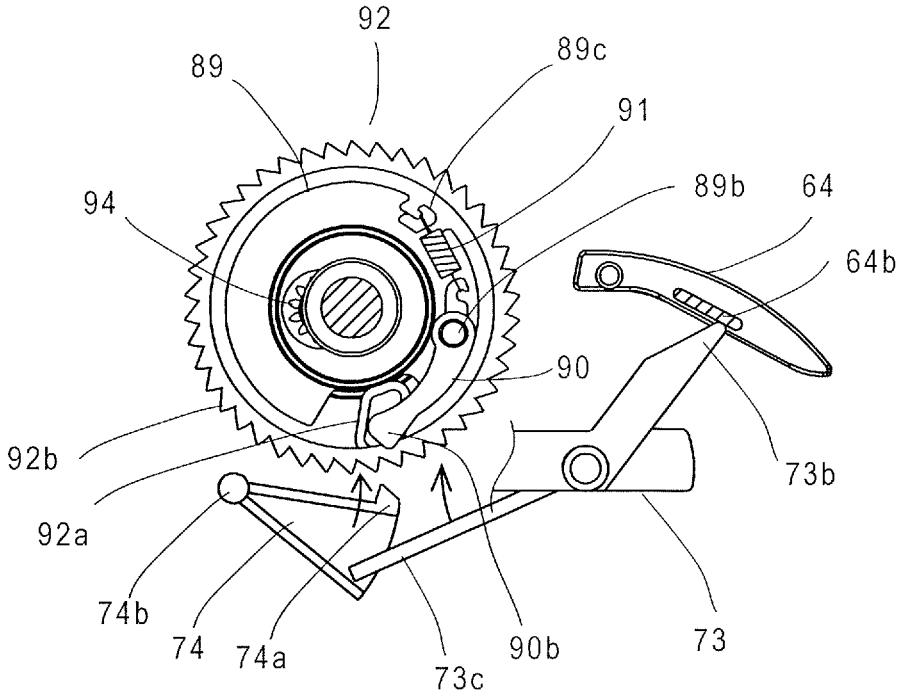
FIG. 28 is an explanatory diagram illustrating an operation of a switch back mechanism according to a second exemplary embodiment of the present invention.
Figure 29:
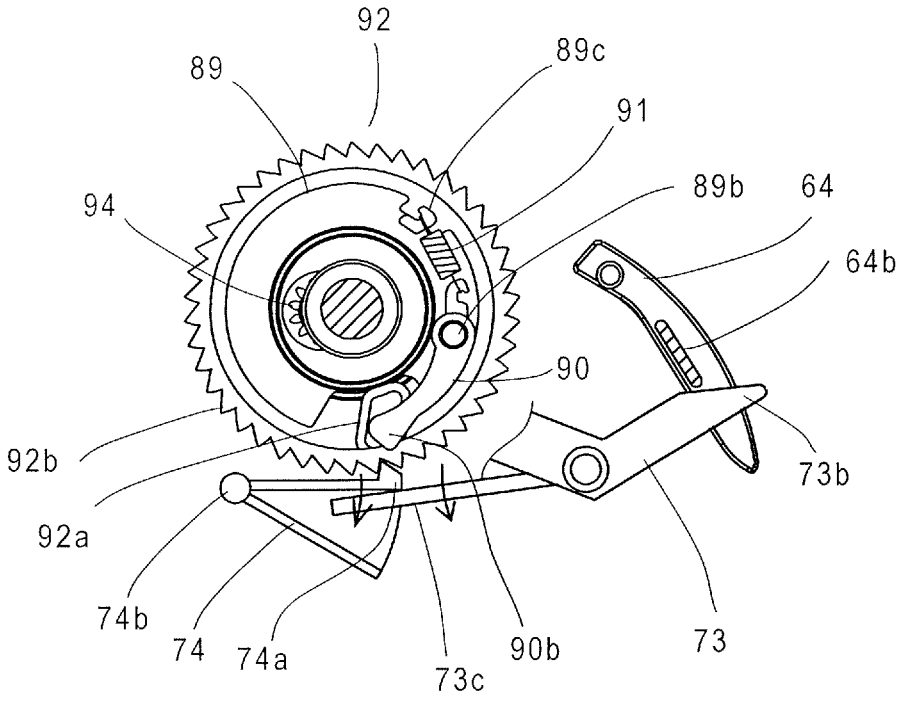
FIG. 29 is an explanatory diagram illustrating an operation of the switch back mechanism according to the second exemplary embodiment of the present invention.

Part of a switch back mechanism according to a second exemplary embodiment will be described below with reference to FIGS. 28 and 29. To be noted, in the description below, the same or equivalent members corresponding to the first exemplary embodiment described above are denoted by the same reference signs, and detailed description thereof will be omitted. In addition, in the second exemplary embodiment, members and configurations that are not illustrated, for example, the overall configurations of the image forming apparatus and the sheet conveyance apparatus are equivalent to the first exemplary embodiment described above. In addition, members not directly illustrated in FIGS. 28 and 29 are denoted by parenthesized reference signs as necessary. In the description below, difference from the first exemplary embodiment will be mainly described.

FIGS. 28 and 29 illustrate sectional structures of a switch back mechanism (65) of the second exemplary embodiment, and the forms of illustration thereof respectively correspond to, for example, FIGS. 14 and 15 described above. FIGS. 28 and 29 illustrate a different configuration of the mechanism that synchronizes the pivot position of the guide member 64 of the switch back mechanism (65) with the switching of the rotational driving direction of the conveyance roller unit (60). In addition, in FIGS. 28 and 29, the rotational driving states of the conveyance roller unit (60) respectively correspond to normal rotation driving and reverse rotation driving.

As illustrated in FIG. 28, a guide link member 73 and the guide member 64 are held in a state of abutting each other by being each pressed by an unillustrated spring. The pivot position of the guide link member 73 is controlled by a guide cam, which is not illustrated and corresponds to the guide cam 83 of FIGS. 5 and 6, similarly to the guide link member 72 described above, and thus the guide member 64 is pivoted.

In the present exemplary embodiment, a claw link portion 73*c* is planted on the guide link member 73, and a carrier control claw 74 is controlled via this claw link portion 73*c*. The carrier control claw 74 includes a locking portion disposed at a predetermined opening angle in a sector shape, is pivotably supported about a pivot shaft 74*b*, and includes a locking claw 74*a* facing the carrier disk 92.

In FIG. 28, the guide link member 73 has pivoted the guide member 64 to the first pivot position, and in FIG. 29, the guide link member 73 has pivoted the guide member 64 to the second pivot position. For example, in the case where the guide link member 73 pivots the guide member 64 from the first pivot position illustrated in FIG. 28 to the second pivot position illustrated in FIG. 29, the claw link portion 73*c* pivots in an arrow direction. As a result of this, the claw link portion 73*c* abuts the locking portion of the carrier control claw 74, which is on the upper side in the figure, and pivots the carrier control claw 74 in the counterclockwise direction such that the locking claw 74*a* approaches the locking portion 92*b* of the carrier disk 92.

Then, when the guide link member 73 moves the guide member 64 to the vicinity of the second pivot position, the locking claw 74*a* locks the locking portion 92*b* of the carrier disk 92 as illustrated in FIG. 29. As a result of this, similarly to the first exemplary embodiment, the conveyance roller unit (60) is switched to the reverse rotation driving.

In the case of switching the conveyance roller unit (60) from the reverse rotation driving to the normal rotation driving, as indicated by an arrow in FIG. 29, the claw link portion 73*c* pivots counterclockwise. Then, the carrier control claw 74 engaging therewith pivots clockwise, thus the locking of the locking claw 74*a* and the locking portion 92*b* of the carrier disk 92 is cancelled, and the conveyance roller unit (60) is switched to the normal rotation driving.

By appropriately determining the planting angle of the claw link portion 73*c* with respect to the guide link member 73 and the opening angle of the locking portion having a sector shape of the carrier control claw 74, the necessary delay between the swing of the guide member 64 and the switching of the normal rotation and reverse rotation of the conveyance roller unit (60) synchronized therewith can be set. As a result of this, a delay timing equivalent to the first exemplary embodiment can be provided between the swing of the guide member 64 and the switching between the normal rotation and reverse rotation of the conveyance roller unit (60).

Also according to the configuration described above, for example, at the start of movement of the guide member 64, the second conveyance roller 62 can be maintained rotating in the current rotation direction without starting reverse rotation. For example, the reverse rotation of the second conveyance roller 62 can be started immediately before or when finishing the movement of the guide member 64 such that the second conveyance roller 62 rotates in a direction opposite to the previous rotation direction, and therefore duplex recording can be performed with a high productivity similarly to the first exemplary embodiment.

Third Exemplary Embodiment

Figure 30:
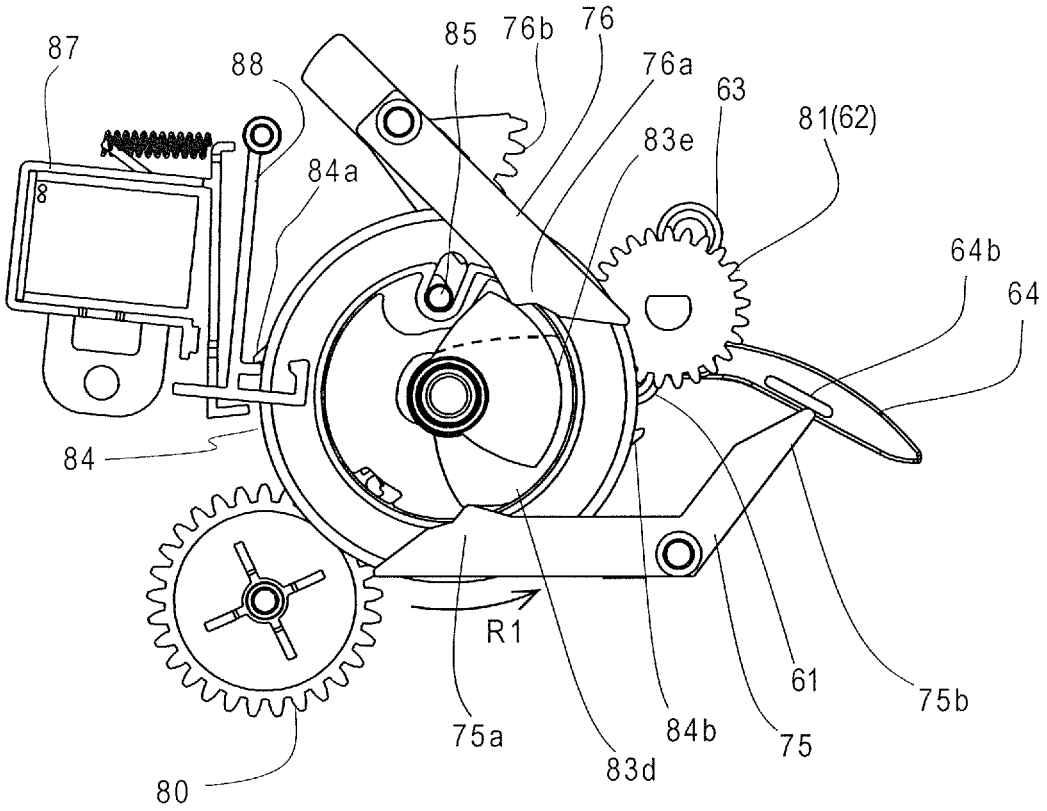
FIG. 30 is a front view of a switch back mechanism according to a third exemplary embodiment of the present invention.
Figure 31:
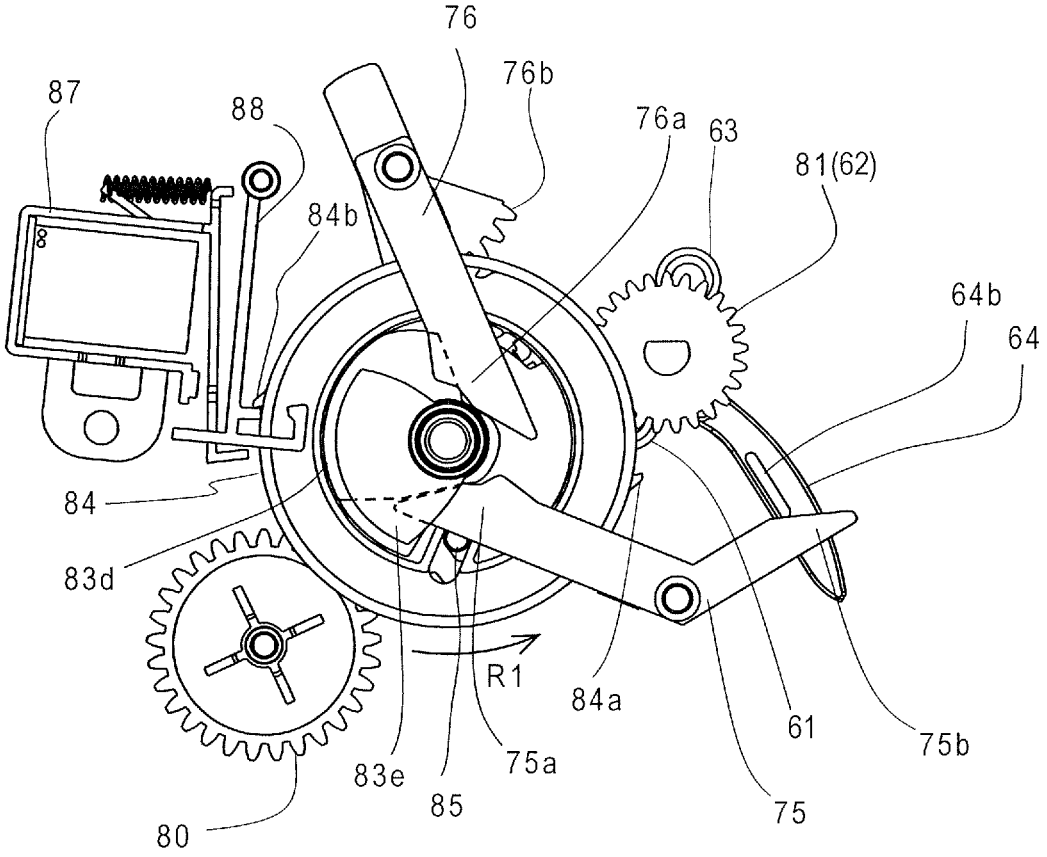
FIG. 31 is a front view of the switch back mechanism according to a third exemplary embodiment of the present invention.

Part of a switch back mechanism according to a third exemplary embodiment will be described below with reference to FIGS. 30 and 31. Also in the present exemplary embodiment, the same or equivalent members corresponding to the first exemplary embodiment described above are denoted by the same reference signs, and detailed description thereof will be omitted. In addition, in the third exemplary embodiment, members and configurations that are not illustrated, for example, the overall configurations of the image forming apparatus and the sheet conveyance apparatus are equivalent to the first exemplary embodiment or the second exemplary embodiment described above. In addition, members not directly illustrated in FIGS. 30 and 31 are denoted by parenthesized reference signs as necessary. In the description below, difference from the first exemplary embodiment or the second exemplary embodiment will be mainly described.

In the first or second exemplary embodiment described above, the switching of the conveyance roller unit 60 between the normal rotation direction and the reverse rotation direction is performed by using the carrier control portion 72*c* or 73*c* that engages with the carrier disk 92 and via the guide link member 72 or 73 driven by the guide cam 83.

In contrast, in the third exemplary embodiment, the guide member 64 is controlled to move between the first and second pivot positions by a guide link member 75 driven by the guide cam (83). The guide link member 75 of the present exemplary embodiment corresponds to the guide link member 72 or 73 of the first or second exemplary embodiment described above, but does not include a portion corresponding to the carrier control portion 72*c* or the claw link portion 73*c*, and controls only the pivoting of the guide member 64 between the first and second pivot positions.

Further, in the present exemplary embodiment, the switching of the conveyance roller unit 60 between the normal rotation direction and the reverse rotation direction is performed by a carrier control link member 76 including a carrier control portion 76*b* that is driven by the guide cam 83 and engages with the carrier disk 92.

FIGS. 30 and 31 illustrate, for example, states respectively corresponding to FIGS. 9 and 12 of the first exemplary embodiment, and, in these figures, the guide member 64 is controlled to pivot to the first pivot position illustrated in FIG. 30 and the second pivot position illustrated in FIG. 31, respectively.

In FIGS. 30 and 31, a first cam portion 83*d* and a second cam portion 83*e* are formed on the circumference of the guide cam 83 at different angles. In FIG. 30, the first cam portion 83*d* of the guide cam 83 and the guide link member 75, and the guide link member 75 and the guide member 64 are each held in a state of abutting each other by being pressed by an unillustrated spring. Similarly to the first exemplary embodiment, when the guide cam 83 is in a rotating state by the control of the cam stopper 85, the pivot position of the guide link member 75 changes in accordance with the shape of the first cam portion 83*d* of the guide cam 83, and thus the pivot position of the guide member 64 can be controlled.

In addition, in the present exemplary embodiment, the carrier control link member 76 is formed separately from the guide link member 75. Further, the position at which the carrier control link member 76 is disposed is different from, for example, the position at which the carrier control portion 72*c* of FIGS. 9 and 12 is disposed with respect to the guide cam 83, and is almost right above the guide cam 83. The carrier control link member 76 is urged by an unillustrated spring, and is held to be capable of abutting the second cam portion 83*e* of the guide cam 83. Further, similarly to the first exemplary embodiment, when the guide cam 83 becomes rotatable by the control of the cam stopper 85, the carrier control link member 76 can be pivoted in accordance with the shape of the second cam portion 83*e* of the guide cam 83.

As described above, in the third exemplary embodiment, the guide link member 75 for moving the guide member 64 and the carrier control link member 76 that determines the timing of reversing the second conveyance roller 62 are formed as separate bodies.

According to such a configuration, for example, timings of start of movement of the guide member 64 and start of reversing the second conveyance roller 62 can be made greatly different, that is, the timing of start of reversing the second conveyance roller 62 can be greatly delayed with respect to the start of movement of the guide member 64. That is, the delay of start of reversing the second conveyance roller 62 with respect to the start of movement of the guide member 64 can be set very flexibly.

For example, according to the configuration of the third exemplary embodiment, reverse rotation of the second conveyance roller 62 of the conveyance roller unit 60 can be started with a large delay with respect to the start of movement of the guide member 64 between the first and second pivot positions. That is, by using the section in which the guide member 64 is moved between the first and second pivot positions, the current rotational driving direction of the second conveyance roller 62 can be maintained as long as possible. Therefore, according to the configuration of the third exemplary embodiment, there is a possibility that the distance between sheets in the conveyance path can be shortened and the sheets can be conveyed more efficiently than in the exemplary embodiments described above. That is, according to the third exemplary embodiment, there is a possibility that duplex image formation can be performed on sheets with a higher productivity.

To be noted, in the description above, an example in which the first nipping portion 6*a* serving as a sheet discharge portion and the second nipping portion 6*b* serving as a sheet inversion portion are constituted by the triple rollers 61, 62, and 63 has been shown. However, the sheet discharge section and the sheet inversion section including the first nipping portion 6*a* serving as the sheet discharge portion and the second nipping portion 6*b* serving as the sheet inversion portion are not only constituted by the triple rollers. For example, as in a fourth exemplary embodiment that will be described later, the first nipping portion 6*a* serving as a sheet discharge portion and the second nipping portion 6*b* serving as a sheet inversion portion may be respectively constituted by sheet nipping portions of first and second pairs of opposing rollers. In this case, the first and second pairs of opposing rollers are, for example, interlocked via a transmission mechanism such as a gear train or a chain. This transmission mechanism can be configured such that the first nipping portion 6*a* serving as a sheet discharge portion and the second nipping portion 6*b* serving as a sheet inversion portion have a relationship of rotational driving direction similar to what has been described above.

Fourth Exemplary Embodiment

Part of a switch back mechanism according to a fourth exemplary embodiment will be described below with reference to FIGS. 32 to 42. Also in the present exemplary embodiment, the same or equivalent members corresponding to the first exemplary embodiment described above are denoted by the same reference signs, and detailed description thereof will be omitted. In addition, in the fourth exemplary embodiment, members and configurations that are not illustrated, for example, the overall configurations of the image forming apparatus and the sheet conveyance apparatus are equivalent to the first exemplary embodiment or the second exemplary embodiment described above.

In the first exemplary embodiment described above, the triple rollers 61, 62, and 63 are used for the sheet inversion section, and the sheet inversion section includes the third rotary member 63 disposed to oppose the second rotary member 62. Further, this third rotary member 63 constitutes the sheet inversion portion that inverts and conveys a sheet together with the second rotary member 62 as a result of the second rotary member 62 being rotationally driven in the normal rotation direction or the reverse rotation direction.

Figure 32:
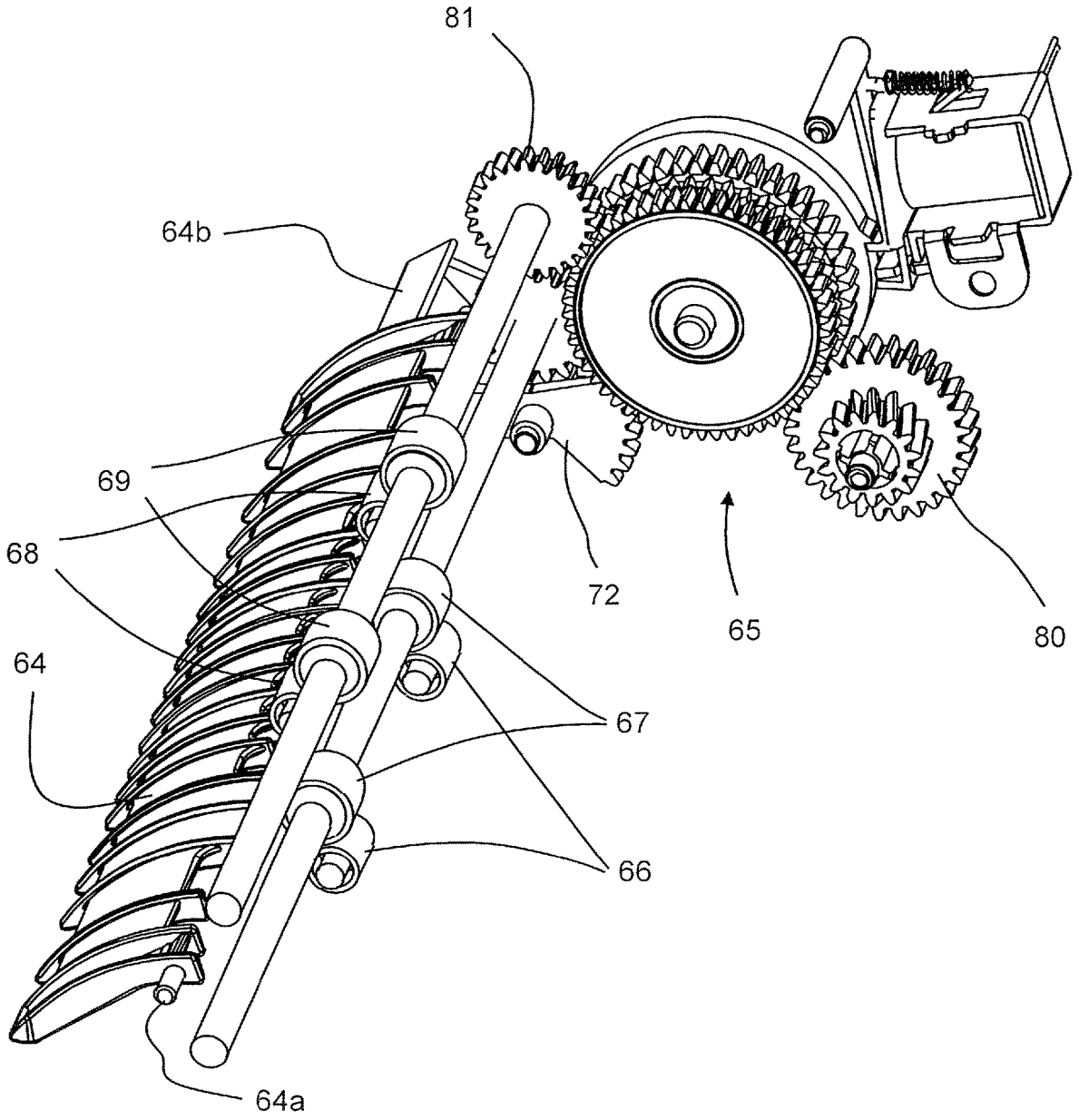
FIG. 32 is an explanatory diagram illustrating a sheet conveyance operation in successive duplex recording according to a fourth exemplary embodiment of the present invention.
Figure 33:
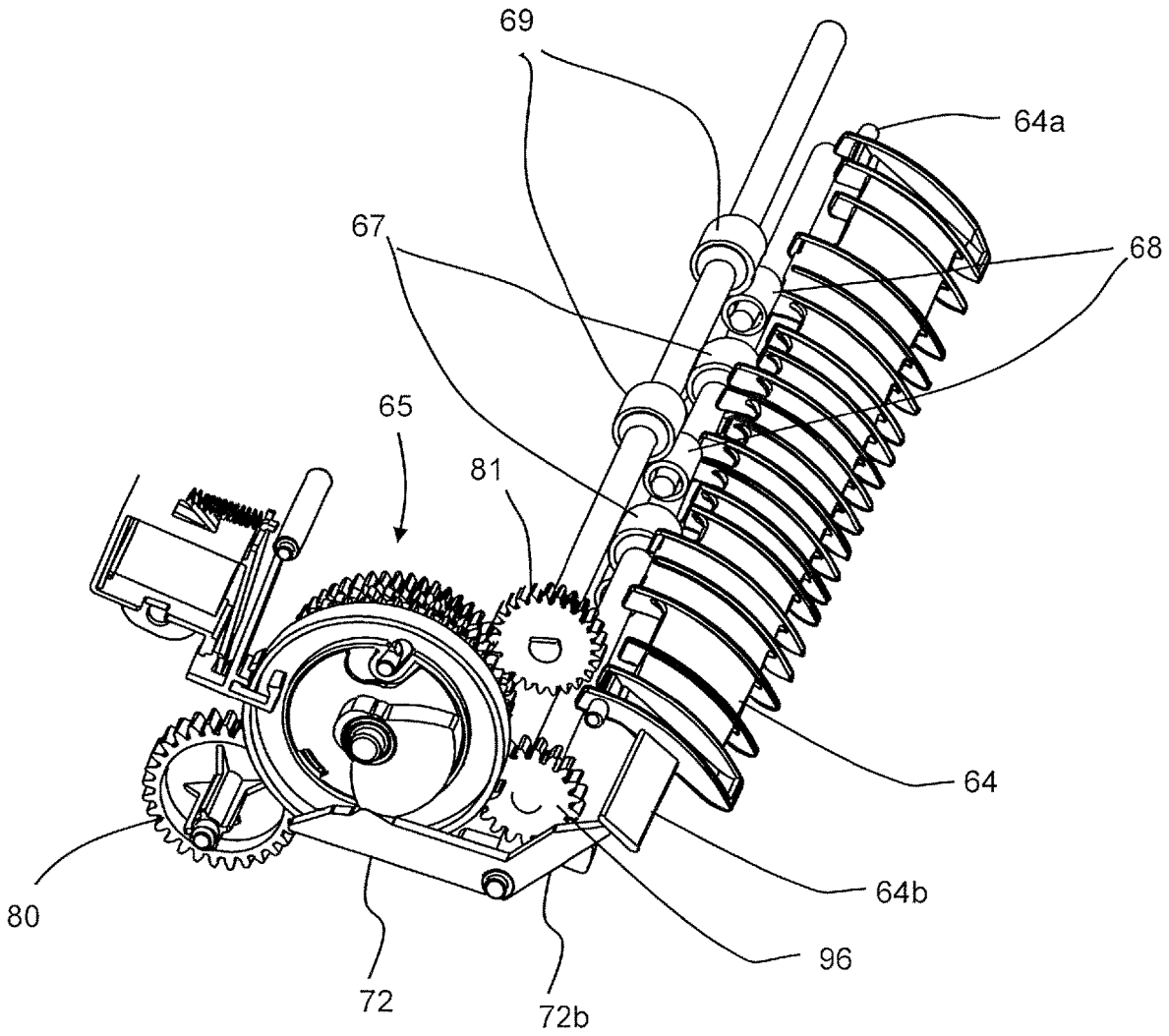
FIG. 33 is an explanatory diagram illustrating the sheet conveyance operation in the successive duplex recording according to the fourth exemplary embodiment of the present invention.

In contrast, in the fourth exemplary embodiment, two pairs of conveyance rollers 66, 67, 68, and 69 are used, and a first rotary member 66 disposed to oppose a second rotary member 67 and a third rotary member 68 disposed to oppose a fourth rotary member 69 are provided. That is, in the present exemplary embodiment, the fourth rotary member 69 serves as a reverse rotary member, and the fourth rotary member 69 and the third rotary member 68 that is a driven roller disposed to oppose the fourth rotary member 69 constitute an inversion conveyance roller pair that inverts and conveys a sheet. In addition, the first and second rotary members 66 and 67 described above constitute a discharge roller pair that discharges and conveys a sheet. Further, the first rotary member 66 conveys a sheet in a discharge direction as a result of the second rotary member 67 being rotationally driven in the normal rotation direction the whole time, and the third rotary member 68 constitutes a sheet inversion portion that inverts and conveys a sheet as a result of the fourth rotary member 69 being rotationally driven in the normal rotation direction or the reverse rotation direction as illustrated in FIGS. 32 and 33.

Among these conveyance rollers, to a sheet discharge conveyance roller 67 serving as the second rotary member, the rotational driving force of the drive source 70 such as a motor is transmitted in the normal rotation direction the whole time via the input gear 80, the switch back input gear 82, a roller gear 96, and so forth. Further, to an inversion conveyance roller 69 serving as the fourth rotary member, the rotational driving force of the drive source 70 such as a motor is transmitted in the normal rotation direction or the reverse rotation direction via the input gear 80, the switch back output gear 93 in the switch back mechanism 65, the roller gear 81, and so forth.

Conveyance of Sheet

Next, a conveyance operation of sheets S0, S1, and S2 at the time of duplex recording in the laser beam printer 1 according to the present exemplary embodiment will be described with reference to FIGS. 34 to 42. In the description below, an operation of discharging the sheet S0 which is leading and both surfaces of which have been subjected to recording while switching back and conveying the different sheet S1 one surface of which has been subjected to recording in an opposite direction by the discharge inversion portion will be mainly described as an example. In addition, in the description below, an example of control in which conveyance is performed by letting in three sheets, and the subsequent sheet S2 one surface of which has been subjected to recording is switched back by using an interval between the sheets S0 and S1 that are to be discharged will be described. In the description below, switch-back inversion conveyance by the discharge inversion portion, the movement of sheets to be discharged, and operations of the guide member 64 and the inversion conveyance roller 69 will be mainly described.

Figure 34:
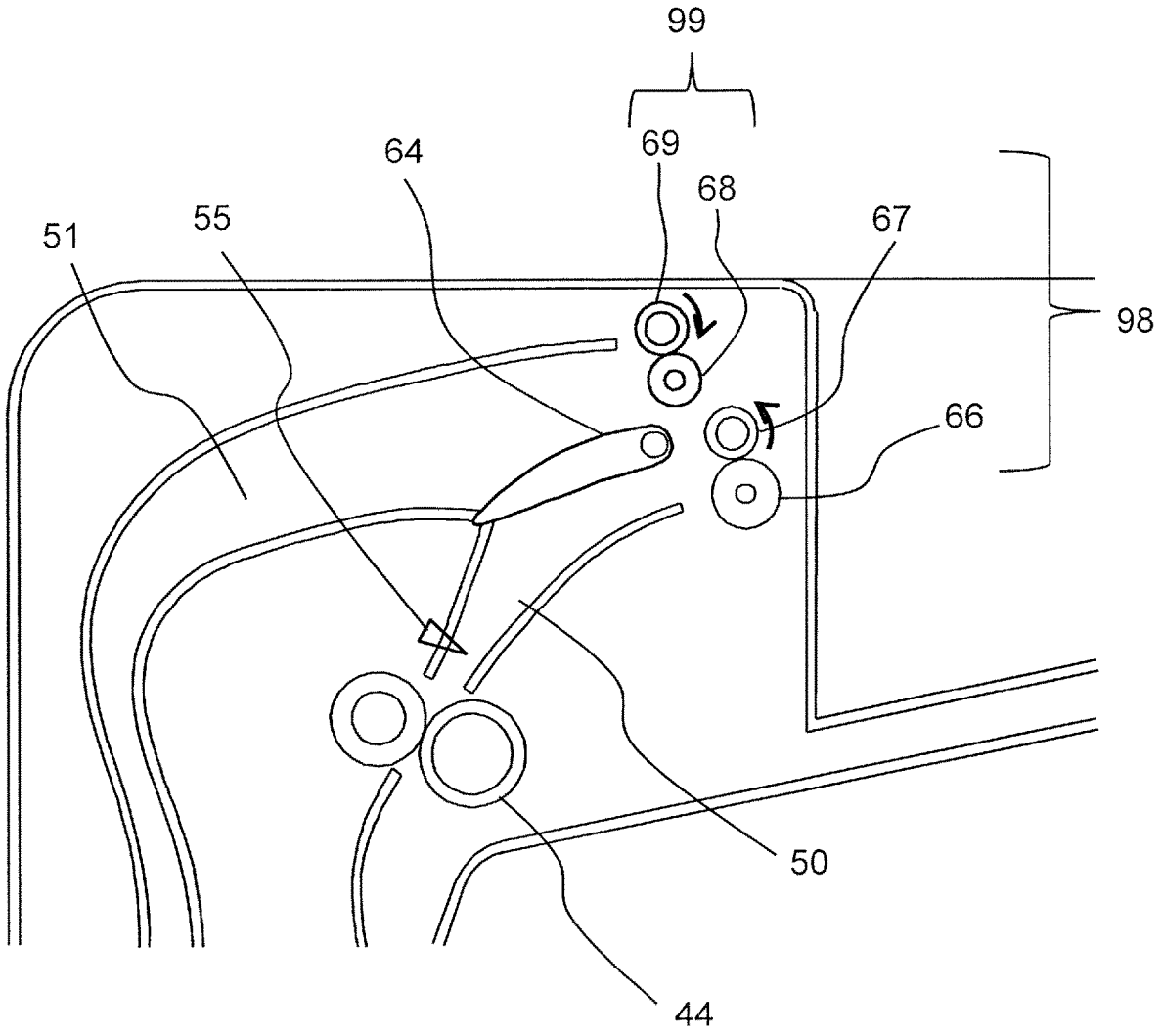
FIG. 34 is an explanatory diagram illustrating the sheet conveyance operation in the successive duplex recording according to the fourth exemplary embodiment of the present invention.

FIG. 34 illustrates a structure in the vicinity of the discharge inversion portion, and the state of this figure corresponds to, for example, the initial position of the discharge inversion portion. In FIG. 34, the guide member 64 is held at a first position at which a sheet conveyed from the first conveyance path 50 is guided to a sheet discharge conveyance roller unit 98. The sheet discharge conveyance roller 67 is rotationally driven in a counterclockwise direction the whole time as indicated by an arrow so as to discharge the sheet. In addition, at this time, the inversion conveyance roller 69 is rotationally driven in a clockwise direction, which is opposite to a direction in which the sheet is discharged, as indicated by an arrow.

Figure 35:
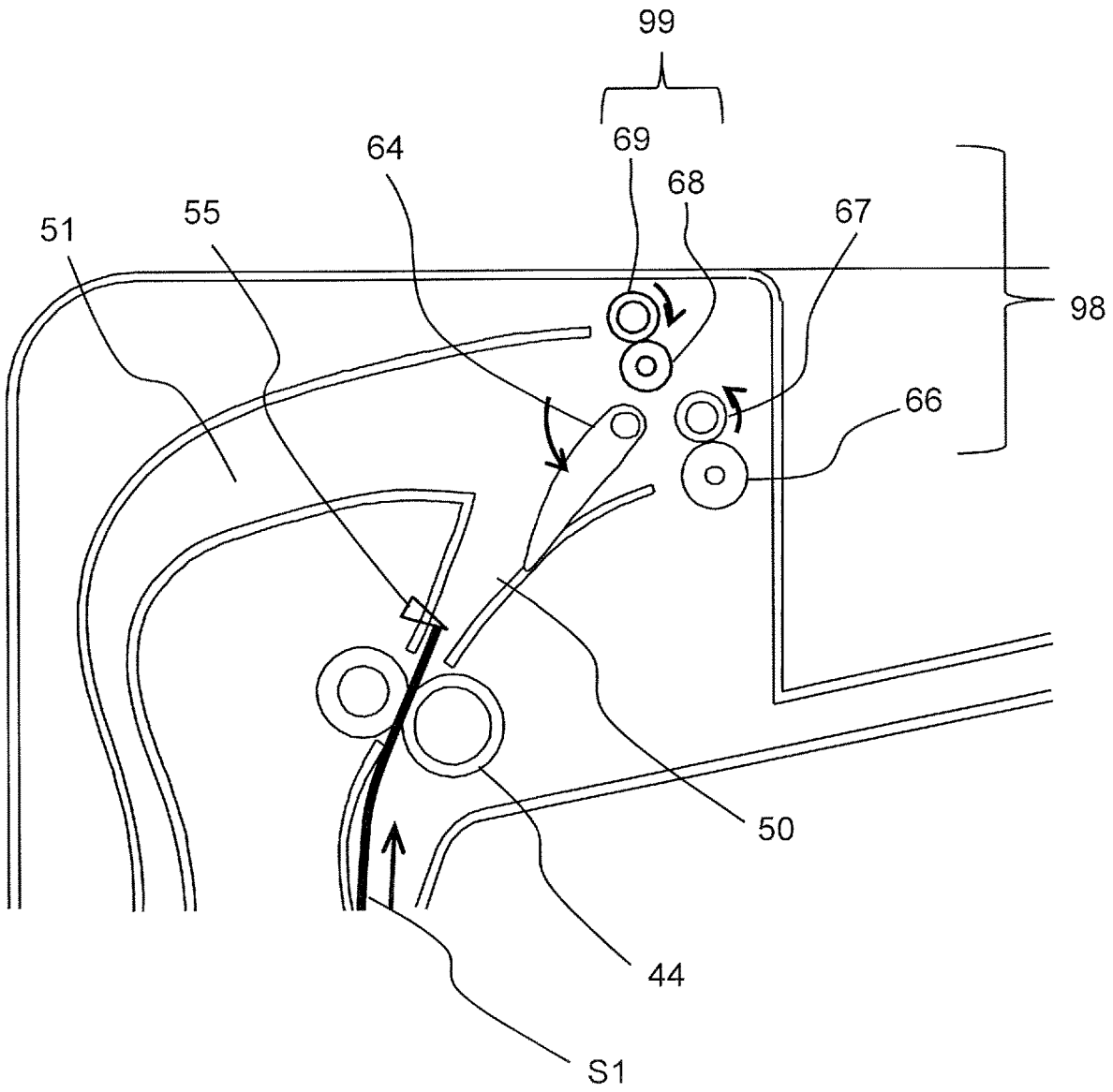
FIG. 35 is an explanatory diagram illustrating the sheet conveyance operation in the successive duplex recording according to the fourth exemplary embodiment of the present invention.

FIG. 35 illustrates a state in which the leading end of the sheet S1 on one surface of which recording has been completed has passed through the fixing portion 44 and reached the position of the second sensor 55. As illustrated in this figure, when the second sensor 55 detects the leading end of the sheet S1, the switch back mechanism 65 operates on the basis of this sheet detection information. As a result of this, the guide member 64 is pivoted to the second pivot position at which the sheet S is guided to the nipping portion of an inversion conveyance roller unit 99. This can be expressed by the change from FIG. 7 to FIG. 12.

However, as has been described, the switch back mechanism 65 does not drive the inversion conveyance roller 69 in the reverse rotation direction at the start of pivoting of the guide member 64. That is, the switch back mechanism 65 drives the inversion conveyance roller 69 in the reverse rotation direction with a delay with respect to the pivoting of the guide member 64, for example, when the guide member 64 has come to the vicinity of the second pivot position or reached the second pivot position. This switching of the driving direction from the normal rotation direction to the reverse rotation direction occurs as a result of the interlocking mechanism of the switch back mechanisms 65A and 65B, that is, the carrier control portion 72*c* of the guide link member 72 and the locking portion 92*b* of the carrier disk 92 being locked as described above. This can be expressed by the change from FIG. 14 to FIG. 15.

Figure 36:
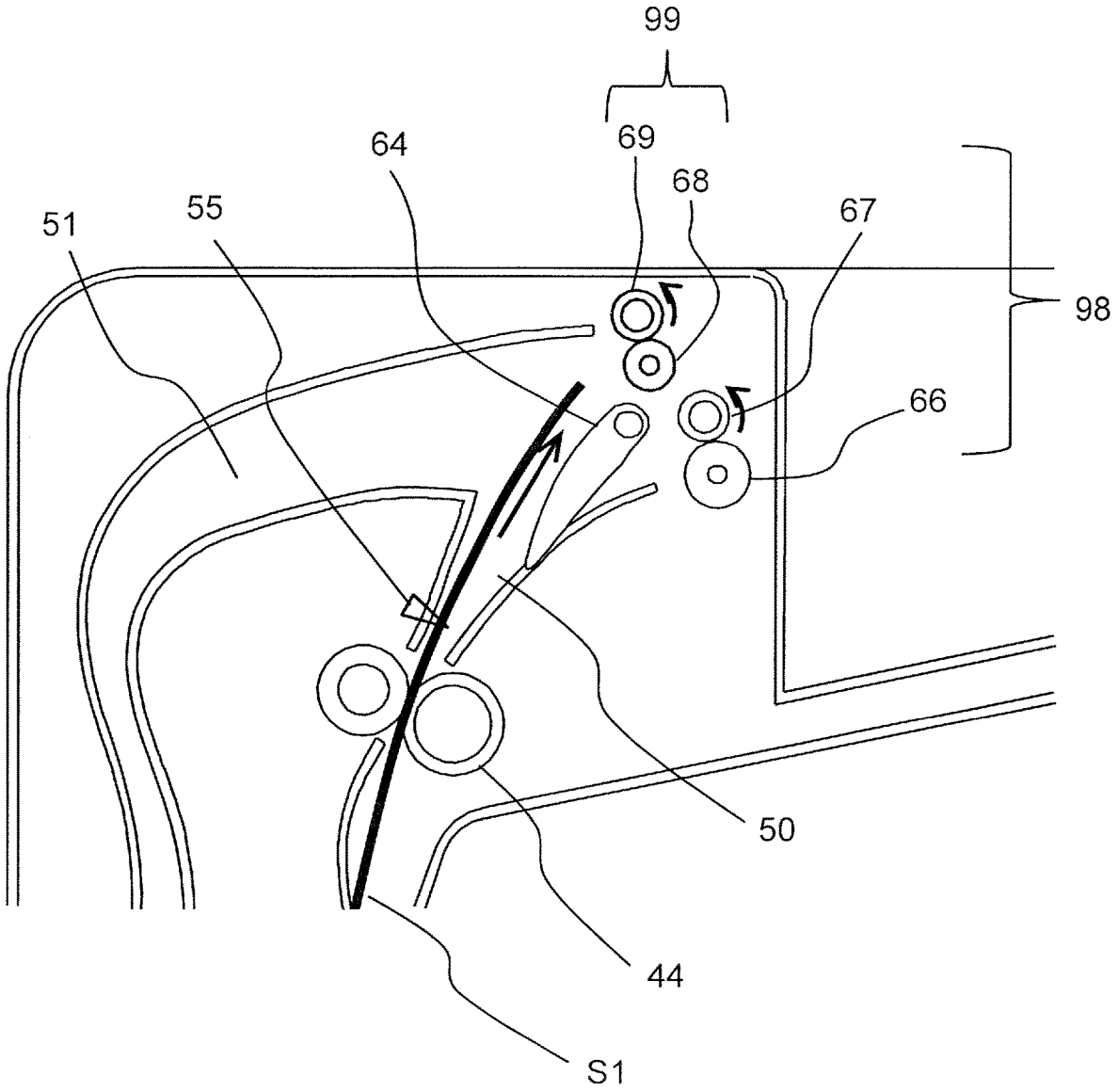
FIG. 36 is an explanatory diagram illustrating the sheet conveyance operation in the successive duplex recording according to the fourth exemplary embodiment of the present invention.

In FIG. 35, although the guide member 64 has almost pivoted to the second pivot position, the inversion conveyance roller 69 is not yet driven in the reverse rotation direction as indicated by an arrow. Then, as illustrated in FIG. 36, when the guide member 64 pivots to the second pivot position, the interlocking mechanism of the switch back mechanisms 65A and 65B, that is, the carrier control portion 72*c* of the guide link member 72 and the locking portion 92*b* of the carrier disk 92 are locked. This can be expressed by the change from FIG. 14 to FIG. 15. As a result of this, the rotational driving force is transmitted through the first idler gear 94 and the second idler gear 95, and the driving of the inversion conveyance roller 69 in the reverse rotation direction is started as illustrated in FIG. 36. As a result of this, the inversion conveyance roller 69 rotates in the clockwise direction as indicated by an arrow in FIG. 36. As a result of this, the sheet is conveyed out toward the outside of the apparatus by the driving of the nipping portion of the inversion conveyance roller unit 99 in the reverse rotation direction. This operation is continued until, for example, the trailing end of the sheet S1 is conveyed to a position at which the sheet S1 can be introduced into the second conveyance path 51.

Figure 37:
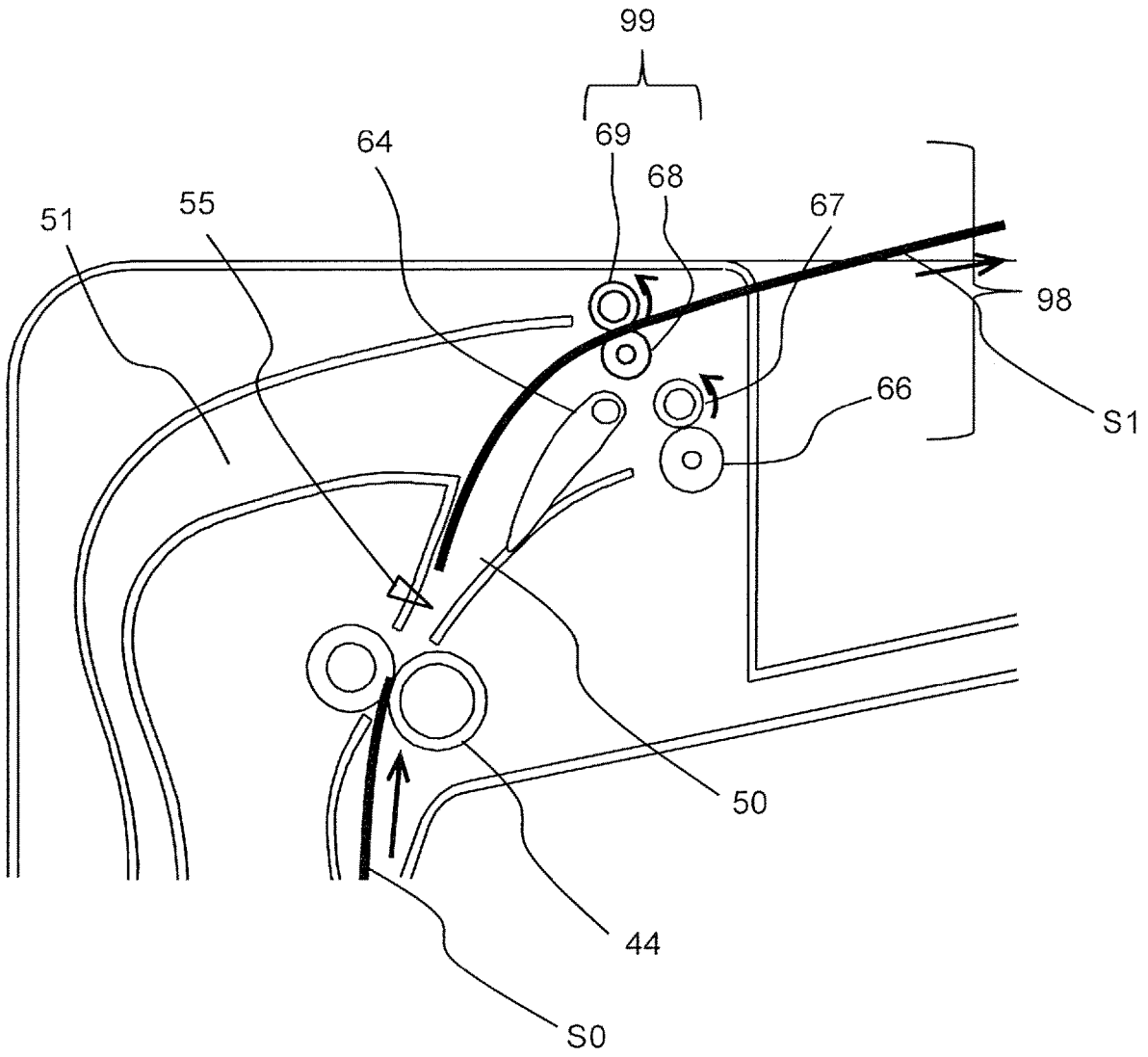
FIG. 37 is an explanatory diagram illustrating the sheet conveyance operation in the successive duplex recording according to the fourth exemplary embodiment of the present invention.

For example, when the sheet S1 one surface of which has been subjected to recording is conveyed toward the outside of the apparatus to a position of FIG. 37 by the nipping portion of the inversion conveyance roller unit 99, the detection information of the trailing end of the sheet by the second sensor 55 changes from detected to not detected. The operation of pivoting the guide member 64 from the first pivot position illustrated in FIG. 37 to the second pivot position illustrated in FIG. 38 can be started by using this change of the detection information of the second sensor 55. To be noted, after the state of FIG. 37, the sheet S0 is a sheet both surfaces of which have been subjected to recording and which is conveyed through the first conveyance path 50 after the sheet S1.

Figure 38:
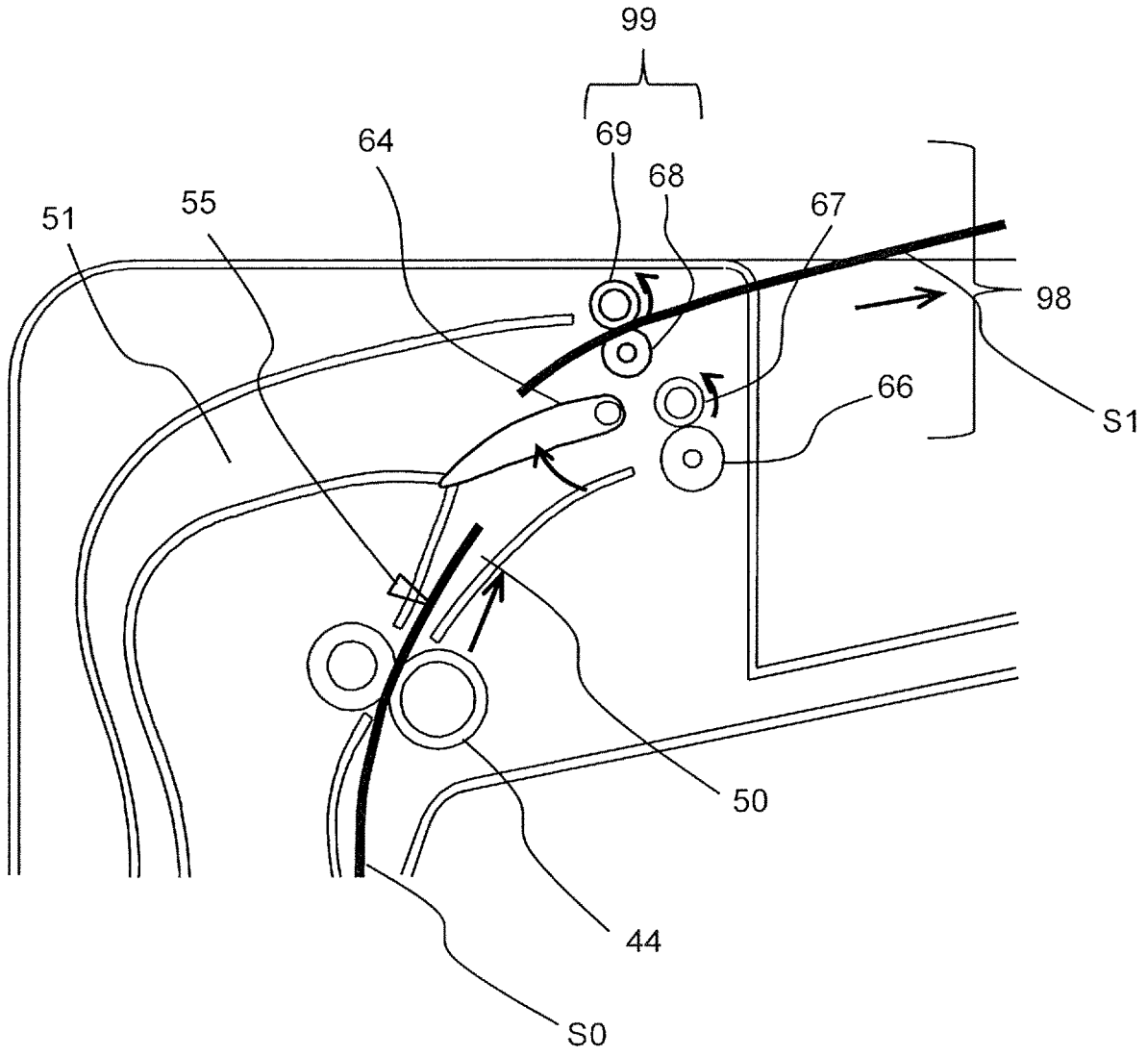
FIG. 38 is an explanatory diagram illustrating the sheet conveyance operation in the successive duplex recording according to the fourth exemplary embodiment of the present invention.

For example, after the detection information of the second sensor 55 described above changes, the trailing end of the sheet S1 one surface of which has been subjected to recording reaches a position at which a predetermined amount of the sheet S1 remains inside the apparatus. Then, as illustrated in FIG. 38, the switch back mechanism 65 starts moving the guide member 64 from the first pivot position illustrated in FIG. 37 to the second pivot position illustrated in FIG. 38. This switching is performed by, for example, releasing the locking of the cam disk 84 by the solenoid link 88 by supplying power to the solenoid 87 after performing timekeeping of a suitable time by a timer after the occurrence of change of the detection information of the second sensor 55 described above.

As a result of this, the guide member 64 returns from the second pivot position illustrated in FIGS. 12 and 18 to the first pivot position illustrated in FIGS. 7 and 9 as illustrated in FIG. 38. That is, the guide member 64 returns to the first pivot position illustrated in FIGS. 7 and 9 at which the sheet S0 both surfaces of which have been subjected to recording is guided to the nipping portion of the sheet discharge conveyance roller unit 98.

Figure 39:
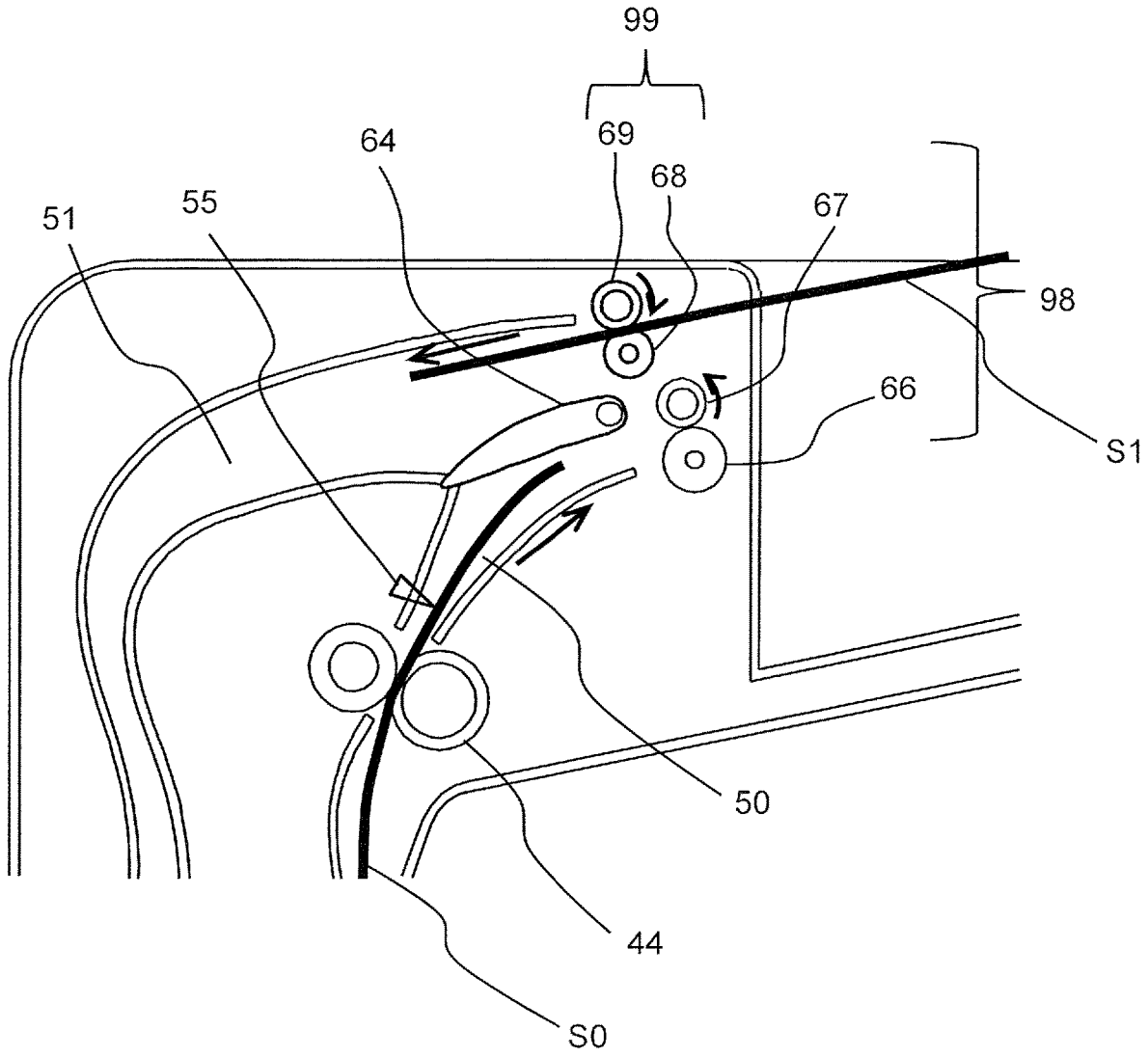
FIG. 39 is an explanatory diagram illustrating the sheet conveyance operation in the successive duplex recording according to the fourth exemplary embodiment of the present invention.

To be noted, at the time of FIG. 38, the inversion conveyance roller 69 is still rotating in the counterclockwise direction by the reverse rotation driving and conveying the sheet one surface of which has been subjected to recording to the outside of the apparatus by the nipping portion of the inversion conveyance roller unit 99. However, thereafter, when the guide member 64 moves to the first pivot position or to the vicinity thereof, the interlocking mechanism of the switch back mechanisms 65A and 65B, that is, the carrier control portion 72*c* of the guide link member 72 and the locking portion 92*b* of the carrier disk 92 are unlocked. This can be expressed by the change from FIG. 15 to FIG. 14. As a result of this, the inversion conveyance roller 69 is switched to normal rotation driving as illustrated in FIG. 39, and rotates in a clockwise direction. In this state, the sheet discharge conveyance roller 67 discharges the sheet S0 both surfaces of which have been subjected to recording to the outside of the apparatus through the first conveyance path 50, and the inversion conveyance roller 69 conveys the sheet S1 one surface of which has been subjected to recording into the second conveyance path 51.

Figure 40:
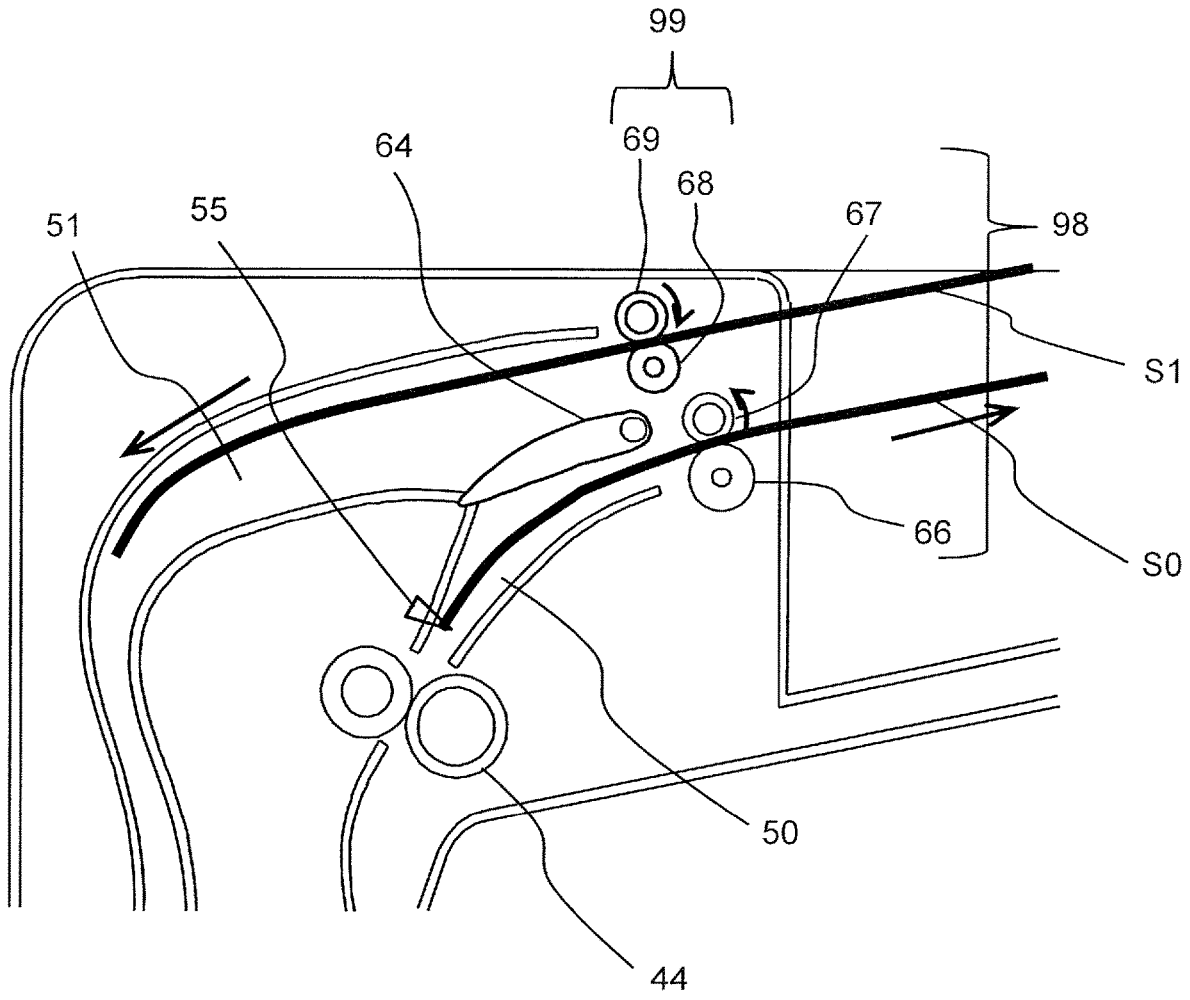
FIG. 40 is an explanatory diagram illustrating the sheet conveyance operation in the successive duplex recording according to the fourth exemplary embodiment of the present invention.
Figure 41:
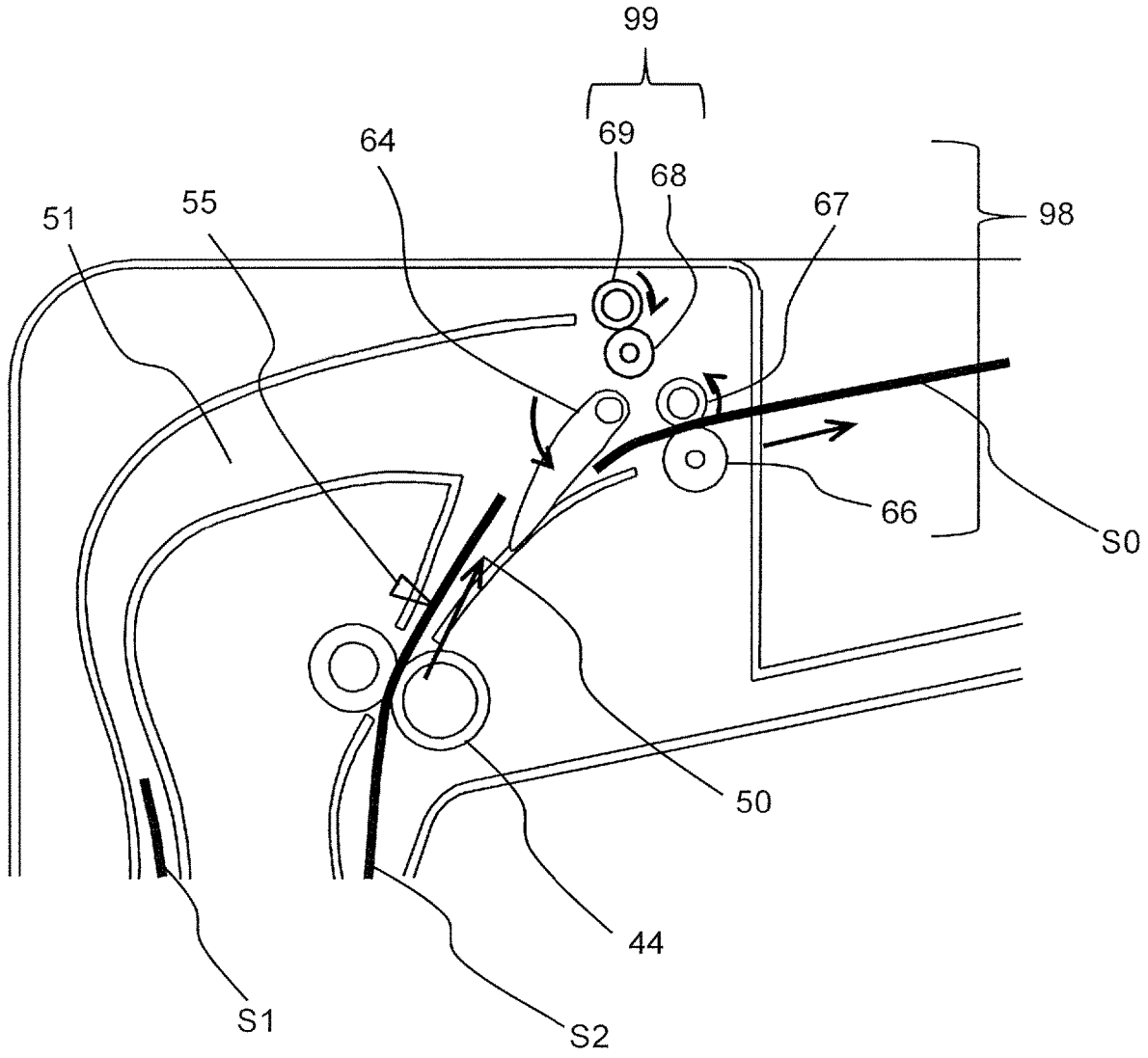
FIG. 41 is an explanatory diagram illustrating the sheet conveyance operation in the successive duplex recording according to the fourth exemplary embodiment of the present invention.
Figure 42:
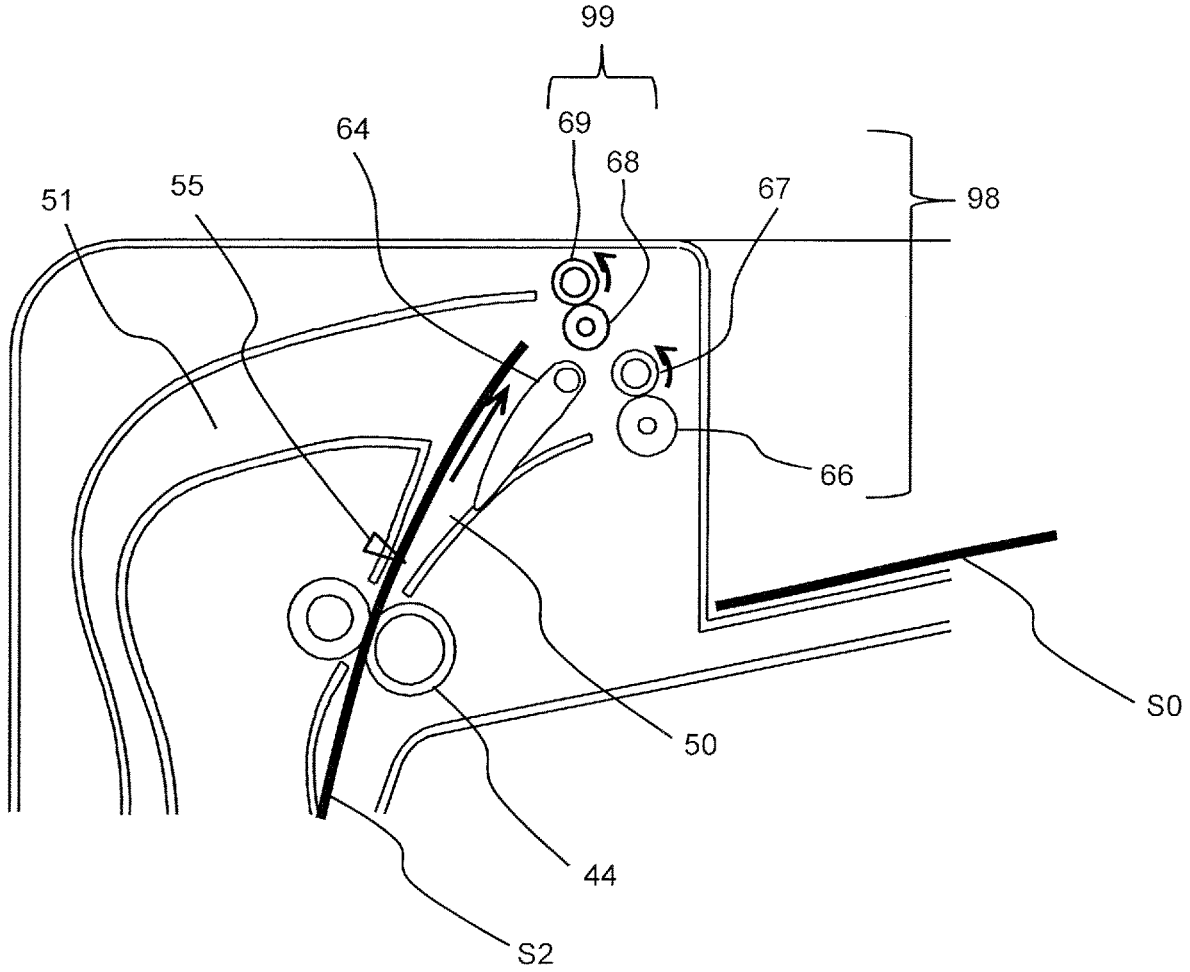
FIG. 42 is an explanatory diagram illustrating the sheet conveyance operation in the successive duplex recording according to the fourth exemplary embodiment of the present invention.

When this state further progresses, conveyance of the sheets S1 and S0 is performed as illustrated in FIG. 40. Further, the sheet S0 both surfaces of which have been subjected to recording is discharged to the outside of the apparatus as illustrated in FIGS. 41 and 42. Meanwhile, in the present exemplary embodiment, the sheet S2 one surface of which has been subjected to recording is switched back and conveyed by effectively using the interval between the sheets S0 and S1 as illustrated in FIGS. 41 and 42.

That is, on the basis of the detection information of the trailing end and leading end of the sheet S2 or S0 described above by the second sensor 55, the switch back mechanism 65 operates to perform switch-back conveyance of the subsequent sheet S2 one surface of which has been subjected to recording. For example, when such a conveyance state as illustrated in FIG. 41 is generated, the switch back mechanism 65 starts moving the guide member 64 from the first pivot position to the second pivot position on the basis of the detection state of the second sensor 55. That is, the switch back mechanism 65 starts moving the guide member 64 to the second pivot position so as to guide the subsequent sheet S2 one surface of which has been subjected to recording to the nipping portion of the inversion conveyance roller unit 99. The conveyance control of the switch back mechanism 65 at this time is the same as the conveyance control described with reference to FIG. 35. To be noted, in FIG. 41, for example, the trailing end of the sheet S0 both surfaces of which have been subjected to recording is at a position at which a predetermined amount of the sheet S0 remains inside the apparatus. In addition, the leading end of the subsequent sheet S2 one surface of which has been subjected to recording has passed the fixing portion 44 and the second sensor 55, and reached a position in the vicinity of the distal end of the guide member 64. In addition, the sheet S1 is being conveyed in the second conveyance path 51 for recording on the back surface thereof In addition, in FIG. 41, the switching of the inversion conveyance roller unit 99 from the normal rotation driving to the reverse rotation driving synchronized with the movement of the guide member 64 to the second pivot position has not occurred, and the normal rotation state of discharging the sheet S0 to the outside is still maintained.

When the sheet S0 both surfaces of which have been subjected to recording is discharged to the outside of the apparatus as illustrated in FIG. 42, in synchronization with the completion of movement of the guide member 64 to the second pivot position or a position in the vicinity thereof, the inversion conveyance roller 69 is switched to the reverse rotation driving. This switching of the inversion conveyance roller 69 from the normal rotation driving to the reverse rotation driving is, for example, as described above with reference to FIG. 36.

As described above, also according to the present exemplary embodiment, sheets can be efficiently conveyed with short inter-sheet intervals by using a pivoting section of the guide member 64.

Although exemplary embodiments of the present invention have been described above, the present invention should not be limited to the configurations of the exemplary embodiments described above. In addition, effects described in the exemplary embodiments of the present invention are merely a list of most preferable effects that can be obtained from the present exemplary embodiments, and the effects of the present invention are not limited to those described in the exemplary embodiments of the present invention. Further, the exemplary embodiments described above can be combined in any way.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-209838, Oct. 30, 2017 and Japanese Patent Application No. 2018-190128, Oct. 5, 2018 which are hereby incorporated by reference herein in their entirety.

What is claimed is:

1. A sheet conveyance apparatus comprising:

a sheet discharge section constituting a sheet discharge portion configured to convey and discharge a sheet;

a sheet inversion section comprising a reverse rotary member constituting a sheet inversion portion configured to invert and convey a sheet;

a guide member configured to pivot to a first pivot position to guide the sheet to the sheet discharge portion and a second pivot position to guide the sheet to the sheet inversion portion;

a rotation driving portion configured to generate a rotational driving force in only one rotation direction;

a first transmission mechanism configured to transmit the rotational driving force of the rotation driving portion such that the guide member pivots between the first pivot position and the second pivot position;

a second transmission mechanism configured to transmit the rotational driving force of the rotation driving portion to the reverse rotary member such that the reverse rotary member is rotationally driven in a normal rotation direction or a reverse rotation direction; and an interlocking mechanism configured to interlock the first transmission mechanism and the second transmission mechanism such that the second transmission mechanism switches a rotational driving direction of the reverse rotary member between the normal rotation direction and the reverse rotation direction with a delay with respect to the first transmission mechanism starting transmission of the rotational driving force such that the guide member pivots between the first pivot position and the second pivot position.

2. The sheet conveyance apparatus according to claim 1, wherein the sheet discharge section comprises:

a first rotary member; and a second rotary member disposed to oppose the first rotary member and configured to constitute the sheet discharge portion together with the first rotary member, and wherein the second rotary member also serves as the reverse rotary member.

3. The sheet conveyance apparatus according to claim 2, wherein the sheet inversion section comprises a third rotary member disposed to oppose the second rotary member and configured to be rotated in accordance with the second rotary member.

4. The sheet conveyance apparatus according to claim 3, wherein the interlocking mechanism maintains a current rotational driving direction of the reverse rotary member when the first transmission mechanism starts moving the guide member from the first pivot position toward the second pivot position, and switches the rotational driving direction of the reverse rotary member to the reverse rotation direction when the guide member reaches at least the second pivot position, and wherein the interlocking mechanism maintains a current rotational driving direction of the second rotary member when the first transmission mechanism starts moving the guide member from the second pivot position toward the first pivot position, and switches the rotational driving direction of the reverse rotary member to the normal rotation direction when the guide member reaches at least the first pivot position.

5. The sheet conveyance apparatus according to claim 1, wherein the sheet discharge section comprises a discharge roller pair configured to convey and discharge the sheet, and wherein the sheet inversion section comprises an inversion conveyance roller pair constituted by a driven roller and the reverse rotary member, the driven roller being disposed to oppose the reverse rotary member and configured to be rotated in accordance with the reverse rotary member.

6. The sheet conveyance apparatus according to claim 1, wherein the first transmission mechanism comprises a disconnection mechanism and a drive source configured to drive the disconnection mechanism, the disconnection mechanism being disposed in a first drive transmission path from the rotation driving portion to the guide member and configured to disconnect transmission of drive from the rotation driving portion to the guide member, wherein the second transmission mechanism comprises a normal/reverse unit disposed in a second drive transmission path from the rotation driving portion to the reverse rotary member and configured to be switchable between a normal rotation state in which a rotation direction of the reverse rotary member is the normal rotation direction and a reverse rotation state in which the rotation direction of the reverse rotary member is the reverse rotation direction, wherein the interlocking mechanism comprises a switching unit connected to the first transmission mechanism at a position downstream of the disconnection mechanism in a drive transmission direction in the first drive transmission path and configured to switch a state of the normal/reverse unit by a drive transmitted from the first transmission mechanism, and wherein the switching unit is configured to receive the drive transmitted from the first transmission mechanism to transition from a first state or a second state to the second state or the first state through a transition state and, in the transition state, maintain a rotation state of the normal/reverse unit, the first state being a state in which the normal/reverse unit is in the normal rotation state, the second state being a state in which the normal/reverse unit is in the reverse rotation state.

7. The sheet conveyance apparatus according to claim 6, wherein the switching unit comprises:

a switching member configured to be movable between a first position and a second position, the first position being a position at which the normal/reverse unit takes the normal rotation state when the normal/reverse unit is not engaged with an engaged member, the second position being a position at which the normal/reverse unit takes the reverse rotation state when the normal/reverse unit is engaged with the engaged member;

a regulation member configured to regulate a position of the switching member; and a movable member movable between an engagement position and a separation position, the engagement position being a position at which the movable member receives a driving force from the first transmission mechanism and engages with the regulation member, the separation position being a position at which the movable member is separated from the regulation member, and wherein, in a case of transitioning from the first state to the second state, the movable member moving from the separation position toward the engagement position in a state in which the movable member is separated from the regulation member causes the switching unit to take the transition state, and, in a case of transitioning from the second state to the first state, the switching member moving from the first position to the second position in a state in which the switching member is not engaged with the engaged member causes the switching unit to take the transition state.

8. The sheet conveyance apparatus according to claim 7, wherein the first transmission mechanism comprises:

a guide cam configured to rotate by the rotational driving force of the rotation driving portion; and a guide link member configured to pivot along a cam surface of the guide cam in accordance with rotation of the guide cam and cause the guide member to pivot between the first pivot position and the second pivot position, and wherein the movable member is connected to the guide link member and pivots in a first pivot direction and a second pivot direction in accordance with pivoting of the guide link member, the first pivot direction being a direction from the engagement position to the separation position, the second pivot direction being a direction from the separation position to the engagement position, which is opposite to the first pivot direction.

9. The sheet conveyance apparatus according to claim 8, wherein the disconnection mechanism comprises:

a cam disk configured to hold the guide cam at a position corresponding to the first pivot position and a position corresponding to the second pivot position; and a connecting member configured to establish drive connection between the guide cam and a driving member rotationally driven by the rotation driving portion, and wherein, in a holding state in which a pivot position of the guide cam is held at the position corresponding to the first pivot position or the position corresponding to the second pivot position, the cam disk causes the connecting member to take a disconnected state in which the drive connection between the guide cam and the driving member is disconnected.

10. The sheet conveyance apparatus according to claim 9, wherein the disconnection mechanism comprises a solenoid link configured to switch the cam disk between the holding state and a cancelling state in which holding of the guide cam by the cam disk is cancelled and the guide cam and the driving member are in drive connection, and wherein the drive source comprises a solenoid configured to drive the solenoid link.

11. The sheet conveyance apparatus according to claim 7, further comprising a driving member rotationally driven by the rotation driving portion, wherein the engaged member is the driving member, wherein the normal/reverse unit comprises a first idler gear, a second idler gear, and a carrier rotatably supporting the first idler gear and the second idler gear, wherein the switching member is provided on the carrier, wherein, at the first position at which the switching member is not engaged with the driving member, the carrier is fixed, and wherein, at the second position at which the switching member is engaged with the driving member, the carrier rotates with the first idler gear and the second idler gear in an integrated manner.

* * * * *